US009567930B2

(12) United States Patent
Sakayanagi et al.

(10) Patent No.: US 9,567,930 B2
(45) Date of Patent: Feb. 14, 2017

(54) INTERNAL COMBUSTION ENGINE CONTROL DEVICE

(75) Inventors: Yoshihiro Sakayanagi, Mishima (JP); Mitsuji Sampei, Funabashi (JP); Kazuma Sekiguchi, Tokyo-to (JP); Kohei Tahara, Yamaguchi (JP); Hironori Ito, Yokohama (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 95 days.

(21) Appl. No.: 14/408,352

(22) PCT Filed: Jun. 26, 2012

(86) PCT No.: PCT/JP2012/066264

§ 371 (c)(1),
(2), (4) Date: Dec. 16, 2014

(87) PCT Pub. No.: WO2014/002189

PCT Pub. Date: Jan. 3, 2014

(65) Prior Publication Data

US 2015/0152804 A1 Jun. 4, 2015

(51) Int. Cl.

| | |
|---|---|
| ***F02D 41/24*** | (2006.01) |
| ***F02D 41/14*** | (2006.01) |
| ***F02D 28/00*** | (2006.01) |

(52) U.S. Cl.

CPC ..... *F02D 41/1402* (2013.01); *F02D 28/00* (2013.01); *F02D 41/248* (2013.01); *F02D 41/2416* (2013.01)

(58) Field of Classification Search

CPC F02D 41/1402; F02D 41/248; F02D 41/2416; F02D 41/2422; F02D 41/2438; F02D 41/2441; F02D 41/2445; F02D 41/2477; F02D 28/00

(Continued)

(56) References Cited

U.S. PATENT DOCUMENTS

| | | | |
|---|---|---|---|
| 4,466,410 | A | 8/1984 | Sakakibara et al. |
| 4,676,215 | A | 6/1987 | Blöcher et al. |

(Continued)

FOREIGN PATENT DOCUMENTS

| | | |
|---|---|---|
| JP | 4-175434 | 6/1992 |
| JP | 9-79072 | 3/1997 |

(Continued)

*Primary Examiner* — Hai Huynh

(74) *Attorney, Agent, or Firm* — Finnegan, Henderson, Farabow, Garrett & Dunner, LLP

(57) ABSTRACT

An engine is provided with an ECU for executing engine control by using various control parameters. The ECU includes a learning map storing a learning value of the control parameter and executes weighting learning control of the learning value. In the weighting learning control, each time the control parameter is acquired, a weight $w_{kij}$ decreasing larger if a distance from a position of an acquired value $z_k$ of the control parameter to a grid point is larger is set to each of the grid points of the learning map. Then, on the basis of the acquired value $z_k$ of the control parameter and the weight $w_{kij}$, the learning values $Z_{ij}(k)$ at all the grid points are updated. As a result, all the learning values can be efficiently updated in one session of the learning operation.

24 Claims, 18 Drawing Sheets

(58) Field of Classification Search
USPC ..... 701/102–106, 108, 110, 111
See application file for complete search history.

(56) References Cited

U.S. PATENT DOCUMENTS

| | | | |
|---|---|---|---|
| 4,901,240 | A | 2/1990 | Schmidt et al. |
| 6,209,515 | B1 | 4/2001 | Gotoh et al. |
| 2005/0085981 | A1 | 4/2005 | Cicala et al. |
| 2005/0107943 | A1 | 5/2005 | Asano et al. |
| 2009/0259385 | A1 | 10/2009 | Loeffler et al. |

FOREIGN PATENT DOCUMENTS

| | | |
|---|---|---|
| JP | 2000-38944 | 2/2000 |
| JP | 2005-146947 | 6/2005 |
| JP | 2007-176372 | 7/2007 |
| JP | 2008-138596 | 6/2008 |
| JP | 2009-46988 | 3/2009 |
| JP | 2009-250243 | 10/2009 |
| JP | 2010-209886 | 9/2010 |

INTERNAL COMBUSTION ENGINE CONTROL DEVICE

CROSS-REFERENCE TO RELATED APPLICATIONS

This application is a national phase application of International Application No. PCT/JP2012/066264, filed Jun. 26, 2012, the content of which is incorporated herein by reference.

TECHNICAL FIELD

The present invention relates to an internal combustion engine control device provided with a learning map of control parameters.

BACKGROUND ART

As a prior art, as disclosed in Patent Literature 1 (Japanese Patent Laid-Open No. 2009-046988), for example, an internal combustion engine control device provided with a learning map of control parameters is known. Learning values for correcting the control parameters are stored in each of grid points of the learning map, respectively. In the prior art, it is configured that, when the control parameter to be learned is acquired, four grid points located in the periphery of the acquired value are selected on the learning map, and the learning values at these four grid points are updated. In this learning control, the acquired value of the control parameter is weighted and then, reflected in the learning values of the grid points on the periphery, but the weighting at this time is set so that the closer a distance between the position of the acquired value and the grid point is, the larger the weighting becomes.

The applicant recognizes the following Literatures including the above-described Literature as those relating to the present invention.

CITATION LIST

Patent Literature

Patent Literature 1: Japanese Patent Laid-Open No. 2009-046988

Patent Literature 2: Japanese Patent Laid-Open No. 9-079072

Patent Literature 3: Japanese Patent Laid-Open No. 2009-250243

Patent Literature 4: Japanese Patent Laid-Open No. 2005-146947

Patent Literature 5: Japanese Patent Laid-Open No. 2000-038944

Patent Literature 6: Japanese Patent Laid-Open No. 4-175434

Patent Literature 7: Japanese Patent Laid-Open No. 2007-176372

SUMMARY OF INVENTION

Technical Problem

In the above-described prior art, it is configured that the learning control is executed for the four learning values located in the periphery of the acquired value of the control parameter so that the closer to the acquired value the grid point is, the larger the weighting becomes. However, in the prior art, the learning values updated in one session of a learning operation is limited only to the four, and the learning value is not updated at a grid point away from the acquired value of the control parameter and thus, there is a problem that learning efficiency is low. Moreover, in the periphery of the grid point at which the learning value is not updated, there is a concern of mis-learning.

The present invention was made in order to solve the above-described problems and has an object to provide an internal combustion engine control device which can update the learning values at a large number of grid points in one session of the learning operation and can easily adjust learning characteristics (learning speed or efficiency) in a wide learning region.

Means for Solving the Problem

A first aspect of the present invention is a control device for internal combustion engine, comprising:

a learning map having a plurality of grid points and storing a learning value of a control parameter used for control of an internal combustion engine at each of the grid points, capable of being updated;

weight setting means for setting a weight of each grid point of the learning map when the control parameter is acquired and for decreasing the weight of the grid point as a distance from a reference position which is a position of the acquired value of the control parameter on the learning map to the grid point becomes larger; and weighting learning means for executing weighting learning control for updating the learning value of the respective grid points so that, each time the control parameter is acquired, the larger the weight is, the more the acquired value of the control parameter is reflected in the learning value at all the grid points.

A second aspect of the present invention, wherein:

the learning map includes a plurality of regions different from each other; and the weight setting means is configured to switch a decrease characteristic of the weight decreasing in accordance with the distance from the reference position for each of the plurality of regions.

A third aspect of the present invention, wherein:

at a grid point where the distance from the reference position is larger than a predetermined effective range, update of the learning value is prohibited.

A fourth aspect of the present invention, wherein:

the weight setting means is a Gaussian function in which the weight decreases in a normal distribution curve state in accordance with the distance from the reference position.

A fifth aspect of the present invention, wherein:

the weight setting means is a primary function in which the weight decreases in proportion to the distance from the reference position.

A sixth aspect of the present invention, wherein:

the weight setting means is a trigonometric function in which the weight decreases in a sinusoidal wave state in accordance with the distance from the reference position.

A seventh aspect of the present invention, further comprising:

a reliability map having a plurality of grid points configured similarly to the learning map and storing a reliability evaluation value which is an index indicating reliability of the learning value at each of the grid points, capable of being updated;

reliability map weight setting means which is means for decreasing a reliability weight which is a weight of each grid point of the reliability map larger as the distance from the reference position to the grid point becomes larger and in which the decrease characteristic of the reliability weight is set steeper than the decrease characteristic of the weight of the learning map; and reliability map learning means for setting a reliability acquired value having a value corresponding to reliability of the acquired value to the reference position each time the control parameter is acquired and for updating the reliability evaluation value of the respective grid points so that, the larger the reliability weight is, the more the reliability acquired value is reflected in the reliability evaluation value at all the grid points of the reliability map.

An eighth aspect of the present invention is a control device for internal combustion engine, comprising:

an MBT map which is a learning map having a plurality of grid points and storing a learning value of an MBT which is ignition timing when a torque of an internal combustion engine becomes a maximum at each of the grid points, capable of being updated;

combustion gravity center calculating means for calculating a combustion gravity center on the basis of an in-cylinder pressure;

ignition timing correcting means for correcting the ignition timing calculated by the MBT map so that the combustion gravity center matches a predetermined combustion gravity center target value;

weight setting means which is means for setting a weight of each grid point of the MBT map on the basis of the ignition timing after correction by the ignition timing correcting means, respectively, and for decreasing the weight of the grid point such that, the larger a distance from a reference position which is a position of the ignition timing after correction on the MBT map to the grid point is, the more the weight of the grid point is decreased; and weighting learning means for executing weighting learning control updating the learning value of the respective grid points so that, if the combustion gravity center matches the combustion gravity center target value, at all the grid points, the larger the weight is, the more the ignition timing after correction is reflected in the learning value of the MBT.

A ninth aspect of the present invention, wherein:

an update amount of the learning value in a transition operation of an internal combustion engine is configured to be suppressed as compared with that in a steady operation.

A tenth aspect of the present invention, further comprising:

MBT estimating means for estimating an MBT on the basis of a difference between the combustion gravity center and the combustion gravity center target value and the ignition timing after correction; and MBT full-time learning means which is means used instead of the weighting learning means and for updating the learning value of the MBT by the weighting learning control even if the combustion gravity center is deviated from the combustion gravity center target value and for lowering a degree of reflection of the estimated value of the MBT in the learning value as the difference between the combustion gravity center and the combustion gravity center target value becomes larger.

An eleventh aspect of the present invention, further comprising:

a TK map which is a learning map having a plurality of grid points configured similarly to the MBT map and storing a learning value of TK ignition timing which is ignition timing in a trace knock region at each of the grid points, capable of being updated, respectively;

TK ignition timing learning means for acquiring the ignition timing when the trace knock occurs before the MBT is realized and for updating the learning value of the TK ignition timing on the basis of the acquired value by the weighting learning control; and selecting means for selecting the ignition timing on a more delayed angle side in the learning values calculated by the MBT map and the learning values calculated by the TK map.

A twelfth aspect of the present invention, further comprising:

a TK region map which is a learning map having a plurality of grid points configured similarly to the TK map and storing a learning value on whether or not the respective grid points of the TK map belong to a trace knock region at each of the grid points, capable of being updated, respectively; and TK region learning means for updating the learning value of the TK region map by the weighting learning control when the TK ignition timing is acquired.

A thirteenth aspect of the present invention, further comprising:

a reliability map which is a learning map having a plurality of grid points configured similarly to the MBT map and storing a reliability evaluation value reflecting a learning history of the MBT at each of the grid points, capable of being updated, respectively; and reliability map learning means for updating the reliability evaluation value by the weighting learning control on the basis of the reference position when the MBT map is updated.

A fourteenth aspect of the present invention, wherein:

the learning map is a correction map storing a learning value of a correction coefficient for correcting an in-cylinder air-fuel ratio on the basis of an output of an air-fuel ratio sensor at each of the grid point, respectively;

in-cylinder air-fuel ratio calculating means for calculating the in-cylinder air-fuel ratio on the basis of at least an output of an in-cylinder pressure sensor is provided;

the weight setting means sets a weight at each grid point of the correction map by using a calculated value of the correction coefficient calculated on the basis of the in-cylinder air-fuel ratio after correction corrected by the correction coefficient and the output of the air-fuel ratio sensor as an acquired value of the control parameter; and the weighting learning means is configured to update the learning value of the correction coefficient at each of the grid points on the basis of the calculated value of the correction coefficient and the weight at each of the grid points.

A fifteenth aspect of the present invention, wherein:

the learning map is an injection characteristic map storing a relationship between a target injection amount of a fuel injection valve and conduction time as a learning value of the conduction time at each of the grid point, respectively;

actual injection amount calculating means for calculating an actual injection amount on the basis of at least an output of an in-cylinder pressure sensor is provided;

the weight setting means sets a weight at each grid point of the injection characteristic map by using the conduction time after correction corrected on the basis of the target injection amount and the actual injection amount as an acquired value of the control parameter; and the weighting learning means is configured to update the learning value of the conduction time at each of the grid points on the basis of the conduction time after correction and the weight at each of the grid points.

A sixteenth aspect of the present invention, wherein:

the learning map is a correction map storing a learning value of a correction coefficient for correcting an output of an airflow sensor at each of the grid points, respectively;

learning reference calculating means for calculating a learning reference value of the correction coefficient on the basis of an output of the air-fuel ratio sensor and a fuel injection amount is provided; and the learning value of the correction coefficient is configured to be updated by executing the weighting learning control by using the learning reference value of the correction coefficient as an acquired value of the control parameter.

A seventeenth aspect of the present invention, wherein:

the learning map is a QMW map storing a learning value of a wall-surface fuel adhesion amount which is an amount of a fuel adhering to a wall surface of an intake passage at each of the grid points, respectively;

learning reference calculating means for calculating a learning reference value of the wall-surface fuel adhesion amount on the basis of at least an output of an air-fuel ratio sensor is provided; and the learning value of the wall-surface fuel adhesion amount is configured to be updated by executing the weighting learning control by using the learning reference value of the wall-surface fuel adhesion amount as an acquired value of the control parameter.

An eighteenth aspect of the present invention, wherein:

the learning map is a VT map storing a learning value of valve timing at which fuel consumption of an internal combustion engine is optimized at each of the grid points, respectively;

learning reference calculating means for calculating a learning reference value of the valve timing on the basis of at least an output of an in-cylinder sensor is provided; and the learning value of the valve timing is configured to be updated by executing the weighting learning control by using the learning reference value of the valve timing as an acquired value of the control parameter.

A nineteenth aspect of the present invention, wherein:

the learning map is a misfire limit map storing a learning value of misfire limit ignition timing which is ignition timing on the most delayed angle side capable of being realized without occurrence of a misfire by ignition timing delay-angle control at each of the grid points, respectively;

misfire limit determining means for determining whether or not the current ignition timing is a misfire limit;

misfire limit learning means for acquiring the ignition timing when being determined to be the misfire limit and for updating the learning value of the misfire limit ignition timing by the weighting learning control on the basis of the acquired value; and selecting means for selecting the ignition timing on the more advance-angle side in target ignition timing delayed by the ignition timing delay-angle control and the learning values calculated by the misfire limit map are provided.

A twentieth aspect of the present invention, wherein:

the learning map is a fuel increase amount map storing a learning value of a fuel increase amount value for increasing a fuel injection amount at each of the grid points, respectively; and a learning value of the fuel increase amount value is configured to be updated by the weighting learning control.

A twenty-first aspect of the present invention, wherein:

the learning map is an ISC map storing a learning value of an opening degree of an intake passage corrected by idle operation control at each of the grid points, respectively; and the learning value of the opening degree of the intake passage is configured to be updated by the weighting learning control.

A twenty-second aspect of the present invention, wherein:

the learning map is a misfire limit EGR map storing a learning value of a misfire limit EGR amount which is a maximum EGR amount capable of being realized without occurrence of a misfire by EGR control at each of the grid points, respectively;

misfire limit determining means for determining whether or not the current ignition timing is a misfire limit;

misfire limit EGR learning means for acquiring an EGR amount when being determined to be the misfire limit and updating the learning value of the misfire limit EGR amount on the basis of the acquired value by the weighting learning control; and selecting means for selecting the larger EGR amount in a requested EGR amount calculated by the EGR control and the learning value calculated by the misfire limit EGR map.

A twenty-third aspect of the present invention, wherein:

the learning map is a correction map storing a learning value of a correction coefficient for correcting an output of an air-fuel ratio sensor, respectively; learning reference calculating means for acquiring an output value of the air-fuel ratio sensor when an output of an oxygen concentration sensor becomes an output value corresponding to a stoichiometric air-fuel ratio as a reference output value and calculating a learning reference value of the correction coefficient on the basis of the reference output value is provided; and the learning value of the correction coefficient is configured to be updated by executing the weighting learning control by using the learning reference value of the correction coefficient as an acquired value of the control parameter.

A twenty-fourth aspect of the present invention, wherein:

the learning map is a start injection amount map storing a learning value of a start injection amount of a fuel injected at start of an internal combustion engine, respectively;

learning reference calculating means for calculating a learning reference value of the start injection amount on the basis of at least an output of an in-cylinder pressure sensor; and the learning value of the start injection amount is configured to be updated by executing the weighting learning control by using the learning reference value of the start injection amount as an acquired value of start injection amount.

Advantageous Effects of Invention

According to the first invention, in weighting learning control, not only a grid point which is the closest to the acquired value of the control parameter but also the learning values at all the grid points can be appropriately updated while being weighted in accordance with a distance by performing one session of the learning operation. As a result, even if learning chances are fewer, the learning values at all the grid points can be optimized quickly by the minimum number of learning times. Moreover, even if the learning value is lost or an unlearned state continues at a part of the grid points, these learning values can be compensated for by the learning operation at other positions. Therefore, regardless of a type of the control parameter, learning efficiency is improved, and reliability of the learning control can be improved. Furthermore, in accordance with a decrease characteristic of a weight set by weighting means, the learning speed or efficiency can be easily adjusted in a wide learning region. Furthermore, since consecutive averaging processing is executed each time the control parameter is acquired, an influence of disturbance (noises and the like) to the learning value can be removed. Moreover, since a calculation load of the learning value can be temporally distributed by the consecutive processing, the calculation load of the learning processing can be alleviated.

According to the second invention, the weight setting means can switch the weight decrease characteristic in accordance with each of a plurality of regions. As a result, by making a setting capable of a rapid change in the weight in a region requiring rapid learning, for example, learning responsiveness and control efficiency can be improved, and an operation such as failsafe can be made stable. Moreover, in a region where gentle learning is allowed, by making a setting of a gentle change in a grid-point range in which the weight is relatively wide, the calculation load in learning can be suppressed, and the learning map can be made smooth. Therefore, the weighting conforming to the entire learning map can be easily realized. Moreover, responsiveness, a speed, efficiency and the like of the learning at all the grid points can be switched in accordance with the characteristics of the region to which the acquired value of the control parameter belongs.

According to the third invention, at a grid point at which a distance from a reference position is larger than a predetermined effective range, update of the learning value can be prohibited. As a result, since the grid point at which the learning value is updated can be limited to the effective range, wasteful update of the learning value at the grid point with small learning effect can be avoided, and the calculation load of the learning processing can be alleviated.

According to the fourth invention, by using Gaussian function as the weight setting means, the weight can be smoothly changed in accordance with a distance from the position (reference position) of the acquired value of the control parameter. Therefore, the learning map can be made smooth, and deterioration of controllability caused by a rapid change in the learning value and the like can be suppressed. Moreover, the decrease characteristic of the weight can be changed in accordance with setting of standard deviation $\sigma$ of the Gaussian function, and the learning speed or efficiency can be easily adjusted in a wide learning region.

According to the fifth invention, by using a primary function as the weight setting means, the calculation load when the weight is calculated can be drastically reduced.

According to the sixth invention, by using a trigonometric function as the weight setting means, while the calculation load of the weight is decreased more than the Gaussian function, the weight can be reduced smoothly similarly to the case in which the Gaussian function is used.

According to the seventh invention, in a reliability evaluation value of each grid point of a reliability map, reliability of the learning value at the same grid point can be reflected. And by executing the weighted learning control of the reliability evaluation value, a reliability acquired value can be reflected in the reliability evaluation value at each grid point at the same degree of reflection as that when the acquired value of the control parameter is reflected in the learning value of each grid point. Therefore, the reliability of the learning value of each grid point can be efficiently calculated in one session of the learning operation. Moreover, if the learning value is used for various controls and the like, the reliability of the learning value can be evaluated on the basis of the reliability evaluation value of the corresponding grid point on the reliability map and appropriate corresponding control can be executed on the basis of the evaluation result.

According to the eighth invention, in learning control of ignition timing, the same working effect as that in the first invention can be obtained. Moreover, the weighted learning control is executed only when a combustion gravity center substantially matches a combustion gravity center target value, but since MBT can be efficiently learned at all the grid points of a MBT map in one session of the learning operation, even if the learning chances are fewer, learning can be made sufficiently.

According to the ninth invention, the more stable an operation state is when the ignition timing is acquired, that is, the higher the reliability of the acquired value of the ignition timing is, the larger an update amount of the learning value can be. On the other hand, if the operation state is unstable, the update amount of the learning value is set smaller, and the learning can be stopped or suppressed. As a result, learning in a steady operation can be promoted, and mis-learning in transition operation can be suppressed.

According to the tenth invention, even if the combustion gravity center deviates from the combustion gravity center target value, an estimated value of the MBT can be acquired all the time, and thus, the learning value can be updated on the basis of this estimated value, and the learning chances can be increased. As a result, the learning value can be brought closer to the MBT quickly, and controllability of MBT control can be improved. Moreover, the larger a difference between the combustion gravity center and the combustion gravity center target value is, that is, the lower the estimation accuracy of the MBT is, MBT full-time learning means can reduce the weight and can decrease the update amount of the learning value. Therefore, a degree of reflection of the estimated value of the MBT in the learning value can be adjusted appropriately in accordance with a degree of reliability of the estimated value, and mis-learning can be suppressed.

According to the eleventh invention, in learning of the ignition timing, either of the MBT and TK ignition timing can be learned, and thus, the learning chances can be increased, and the ignition timing can be efficiently learned other than an MBT region. Moreover, since selecting means can select the ignition timing on an advanced angle side from the MBT learning value and a TK learning value, the ignition timing can be controlled to the advanced angle side as much as possible and operation performances and operation efficiency can be improved while occurrence of knocking is avoided.

According to the twelfth invention, by using a TK region map, a boundary of a TK region can be made clear, and thus, mis-learning of the TK ignition timing in a region other than a TK region can be suppressed, and learning accuracy can be improved.

According to the thirteenth invention, the reliability map in the seventh invention can be applied to the eighth to twelfth inventions. As a result, when the learning value of the ignition timing is used for various controls and the like, reliability of the learning value of the ignition timing can be evaluated on the basis of the reliability evaluation value of the corresponding grid point on the reliability map, and appropriate corresponding control can be executed on the basis of the evaluation result.

According to the fourteenth invention, in calculation control of an in-cylinder air-fuel ratio, the same working effect as that in the first invention can be obtained. Particularly, the in-cylinder air-fuel ratio calculated by an in-cylinder sensor has a large error caused by a change in the operation state and thus, practicability cannot be easily improved even by using a correction coefficient acquired by a prior-art learning method. On the other hand, the weighting learning control can quickly learn the correction coefficients of all the grid points of a correction map even if the learning chances are relatively fewer. Therefore, even if an error of the in-cylinder air-fuel ratio is large, this error can be appropriately corrected by the correction coefficient, and the calculation accuracy and practicability of the in-cylinder air-fuel ratio can be improved.

According to the fifteenth invention, in the learning control of a fuel injection characteristic, the same working effect as that in the first invention can be obtained. Therefore, a change in the injection characteristic can be efficiently learned even in a small number of learning times, and accuracy of fuel injection control can be improved. Moreover, an actual injection amount can be calculated on the basis of an output of an in-cylinder pressure sensor, and learning can be executed on the basis of this actual injection amount and thus, even if an actual fuel injection amount cannot be detected, the learning control can be easily executed by using an existing sensor.

According to the sixteenth invention, in learning control of a correction coefficient for an airflow sensor, the same working effect as that in the first invention can be obtained. Therefore, the correction coefficient can be efficiently learned even in a small number of learning times, and calculation accuracy of an intake air amount can be improved.

According to the seventeenth invention, in learning control of a wall-surface fuel adhesion amount, the same working effect as that in the first invention can be obtained. Therefore, the wall-surface fuel adhesion amount can be efficiently learned even in a small number of learning times, and accuracy of fuel injection control can be improved.

According to the eighteenth invention, in learning control of valve timing, the same working effect as that in the first invention can be obtained. Therefore, the valve timing can be efficiently learned even in a small number of learning times, and controllability of a valve system can be improved.

According to the nineteenth invention, in learning control of misfire limit ignition timing, the same working effect as that in the first invention can be obtained, and a misfire limit can be efficiently learned. Moreover, selecting means can select a delay angle side in target ignition timing delayed by ignition timing delay-angle control and an ignition timing calculated by a misfire limit map. As a result, while a misfire is avoided, the ignition timing can be delayed to the maximum in response to a delay-angle request, and controllability of the ignition timing can be improved. Moreover, the weighting learning control is executed only when the misfire limit is reached, but since the misfire limit ignition timing can be efficiently learned at all the grid points of a misfire limit map in one session of the learning operation, even if the learning chances are fewer, learning can be made sufficiently.

According to the twentieth invention, in the learning control of a fuel increase amount value, the same working effect as that in the first invention can be obtained. Therefore, the fuel increase amount value can be efficiently learned even in a small number of learning times, and operation performances of the internal combustion engine can be improved.

According to the twenty-first invention, in learning control of ISC opening degree, the same working effect as that in the first invention can be obtained. Therefore, the ISC opening degree can be efficiently learned even in a small number of learning times, and stability of idling operation can be improved.

According to the twenty-second invention, in learning control of EGR, the same working effect as that in the first invention can be obtained, and a misfire limit EGR amount can be efficiently learned. Moreover, selecting means can select the larger of a requested EGR amount calculated by the EGR control and the misfire limit EGR amount. As a result, while a misfire is avoided, the EGR amount is ensured to the maximum in accordance with a request, and controllability of the EGR control can be improved. Moreover, the weighting learning control is executed only when the misfire limit is reached, but since the misfire limit EGR amount can be efficiently learned at all the grid points on the misfire limit EGR map in one session of the learning operation, even if learning chances are relatively fewer, learning can be made sufficiently.

According to the twenty-third invention, in output correction control of an air-fuel ratio sensor, the same working effect as that in the first invention can be obtained, and detection accuracy of an exhaust air-fuel ratio can be improved. Moreover, learning reference calculating means can acquire an output value of the air-fuel ratio sensor as a reference output value when an output of an oxygen concentration sensor becomes an output value corresponding to a stoichiometric air-fuel ratio and thus, a reference for correction can be easily acquired. Moreover, weighting learning means is executed only when the stoichiometric is detected by the oxygen concentration sensor, but since the correction coefficient can be efficiently learned at all the grid points of the correction map in one session of the learning operation, even if learning chances are relatively fewer, learning can be made sufficiently.

According to the twenty-fourth invention, in learning control of a start injection amount, the same working effect as that in the first invention can be obtained. Therefore, the start injection amount can be efficiently learned even in a small number of learning times, and startability of the internal combustion engine can be improved.

DESCRIPTION OF EMBODIMENTS

Embodiment 1

Configuration of Embodiment 1

Figure 1:
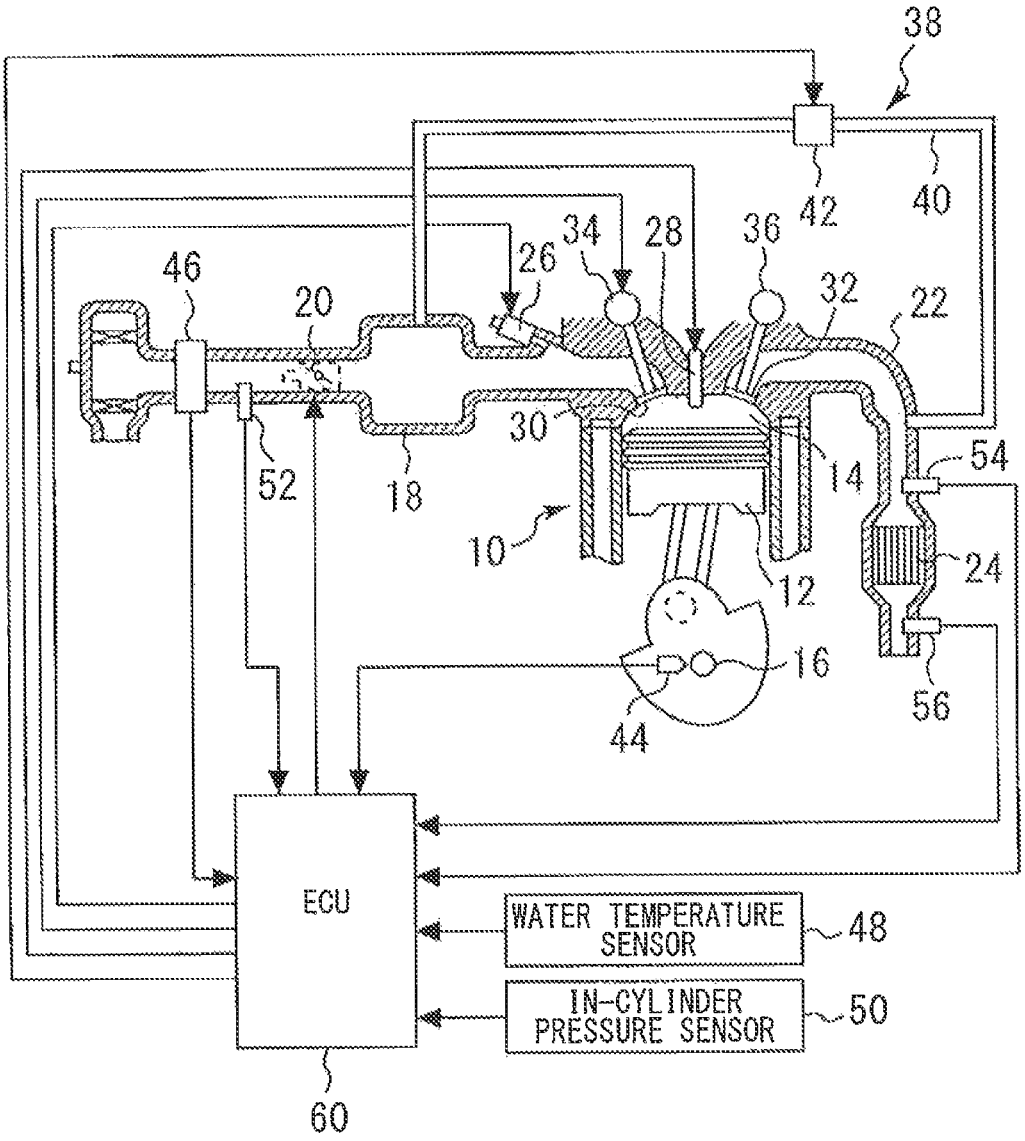
FIG. 1 is an entire configuration diagram for explaining a system configuration of Embodiment 1 of the present invention.

Embodiment 1 of the present invention will be explained below by referring to FIGS. 1 to 4. FIG. 1 is an entire configuration diagram for explaining a system configuration of Embodiment 1 of the present invention. The system of this embodiment is provided with a multiple-cylinder type engine 10 as an internal combustion engine. The present invention is applied to an internal combustion engine with an arbitrary number of cylinders including a single cylinder and a multiple cylinder, and FIG. 1 exemplifies one cylinder in a plurality of cylinders mounted on the engine 10. Moreover, the system configuration illustrated in FIG. 1 describes all the configurations required for Embodiments 1 to 22 of the present invention, and in the individual Embodiments, only those required in this system configuration can be employed.

In each of the cylinders in the engine 10, a combustion chamber 14 is formed by a piston 12, and the piston 12 is connected to a crank shaft 16. Moreover, the engine 10 is provided with an intake passage 18 for taking in an intake air into each of the cylinders, and in the intake passage 18, an electronically controlled throttle valve 20 for adjusting an intake air amount is provided. On the other hand, the engine 10 is provided with an exhaust passage 22 for exhausting an exhaust gas of each of the cylinders, and in the exhaust passage 22, a catalyst 24 such as a three-way catalyst or the like for purifying the exhaust gas is provided. Moreover, each of the cylinders of the engine is provided with a fuel injection valve 26 for injecting a fuel into an intake port, an ignition plug 28 for igniting an air mixture, an intake valve 30 for opening/closing the intake port, and an exhaust valve 32 for opening/closing an exhaust port. Moreover, the engine 10 is provided with an intake variable valve mechanism 34 for variably setting a valve opening characteristic of the intake valve 30 and an exhaust variable valve mechanism 36 for variably setting the valve opening characteristic of the exhaust valve 32. These variable valve mechanisms 34 and 36 are configured by a VVT (Variable Valve Timing system) described in Japanese Patent Laid-Open No. 2000-87769, for example. Moreover, the engine 10 is provided with an EGR mechanism 38 for refluxing a part of the exhaust gas to an intake system. The EGR mechanism 38 is provided with an EGR passage 40 connected between the intake passage 18 and the exhaust passage 22 and an EGR valve 42 for adjusting a flow rate of the exhaust gas flowing through the EGR passage 40.

Subsequently, a control system mounted on the system of this embodiment will be explained. The system of this embodiment is provided with a sensor system including various sensors required for operations of the engine and a vehicle and an ECU (Engine Control Unit) 60 for controlling an operation state of the engine. First, the sensor system will be described, and a crank angle sensor 44 outputs a signal synchronized with rotation of the crank shaft 16, and an airflow sensor 46 detects an intake air amount. Moreover, a water temperature sensor 48 detects a water temperature of an engine coolant, an in-cylinder pressure sensor 50 detects an in-cylinder pressure, and an intake temperature sensor 52 detects a temperature of the intake air (outside air temperature). An air-fuel ratio sensor 54 detects the exhaust air-fuel ratio as a continuous detection value and is arranged on an upstream side of the catalyst 24. An oxygen concentration sensor 56 detects which of the rich and lean the exhaust air-fuel ratio is to a stoichiometric air-fuel ratio and is arranged on a downstream side of the catalyst 24.

An ECU 60 is configured by an arithmetic processing device composed of a storage circuit composed of a ROM, a RAM, a nonvolatile memory and the like and an input/output port. The nonvolatile memory of the ECU 60 stores various learning maps which will be described later. To an input side of the ECU 60, each of sensors of the sensor system is connected, respectively. To an output side of the ECU 60, a throttle valve 20, a fuel injection valve 26, an ignition plug 28, variable valve mechanisms 34 and 36, an actuator such as the EGR valve 42 and the like are connected. The ECU 60 drives each of the actuators on the basis of operation information of the engine detected by the sensor system and executes operation control. Specifically, an engine rotation number and a crank angle are detected on the basis of an output of a crank angle sensor 44, and an intake air amount is detected by an airflow sensor 46. An engine load is calculated on the basis of the engine rotation number and the intake air amount, and a fuel injection amount is calculated on the basis of the intake air amount, the engine load, a water temperature and the like, and fuel injection timing and ignition timing are determined on the basis of the crank angle. When the fuel injection timing comes, the fuel injection valve 26 is driven, and when the ignition timing comes, the ignition plug 28 is driven. As a result, an air mixture is combusted in each of the cylinders, and the engine is operated.

Moreover, the ECU 60 executes, in addition to the above-described ignition timing control and the fuel injection control, air-fuel ratio feedback control for correcting the fuel injection amount so that an exhaust air-fuel ratio becomes a target air-fuel ratio such as a stoichiometric air-fuel ratio, valve timing control for controlling at least either one of the variable valve mechanisms 34 and 36 on the basis of the operation state of the engine, EGR control for controlling the EGR valve 42 on the basis of the operation state, and idle operation control for executing feedback control so that the engine rotation number in an idle operation becomes a target rotation number. Moreover, the ignition timing control includes ignition timing delay-angle control for delaying the ignition timing such as knock control, a variable speed response control, catalyst warming-up control and the like, for example. Any of the above-described various controls are known.

[Features of Embodiment 1]

(Weighting Learning Control)

In engine control in general, learning control for learning control parameters on the basis of acquired values of the various control parameters is executed. In this description, to "acquire" includes meanings of detection, counting, measurement, calculation, estimation and the like. In this embodiment, as the learning control, the weighting learning control described below is executed. The ECU 60 constitutes a learning device for executing the weighting learning control and is provided with a learning map having a plurality of grid points. In this embodiment, specific contents of the weighting learning control will be explained, and specific examples of the control parameters will be explained in Embodiment 7 which will be described later and after.

Figure 2:
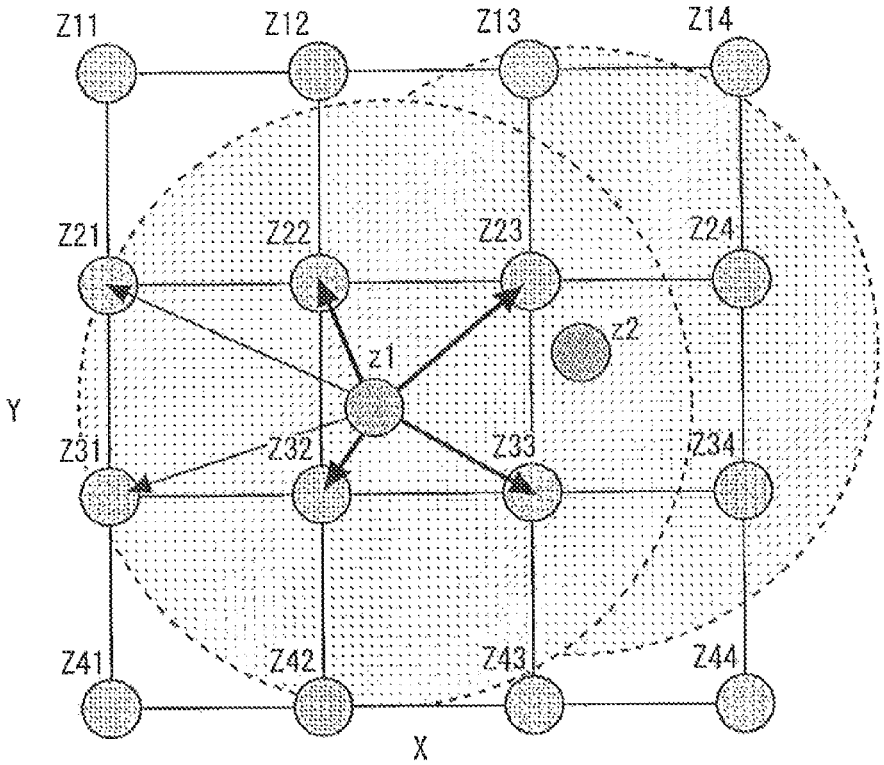
FIG. 2 is an explanatory diagram schematically illustrating an example of the learning map used in the weighting learning control.

FIG. 2 is an explanatory diagram schematically illustrating an example of the learning map used in the weighting learning control. This figure exemplifies a two-dimensional learning map from which one learning value is calculated on the basis of two reference parameters corresponding to the X-axis and the Y-axis. The learning map illustrated in FIG. 2 has 16 grid points whose coordinates i and j change within a range of 1 to 4. At each grid point (i, j) on the learning map, a learning value $Z_{ij}$ of the control parameter is stored, respectively, capable of being updated.

In the following explanation, it is assumed that variable values $z_k$, $w_{kij}$, $W_{ij}(k)$, $V_{ij}(k)$, $Z_{ij}(k)$ attached with suffixes k indicate the k-th value corresponding to the k-th acquiring timing (calculation timing), and variable values $w_{ij}$, $W_{ij}$, $V_{ij}$, $Z_{ij}$ without suffixes k indicate general values not discriminated by the acquiring timing. Moreover, FIG. 2 exemplifies a state in which the first and second acquired values $z_1$, $z_2$ of the control parameter are reflected in a learning value $Z_{ij}$ of all the grid points by arrows, and in order to make the figure easy to be understood, a part of the arrows are omitted, and an update range of the learning values are indicated by a circle.

In the weighting learning control, a learning value $Z_{ij}(k)$ at all the grid points (i, j) where learning is effective is updated basically on the basis of an acquired value of the control parameter acquired at the k-th session of (k-th) acquiring timing (parameter acquired value $z_k$) and a weight $w_{kij}$ at each grid point (i, j) set by a weighting function (weight setting means) which will be described later. In this embodiment, "all the grid points where learning is effective" means all the grid points present on the learning map. The update processing of the learning value $Z_{ij}(k)$ is realized by calculating the following equations in Formulas 1 to 3 at all the grid points (i, j).

$$W_{ij}(k)=W_{ij}(k-1)+w_{kij} \quad \text{[Formula 1]}$$

$$V_{ij}(k)=V_{ij}(k-1)+z_k*w_{kij} \quad \text{[Formula 2]}$$

$$Z_{ij}(k)=V_{ij}(k)/W_{ij}(k) \quad \text{[Formula 3]}$$

In the above-described equations, $W_{ij}(k)$ indicates a weight integrated value acquired by totaling the first to the k-th weights $w_{kij}$, and $V_{ij}(k)$ indicates a parameter integrated value acquired by totaling a multiplied value ($z_k*w_{kij}$) of the k-th parameter acquired values $z_k$ and the weight $w_{kij}$ for the first to k-th sessions. As is known from the above-described equations, the weighting learning control is to update the learning values $Z_{ij}(k)$ at the individual grid points so that the larger the weight $w_{kij}$ is, the more the parameter acquired values $z_k$ is reflected in the learning value $Z_{ij}(k)$.

Moreover, in the equations in the above-described Formula 1 and Formula 2, the integrated values $W_{ij}(k-1)$ and $V_{ij}(k-1)$ of the previous time (the k−1-th session) are used, but these initial values (values when k=1) are defined by the equations in the following Formula 4 and Formula 5. Therefore, according to the equations in Formulas 1 to 5, the learning map can be updated by calculating the k-th learning value $Z_{ij}(k)$ at all the grid points (i, j) on the basis of the k-th parameter acquired value $z_k$ and the weight $w_{kij}$.

$$V_{ij}(1)=z_1*w_{1ij} \quad \text{[Formula 4]}$$

$$W_{ij}(1)=w_{1ij} \quad \text{[Formula 5]}$$

(Weight Setting Method)

Subsequently, a setting method of the weight $w_{kij}$ in this embodiment will be explained. The weight $w_{kij}$ at each grid point (i, j) corresponding to the k-th parameter acquired value $z_k$ is calculated from Gaussian function indicated in an equation in the following Formula 6 so as to satisfy $1 \geq w_{kij} \geq 0$. The Gaussian function constitute the weight setting means of this embodiment, and the larger a distance from a position of the parameter acquired value $z_k$ (reference position) on the learning map to the grid point (i, j), the more the weight $w_{kij}$ at the grid point (i, j) is decreased. The "position" on the learning map is determined by combination of each reference parameters at a time when the parameter acquired value $z_k$ is acquired.

$$w_{kij} = \frac{1}{\sqrt{2\pi}\,\sigma}\exp\left(-\frac{|z_k - Z_{ij}|^2}{2\sigma^2}\right) \quad \text{[Formula 6]}$$

Figure 3:
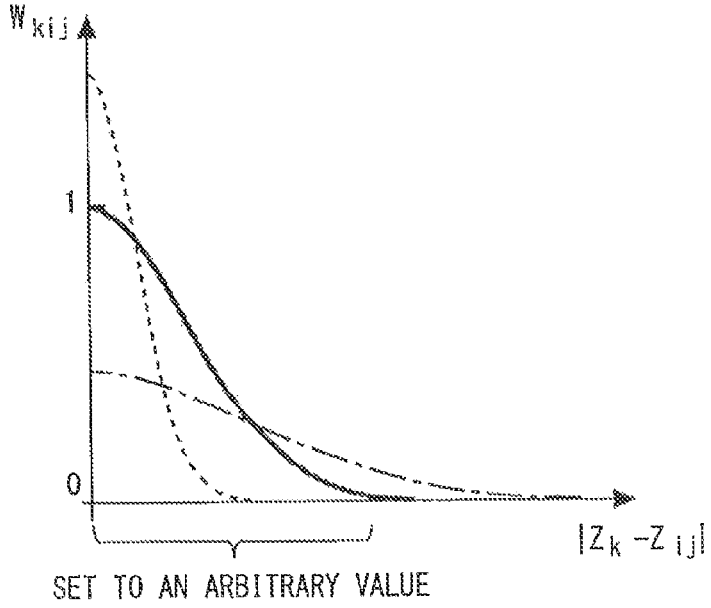
FIG. 3 is a characteristic diagram illustrating a decrease characteristic of the weight by the Gaussian function in Embodiments 1 of the present invention.

In the equation in the above-described Formula 6, $|z_k-Z_{ij}|$ indicates Euclidean distance from the reference position to the grid point (i, j). FIG. 3 is a characteristic diagram illustrating a decrease characteristic of the weight by the Gaussian function in Embodiments 1 of the present invention. Here, the decrease characteristic of the weight means a relationship between the weight decreasing in accordance with the distance from the reference position and the distance. As indicated by a solid line in FIG. 3, the weight $w_{kij}$ acquired by the Gaussian function becomes larger if the grid point is closer to the reference position and decreases in a state of a normal distribution curve if the grid point is farther from the reference position. Therefore, a degree at which the parameter acquired value $z_k$ is reflected in the learning value $Z_{ij}$ (learning effect) is larger if the grid point is closer to the reference position and decreases if the grid point becomes farther from the reference position.

Moreover, the reference character σ indicated in the above-described Formula 6 is a standard deviation that can be set to an arbitrary value, and the decrease characteristic of the Gaussian function changes in accordance with the standard deviation σ. That is, the weight $w_{kij}$ has, as indicated by a dotted line in FIG. 3, a larger peak value present in the vicinity of the reference position if the standard deviation σ is smaller but it rapidly decreases as getting farther from the reference position. As a result, if the standard deviation σ is smaller, steep learning is executed only in the vicinity of the reference position, and though responsiveness of learning becomes high, irregularity can easily occur on a curved surface of the learning map. On the other hand, the weight $w_{kij}$ has a smaller peak value if the standard deviation σ is larger and gently decreases as getting farther from the reference position as indicated by a one-dot chain line in FIG. 3. As a result, if the standard deviation σ is large, learning from the vicinity to far from the reference position is executed in a wide range, and though responsiveness of learning relatively drops, the learning map can be made a smooth curved surface.

[Specific Processing for Realizing Embodiment 1]

Figure 4:
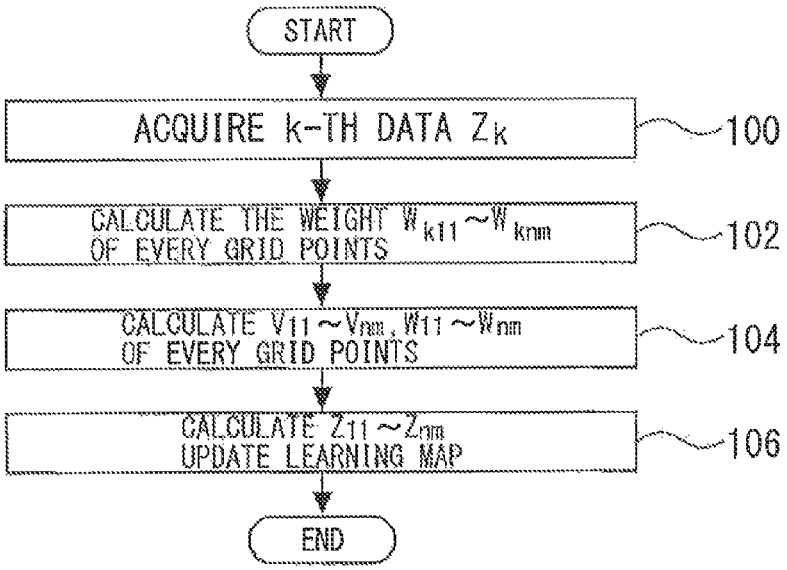
FIG. 4 is a flowchart of the control executed by an ECU in Embodiment 1 of the present invention.

Subsequently, by referring to FIG. 4, specific processing for realizing the above-described control will be explained. FIG. 4 is a flowchart of the control executed by an ECU in Embodiment 1 of the present invention. A routine illustrated in this figure is assumed to be repeatedly executed during an operation of an engine. In the routine illustrated in FIG. 4, first, at Step 100, the k-th data (parameter acquired value) $z_k$ is acquired.

Subsequently, at Step 102, the weight $w_{kij}$ of all the grid points (i, j) at the k-th acquiring timing is calculated by the equation of the above-described Formula 6. Then, at Step 104, on the basis of the k-th parameter acquired value $z_k$ and the weight $w_{kij}$, the weight integrated value $W_{ij}(k)$ and the parameter integrated value $V_{ij}(k)$ at all the grid points (i, j) are calculated. Subsequently, at Step 106, on the basis of the weight integrated value $W_{ij}(k)$ and the parameter integrated value $V_{ij}(k)$, the learning value $Z_{ij}(k)$ of all the grid points (i, j) are calculated, and the learning map is updated.

Therefore, according to this embodiment, the following effects can be obtained. First, in the weighting learning control, by executing one session of the learning operation, not only the grid point (i, j) which is the closest to the parameter acquired value $z_k$, but the learning values $Z_{ij}(k)$ of all the grid points (i, j) can be updated as appropriate with weighting in accordance with the distance. As a result, even if the learning chances are fewer, the learning values $Z_{ij}(k)$ of all the grid points (i, j) can be quickly optimized in the minimum number of learning times. Moreover, even if the learning values $Z_{ij}(k)$ are lost at a part of the grid points (i, j) or an unlearned state continues, these learning values $Z_{ij}(k)$ can be complemented by the learning operation at another position. Therefore, regardless of the type of the control parameter, the learning efficiency can be improved, and reliability of the learning control can be improved.

Moreover, by using the Gaussian function as the weight setting means, the weight $w_{kij}$ can be smoothly changed in accordance with a distance from the position of the parameter acquired value $z_k$ (reference position). Therefore, the learning map can be made smooth, and deterioration of controllability caused by a rapid change or the like of the learning value $Z_{ij}(k)$ can be suppressed. Moreover, the decrease characteristic of the weight $w_{kij}$ can be changed in accordance with the setting of the standard deviation σ, and the learning characteristic (learning speed or efficiency) can be easily adjusted in a wide learning region. Moreover, each time when the control parameter is acquired, consecutive averaging processing is executed and thus, an influence of disturbance (noise and the like) to the learning value $Z_{ij}(k)$ can be removed. Moreover, since the calculation load of the learning value $Z_{ij}(k)$ can be temporally distributed by the consecutive processing, the calculation load of the ECU 60 can be alleviated.

In Embodiment 1, FIG. 2 illustrates a specific example of the learning map in claim 1, Step 102 in FIG. 4 and the equation of the above-described Formula 6 illustrates a specific example of the weight setting means, and Steps 104 and 106 illustrate a specific example of the weighting learning means. Moreover, in Embodiment 1, the equation of Formula 6 is exemplified as the Gaussian function, but the present invention is not limited to that, and the weight $w_{kij}$ can be set by the Gaussian function illustrated in an equation in the following Formula 7.

$$w_{kij} = \frac{1}{\sqrt{2\pi}\,\sigma_1}\exp\left(-\frac{(z_{k_1} - Z_{ij_1})}{2\sigma_1^2}\right)\times \frac{1}{\sqrt{2\pi}\,\sigma_2}\exp\left(-\frac{(z_{k_2} - Z_{ij_2})}{2\sigma_2^2}\right) \quad \text{[Formula 7]}$$

In the equation in the above-described Formula 7, $z_{k_1}$ indicates a first-axis coordinate of the parameter acquired value $Z_K$ (the X-axis coordinate in FIG. 2, for example), and $z_{k_2}$ indicates a second-axis coordinate of the parameter acquired value $Z_K$ (the Y-axis coordinate). Moreover, $Z_{ij_1}$ indicates a first-axis coordinate i of the grid point (i, j) corresponding to the learning value $Z_{ij}$, and $Z_{ij_2}$ indicates a second-axis coordinate j of the same grid point (i, j). Moreover, σ1, σ2 in the same equation correspond to the first-axis coordinate component and the second-axis coordinate component of the above-described standard deviation σ.

Moreover, in Embodiment 1, an instance applied to the two-dimensional learning map is exemplified, but the present invention is not limited to that, and as illustrated in an equation in Formula 8, for example, the present invention can be also applied to the learning map having an arbitrary dimension other than one dimension and three dimensions. In this case, it is only necessary that the number of dimensions of the weight $w_{ij}$, the weight integrated value $W_{ij}$, the parameter integrated value $V_{ij}$, and the learning value $Z_{ij}$ are changed to $w_{ijlmn}$ . . . , $W_{ijlmn}$ . . . , $V_{ijlmn}$ . . . , and $Z_{ijlmn}$ . . . in accordance with the number of dimensions in the learning map.

$$w_{kijlm} = \frac{1}{\sqrt{2\pi}\,\sigma_1}\exp\left(-\frac{(z_{k_1} - Z_{ijklm\ldots_1})}{2\sigma_1^2}\right)\times \frac{1}{\sqrt{2\pi}\,\sigma_2}\exp\left(-\frac{(z_{k_2} - Z_{ijklm\ldots_2})}{2\sigma_2^2}\right)\times \frac{1}{\sqrt{2\pi}\,\sigma_3}\exp\left(-\frac{(z_{k_3} - Z_{ijklm\ldots_3})}{2\sigma_3^2}\right)\times\ldots \quad \text{[Formula 8]}$$

Moreover, in Embodiment 1, the initial values of the integrated values $W_{ij}$ and $V_{ij}$ are calculated by the equations of the above-described Formula 4 and FIG. 5, but in the present invention, the initial values may be set as in a variation illustrated below. First, in the above-described weighting learning control, the initial value stored in the ECU 60 are only integrated values $W_{ij}$ and $V_{ij}$ and the learning value $Z_{ij}$ calculated from these values is not stored as an initial value. Thus, in this variation, on the basis of a value of the learning value $Z_{ij}$ to be stored as an initial value and an initial value of the weight integrated value $W_{ij}$, an initial value of the parameter integrated value $V_{ij}$ ($=Z_{ij}\times W_{ij}$) is reversely calculated by the equation of Formula 3, and this reversely calculated value is stored in the ECU 60.

According to the above-described variation, the value of the learning value $Z_{ij}$ to be stored as an initial value by theoretical calculation in design or the like can be stored in advance as initial values of the integrated values $W_{ij}$ and $V_{ij}$. Then, in the first session of the learning operation, the initial value of the learning value $Z_{ij}$ can be set to a desired value by the equations in the above-described Formula 4 and Formula 5. Moreover, by setting the weight integrated value $W_{ij}$ large at the grid point (i, j) where learning is to be expedited and by setting the weight integrated value $W_{ij}$ small at the grid point (i, j) where learning is to be delayed, an initial condition of the learning speed can be also adjusted easily.

Embodiment 2

Subsequently, by referring to FIG. 5, Embodiment 2 of the present invention will be explained. This embodiment is characterized in that in the configuration similar to the above-described Embodiment 1, a primary function is used as the weight setting means. In this embodiment, the same constituent elements are given the same reference numerals as those in Embodiment 1, and the explanation will be omitted.

[Features of Embodiment 2]

Figure 5:
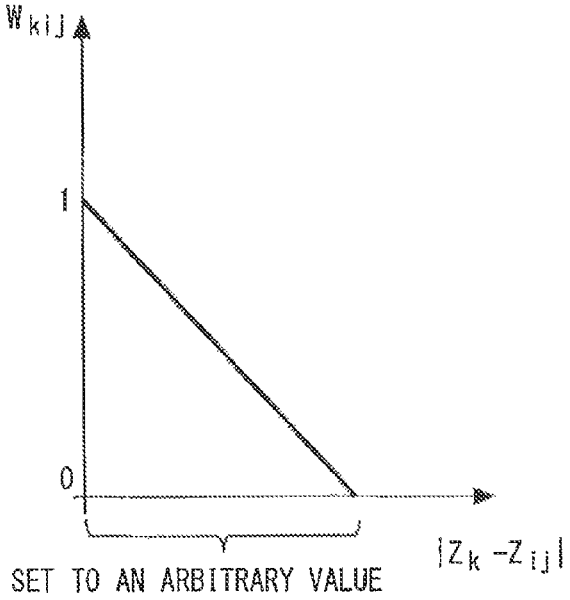
FIG. 5 is a characteristic diagram illustrating the decrease characteristic of the weight by the primary function in Embodiment 2 of the present invention.

FIG. 5 is a characteristic diagram illustrating the decrease characteristic of the weight by the primary function in Embodiment 2 of the present invention. As illustrated in this figure, in this embodiment, the primary function by which the weight decreases in proportion according to the distance from the reference position as the weight setting means. In this embodiment configured as above, too, the working effect substantially similar to that in the above-described Embodiment 1 can be obtained. Particularly in this embodiment, the calculation load when the weight $w_{kij}$ is calculated can be drastically decreased by using the primary function.

Embodiment 3

Subsequently, by referring to FIG. 6, Embodiment 3 of the present invention will be explained. This embodiment is characterized in that in the configuration similar to the above-described Embodiment 1, a trigonometric function is used as the weight setting means. In this embodiment, the same constituent elements are given the same reference numerals as those in Embodiment 1, and the explanation will be omitted.

[Features of Embodiment 3]

Figure 6:
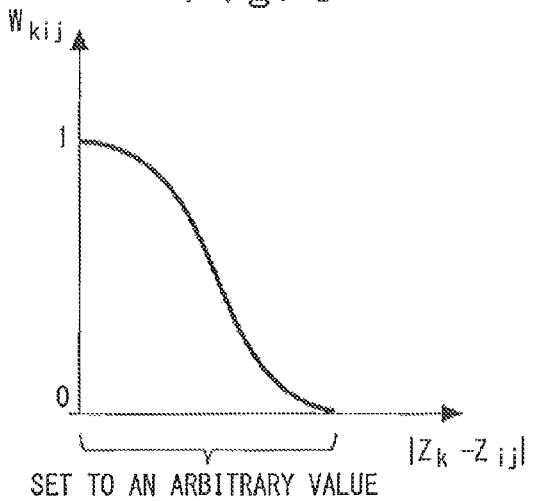
FIG. 6 is a characteristic diagram illustrating the decrease characteristic of the weight by the trigonometric function in Embodiment 3 of the present invention.

FIG. 6 is a characteristic diagram illustrating the decrease characteristic of the weight by the trigonometric function in Embodiment 3 of the present invention. As illustrated in this figure, in this embodiment, the trigonometric function by which the above-described weight decreases sinusoidally in accordance with the distance from the reference position as the weight setting means. In this embodiment configured as above, too, the working effect substantially similar to that in the above-described Embodiment 1 can be obtained. Particularly in this embodiment, the weight $w_{kij}$ can be smoothly decreased similarly to the instance in which the Gaussian function is used while the calculation load of the weight $w_{kij}$ is decreased by using the trigonometric function more than the Gaussian function.

Embodiment 4

Figure 7:
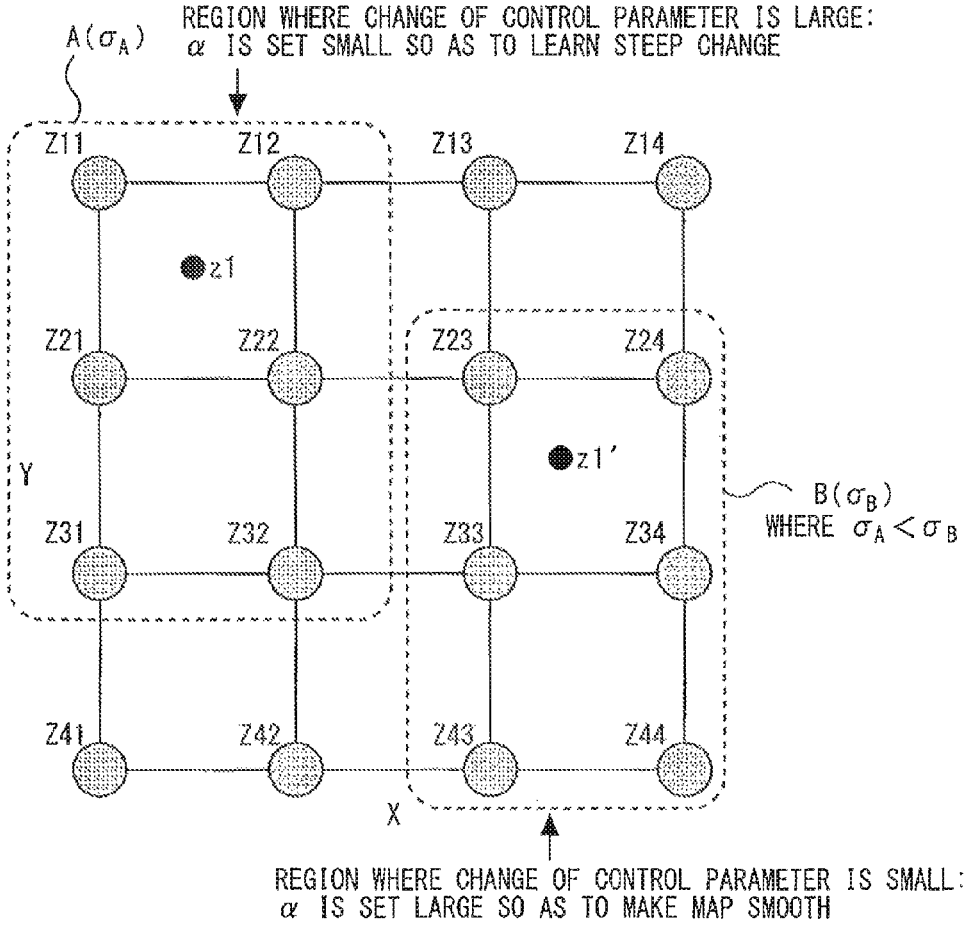
FIG. 7 is an explanatory diagram schematically illustrating an example of the learning map used for the weighting learning control in Embodiment 4 of the present invention.

Subsequently, by referring to FIG. 7, Embodiment 4 of the present invention will be explained. This embodiment is characterized in that in the configuration similar to the above-described Embodiment 1, the learning map is divided into a plurality of regions, and in at least a part of the regions, the decrease characteristic of the weight is switched for each region. In this embodiment, the same constituent elements are given the same reference numerals as those in Embodiment 1, and the explanation will be omitted.

[Features of Embodiment 4]

Regarding the update amount of the learning value and the like, a request might be different for each region on the learning map. Particularly, on the learning map, there are a region where a change in the control parameter is large and a region where the change in the control parameter is small (little change) in many cases. Thus, in the method of setting the weight in accordance only with the distance between the position of the parameter acquired value $z_k$ and the grid point, it is difficult to set the weight so that the learning speed or efficiency at each grid point become appropriate. That is, in this method, even between the grid points in different regions, learning at the same level is made if the distances are equal, and there is a problem that accurate learning control cannot be made. Moreover, it is difficult to find a certain weight conforming to the entire learning map. That is, if a rapid change is allowed in a region where a rapid change of the weight is not necessary, an increase of the calculation load or irregularity of the learning map can easily occur. Moreover, if the rapid change is suppressed in a region where a rapid change of the weight is needed, there is a concern that deterioration of the control efficiency, defective operation of failsafe and the like can be caused. Thus, if a certain weight is applied to the entire learning map, it results in nonconformity in at least a part of the regions.

Thus, in this embodiment, the following control is executed. FIG. 7 is an explanatory diagram schematically illustrating an example of the learning map used for the weighting learning control in Embodiment 4 of the present invention. As illustrated in this figure, in this embodiment, at least a part of the learning map is divided into a plurality of regions. FIG. 7 exemplifies an instance in which the part of the learning map is divided into two regions A and B. Here, the region A is a region where a change of the control parameter during an operation of the engine and the like, for example, is large, while the region B is a region where a change of the control parameter is small. In the weighting learning control, the decrease characteristic of the weight $w_{kij}$ (Gaussian function) decreasing in accordance with the distance from the reference position is configured to be switched for each of the regions A and B.

Specifically speaking, in the region A in which a steep change of the control parameter needs to be learned, a standard deviation $\sigma_A$ of the Gaussian function is set smaller than a standard deviation on of the region B ($\sigma_A<\sigma_B$). Thus, in the region A, the weight $w_{kij}$ is configured to take a large peak value in the vicinity of the reference position and rapidly decreases when being away from the reference position. On the other hand, in the region B in which the control parameter scarcely changes, the standard deviation $\sigma$ is set to a relatively large value. Thus, in the region B, the weight $w_{kij}$ is configured to take a small peak value in the vicinity of the reference position and gently decreases in a wide range when being away from the reference position Then, in the weighting learning control, at the individual grid points (i, j), the weight $w_{kij}$ is set on the basis of the decrease characteristic of the region to which the grid point belongs. As an example, when the first session of the learning operation is to be executed on the basis of the parameter acquired value $z_1$ in FIG. 7, at the grid points (1, 1), (1, 2), (2, 1), (2, 2), (3, 1), and (3, 2) belonging to the region A, the weight $w_{lij}$ is set by using the Gaussian function of the standard deviation $\sigma_A$. On the other hand, at the grid points (2, 3), (2, 4), (3, 3), (3, 4), (4, 3), and (4, 4) belonging to the region B, the weight $w_{lij}$ is set by using the Gaussian function of the standard deviation $\sigma_B$. Similarly to this, in the learning operation at the second session and after ($k\geq 2$), the decrease characteristic (standard deviation) of the Gaussian function is switched in accordance with the region to which the grid point belongs. Processing for updating the learning value $Z_{ij}(k)$ after setting the weight $w_{kij}$ is similar to that described above.

In this embodiment configured as above, too, the working effect substantially similar to the above-described Embodiment 1 can be obtained. Particularly in this embodiment, the decrease characteristic of the weight $w_{kij}$ is configured to be switched for each of the regions A and B. As a result, in the region A in which steep learning is needed, for example, setting is made such that a rapid change of the weight $w_{kij}$ can be made, responsiveness or control efficiency of the learning can be improved, and an operation such as failsafe and the like can be made stable. Moreover, in the region B in which gentle learning can be allowed, by making setting such that the weight $w_{kij}$ is gently changed in a relatively wide grid point range, the calculation load in learning can be suppressed, and the learning map can be made smooth. Therefore, the weighting conforming to the entire learning map can be easily realized.

In the above-described Embodiment 4, the instance in which the two regions A and B are provided on the learning map is exemplified, but in the present invention, the number of regions to be provided on the learning map may be set to an arbitrary number. Moreover, in the present invention, if three or more regions are provided, the decrease characteristic of the weight $w_{kij}$ does not have to be made different among all the regions, and it is only necessary to make the decrease characteristic different between at least two regions.

Moreover, in Embodiment 4, the instance in which the weight $W_{kij}$ is set on the basis of the decrease characteristic of the region to which the grid point belongs in the individual grid points (i, j). However, the present invention is not limited to this and may be so configured as in a variation described below. In this variation, on the basis of the decrease characteristic of the region to which the parameter acquired value $z_k$ belongs, the weight is set for all the grid points. Specifically speaking, if the learning value is to be updated on the basis of the parameter acquired value $z_1$ in FIG. 7, since the position of the parameter acquired value $z_1$ belongs to the region A, the weight $w_{lij}$ for all the grid points including the regions A and B is set on the basis of the decrease characteristic of the region A (Gaussian function of the standard deviation $\sigma_A$). Moreover, if the learning value is to be updated on the basis of the parameter acquired value $z_1'$ at the position belonging to the region B, the weight $w_{lij}$ for all the grid points including the regions A and B is set on the basis of the decrease characteristic of the region B (Gaussian function of the standard deviation $\sigma_B$).

According to the variation configured as above, the responsiveness, speed, efficiency and the like of the learning at all the grid points can be switched in accordance with the characteristic of the region to which the parameter acquired value $z_k$ belongs. That is, if the parameter acquired value $z_k$ belongs to the region A requiring steep learning, the weight $w_{kij}$ can be set for all the grid points by the Gaussian function of the standard deviation $\sigma_A$. Furthermore, if the parameter acquired value $z_k$ belongs to the region B not requiring steep learning, the weight $w_{kij}$ can be set for all the grid points by the Gaussian function of the standard deviation $\sigma_B$. Therefore, the weighting conforming to the entire learning map can be easily realized.

Embodiment 5

Subsequently, by referring to FIG. 8 and FIG. 9, Embodiment 5 of the present invention will be explained. This embodiment is characterized in that update of the learning value at the grid point far from the reference position more than necessary is prohibited in the configuration similar to the above-described Embodiment 1. In this embodiment, the same reference numerals are given to the same constituent elements as those in Embodiment 1, and the explanation will be omitted.

[Features of Embodiment 5]

Figure 8:
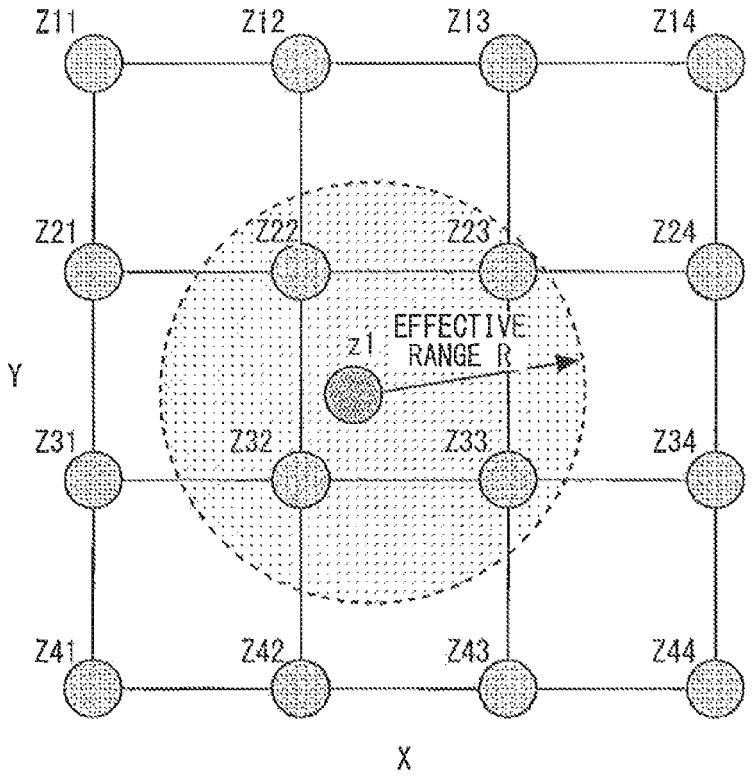
FIG. 8 is an explanatory diagram schematically illustrating an example of the learning map used for the weighting learning control in Embodiment 5 of the present invention.

FIG. 8 is an explanatory diagram schematically illustrating an example of the learning map used for the weighting learning control in Embodiment 5 of the present invention. In this embodiment, it is configured such that the weight $w_{kij}$ of the grid point where the distance $|z_k-Z_{ij}|$ is larger than a predetermined effective range R is set to 0. Explaining this by using an example illustrated in FIG. 8, at grid points having the distances from the position of the parameter acquired value $z_1$ (reference position) within the effective range R, that is, at the grid points (2, 3), (3, 3) and the like, for example, the weight $w_{lij}$ is calculated by the above-described method. On the other hand, at the grid points (3, 1), (2, 4), (4, 4) and the like, for example, since the distance $|z_k-Z_{ij}|$ from the reference position is larger than the effective range R, the weight $w_{lij}=0$ is set, and update of the learning value $Z_{ij}(k)$ is prohibited.

Figure 9:
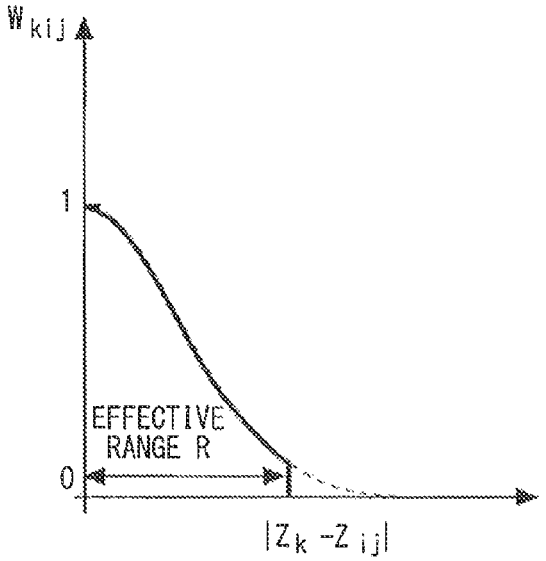
FIG. 9 is a characteristic diagram illustrating a characteristic of weighting according to Embodiment 5 of the present invention.

FIG. 9 is a characteristic diagram illustrating a characteristic of weighting according to Embodiment 5 of the present invention. As illustrated in this figure, at the grid point where the distance $|z_k-Z_{ij}|$ from the reference position exceeds the effective range R, the weight $w_{kij}$ becomes 0, and the learning value $Z_{ij}(k)$ acquired by the equations in the above-described Formulas 1 to 3 becomes the same value as that of the previous time, and update of the learning value is stopped. If the Gaussian function is used, as the distance $|z_k-Z_{ij}|$ becomes larger, the weight $w_{kij}$ is gradually brought close to 0, and at the grid point where this distance is larger than a certain degree, even if the learning value is updated, the learning effect is small (learning does not become effective).

Therefore, the effective range R is set as a distance which includes all the grid points where learning becomes effective and can alleviate the calculation load of the learning processing. Moreover, in this embodiment, when the update processing of the learning value is executed in accordance with the flowchart illustrated in the above-described FIG. 4, it is preferable that the equations in the above-described Formulas 1 to 5 are executed by excluding the grid points where the weight $w_{kij}$ is set to 0.

In this embodiment configured as above, too, the working effect substantially similar to that in the above-described Embodiment 1 can be obtained. Particularly in this embodiment, the grid points at which the learning values are updated can be limited to within the effective range. As a result, wasteful update of the learning value at the grid point where the learning effect is small can be avoided, and the calculation load of the ECU 60 can be alleviated. In this embodiment, at the grid point where the distance $|z_k-Z_{ij}|$ from the reference position exceeds the effective range R, the weight $w_{kij}$ is set to 0. However, the present invention is not limited to that, and it is only necessary that wasteful calculation at the grid point where the distance $|z_k-Z_{ij}|$ exceeds the effective range R is prohibited, and the weight $w_{kij}$ does not necessarily have to be set to 0. That is, in the present invention, it may be so configured that, if it is determined that the distance $|z_k-Z_{ij}|$ is larger than the effective range R, the calculation processing relating to the learning this time at the grid point is stopped.

Embodiment 6

Subsequently, by referring to FIG. 10 and FIG. 11, Embodiment 6 of the present invention will be explained. This embodiment is characterized in that a reliability map for evaluating reliability of the learning value is used in the configuration similar to the above-described Embodiment 1. In this embodiment, the same reference numerals are given to the same constituent element as those in Embodiment 1, and the explanation will be omitted.

[Features of Embodiment 6]

According to the above-described weighting learning control, the learning values of all the grid points where learning is effective can be updated in one session of the learning operation. However, if the standard deviation σ of the Gaussian function is set large, and the learning map is to be made smooth, there is a concern that mis-learning that the learning value is updated meaninglessly can occur even in a region where the control parameter has not been actually acquired in the learning map. Thus, in this embodiment, it is configured such that a reliability map for evaluating reliability of the learning map is used.

Figure 10:
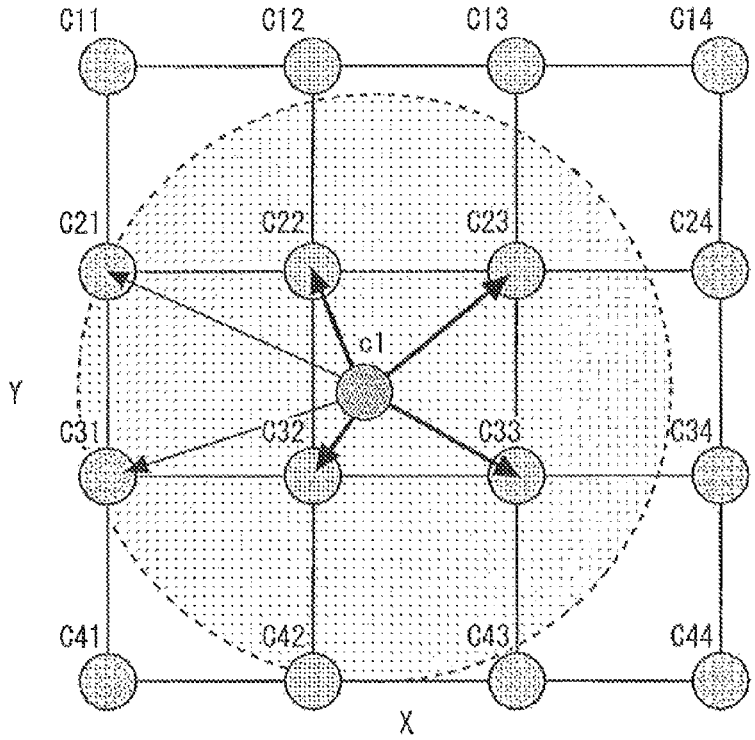
FIG. 10 is an explanatory diagram schematically illustrating an example of the reliability map in Embodiment 6 of the present invention.

FIG. 10 is an explanatory diagram schematically illustrating an example of the reliability map in Embodiment 6 of the present invention. As illustrated in this figure, the reliability map has a plurality of the grid points configured similarly (same dimensional number) to the learning map, and at the individual grid points, reliability evaluation values $C_{ij}$ which are indexes indicating reliability of the learning values $Z_{ij}(k)$ are stored, respectively, capable of being updated. The reliability evaluation values $C_{ij}$ at all the grid points have their initial values set to 0 and they change within a range of 0 to 1. In the following processing, the reliability map is updated such that the higher the reliability of the learning value $Z_{ij}$ is, the larger the reliability evaluation value $C_{ij}$ at the corresponding grid points (i, j) becomes.

Subsequently, a function of the reliability map and the update processing will be explained by referring to FIG. 11. FIG. 11 is a flowchart of the control executed by the ECU. A routine illustrated in this figure describes only the processing relating to learning of the reliability map, and the learning processing of the reliability map is executed periodically in parallel with the learning processing of the learning map. In the routine illustrated in FIG. 11, first, at Step 200, the k-th data (parameter acquired value) $z_k$ is acquired similarly to Embodiment 1 (FIG. 4).

Subsequently, at Step 202, if the parameter acquired value $z_k$ is a reliable value, a reliability acquired value $c_k$ (=1) is set at the same reference position as the parameter acquired value $z_k$ on the reliability map. Whether or not the parameter acquired value $z_k$ is reliable can be determined on the basis of the type and characteristics of the control parameter, a range of normal values, a result of sensor abnormality check and the like in individual controls using the learning value $Z_{ij}(k)$. Depending on the reliability of the parameter acquired value $z_k$, a value less than 1 may be set to the reliability acquired value $c_k$, and particularly if the reliability of the parameter acquired value $z_k$ is determined to be low, the reliability acquired value $c_k$ may be set to 0. That is, at Step 202, the reliability acquired value $c_k$ having a value corresponding to the reliability of the parameter acquired value $z_k$ is set to the reference position.

Then, at Step 204, the weighting learning control similar to the learning map is executed to the reliability map, and each time the control parameter is acquired, the reliability evaluation value $C_{ij}$ of each grid point is calculated, and the reliability map is updated. This weighting learning control is realized by equations in the following Formulas 9 to 14. In these equations, the parameter acquired value $z_k(z_1)$ and the learning value $Z_{ij}(k)$ are replaced by the reliability acquired value $c_k(c_1)$ and the reliability evaluation value $C_{ij}$ in the above-described Formulas 1 to 6. However, the other variable values not replaced are attached with dashes "'" indicating that they are different from those used in the learning map. A value of the standard deviation $\sigma_c$ in the equation in Formula 14 will be described later.

$$W_{ij}(k)'=W_{ij}(k-1)'+w_{kij}' \quad \text{[Formula 9]}$$

$$V_{ij}(k)'=V_{ij}(k-1)'+c_k*W_{kij}' \quad \text{[Formula 10]}$$

$$C_{ij}(k)=V_{ij}(k)'/W_{ij}(k)' \quad \text{[Formula 11]}$$

$$V_{ij}(1)'=c_1*w_{1ij}' \quad \text{[Formula 12]}$$

$$W_{ij}(1)'=w_{1ij}' \quad \text{[Formula 13]}$$

$$w_{kij}' = \frac{1}{\sqrt{2\pi}\,\sigma_c}\exp\left(-\frac{|c_k - C_{ij}|^2}{2\sigma_c^2}\right) \quad \text{[Formula 14]}$$

As is known from each of the above-described equations, in the weighting learning control of the reliability map, it is regarded that the reliability acquired value $c_k$ according to its reliability was acquired at the same position as the parameter acquired value $z_k$, for example, the weight (reliability weight) $w_{kij}'$ is set at all the grid points where learning is effective, and the reliability evaluation value $C_{ij}$ is updated. As a result, the reliability evaluation values $C_{ij}$ at the individual grid points are updated so that the larger the reliability weight $w_{kij}'$ is, the more the reliability acquired value $c_k$ is reflected. Moreover, the reliability weight $w_{kij}'$ is set by using the Gaussian function illustrated in the equation in the above-described Formula 14 so that the larger the distance from the reference position (position of the reliability acquired value $c_k$) to the grid point is, the more the reliability weight $w_{kij}'$ is decreased. The standard deviation $\sigma_c$ of the Gaussian function determining the decrease characteristic of the reliability weight $w_{kij}'$ is set to a value sufficiently smaller than the standard deviation $\sigma$ of the learning map ($\sigma >> \sigma_c$). That is, the decrease characteristic when the reliability weight $w_{kij}'$ is decreased in accordance with the distance from the reference position is set steeper than the decrease characteristic of the weight $w_{kij}$ of the learning map.

As a result, the reliability weight $w_{kij}'$ becomes larger only in the vicinity of the reference position where the control parameter was actually acquired and rapidly decreases as getting far from the reference position. Moreover, in a region where the reliability evaluation value $C_{ij}$ increased by learning is limited only to the vicinity of the reference position. Therefore, in a region where the control parameter is acquired at a high frequency, the reliability evaluation value $C_{ij}$ at each of the grid points becomes a large value. On the other hand, in a region where the control parameter is scarcely acquired, the reliability evaluation value $C_{ij}$ becomes a small value, and particularly in a region without an acquisition history of the control parameter, the reliability evaluation value $C_{ij}$ becomes a value close to 0. That is, in a value of the reliability evaluation value $C_{ij}$, reliability of the learning value $Z_{ij}$ on whether or not the current learning value $Z_{ij}$ is calculated on the basis of the actually acquired control parameter is reflected.

According to this embodiment configured as above, in addition to the working effect substantially similar to the above-described Embodiment 1, the following working effects can be obtained. First, in the reliability evaluation value $C_{ij}$ at each grid point of the reliability map, the reliability of the learning value $Z_{ij}$ at the same grid point can be reflected. And by executing the weighting learning control of the reliability evaluation value $C_{ij}$, with an equal degree of reflection when the acquired value of the control parameter is reflected in the learning value at each grid point, the reliability acquired value $C_k$ can be reflected in the reliability evaluation value $C_{ij}$ at each grid point. Therefore, the reliability of the learning value at each grid point can be efficiently calculated in one session of the learning operation.

Moreover, when the learning value $Z_{ij}$ is used for various controls and the like, the reliability of the learning value $Z_{ij}$ is evaluated on the basis of the reliability evaluation value $C_{ij}$ at the corresponding grid point (i, j) on the reliability map, and appropriate corresponding control can be executed on the basis of the evaluation result. As a specific example, if the reliability evaluation value $C_{ij}$ is at a predetermined determination value or more, the learning value $Z_{ij}$ is determined to be reliable, and the learning value $Z_{ij}$ can be used as it is for control.

On the other hand, if the reliability evaluation value $C_{ij}$ is less than the above-described determination value, it is determined that the learning value $Z_{ij}$ is not reliable, and a conservative safe value is used instead of the learning value $Z_{ij}$, or the learning value $Z_{ij}$ can be corrected to a safe side (if it is at an ignition timing, for example, correction is made to a delay angle side, for example). Alternatively, the reliability evaluation value CU is reflected in the learning value $Z_{ij}$ by means such as addition, multiplication and the like, for example, so that the learning value $Z_{ij}$ can be continuously increased/decreased in accordance with the reliability.

Figure 11:
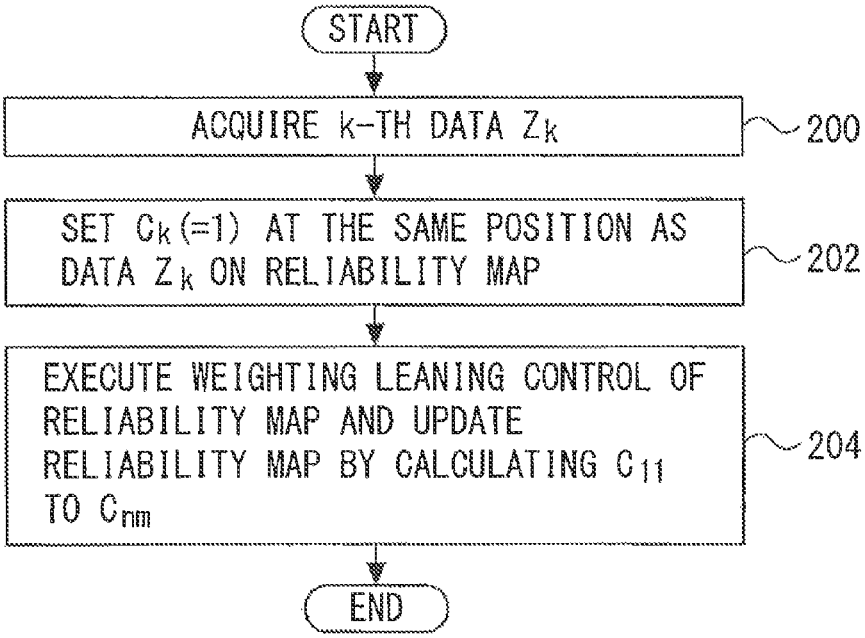
FIG. 11 is a flowchart of the control executed by the ECU.

In the above-described Embodiment 6, FIG. 10 illustrates a specific example of the reliability map, the equation in the above-described Formula 14 illustrates a specific example of the reliability map weight setting means, and the routine illustrated in FIG. 11 illustrates a specific example of the reliability map learning means.

Embodiment 7

Subsequently, Embodiment 7 of the present invention will be explained by referring to FIG. 12 and FIG. 13. This embodiment is characterized in that the weighting learning control described in the above-described Embodiment 1 is applied to learning control of ignition timing. In this embodiment, the same reference numerals are given to the same constituent elements as those in Embodiment 1, and the explanation will be omitted.

[Features of Embodiment 7]

Figure 12:
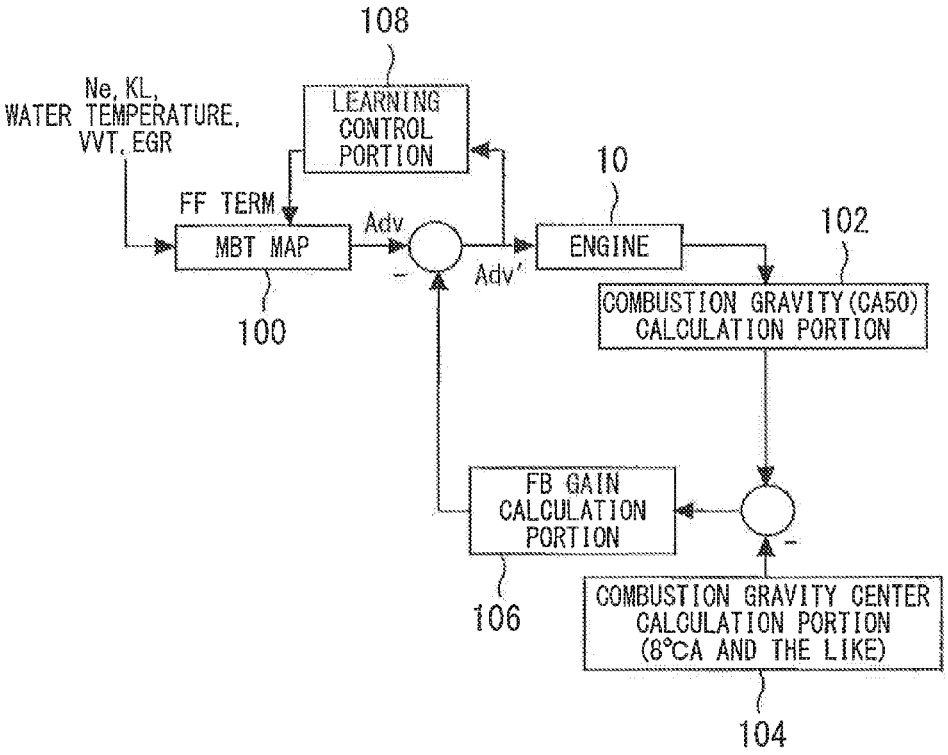
FIG. 12 is a control block diagram illustrating ignition timing control according to Embodiment 7 of the present invention.

FIG. 12 is a control block diagram illustrating ignition timing control according to Embodiment 7 of the present invention. A system of this embodiment is provided with an MBT map 100 included in a storage circuit or a calculation function of the ECU 60, a combustion gravity center calculation portion 102, a combustion gravity center target setting portion 104, an FB gain calculation portion 106, and a learning control portion 108. The MBT map 100 is constituted by a multi-dimensional learning map for calculating ignition timing which is a control parameter on the basis of a plurality of reference parameters. Here, as an example of the reference parameter, an engine rotation number Ne, an engine load KL, a water temperature, a valve timing control amount by the variable valve mechanisms 34 and 36 such as a VVT and the like, a control amount of the EGR valve 42 and the like can be cited. At each of the grid points on the MBT map 100, the learning value $Z_{ij}(k)$ of the MBT (Minimum spark advance for Best Torque) which is an ignition timing when an engine torque is maximized is stored, respectively.

In this embodiment, during an operation of the engine, MBT control for matching the ignition timing with the MBT is executed. In the MBT control, first, by referring to the MBT map 100 on the basis of each of the above-described reference parameters, ignition timing Adv which is a feed-forward (FF) term is calculated. Subsequently, the combustion gravity center calculation portion 102 calculates a combustion gravity center CA 50 acquired from combustion at this ignition timing Adv by an equation in the following Formula 15 on the basis of an output of the in-cylinder pressure sensor 50 and the like. This equation is a known equation for calculating a combustion mass ratio MFB (Mass fraction of Burned fuel), and the combustion gravity center CA 50 is defined as a crank angle θ at which MFB=50% is acquired. In the equation in the following Formula 15, reference character P denotes an in-cylinder pressure, reference character V denotes an in-cylinder volume, reference character κ denotes a specific heat ratio, reference character θs denotes a combustion start crank angle, and reference character θe denotes a combustion end crank angle, respectively.

$$MFB\ (\%) = \frac{PV^{\kappa}(\theta) - PV^{\kappa}(\theta e)}{PV^{\kappa}(\theta s) - PV^{\kappa}(\theta e)} \quad \text{[Formula 15]}$$

Subsequently, the combustion gravity center target setting portion 104 reads out a predetermined combustion gravity center target value (ATDC8° CA and the like), and the FB gain calculation portion 106 corrects the ignition timing Adv (feedback control) so that the combustion gravity center CA 50 matches the combustion gravity center target value. As a result, the ignition timing Adv becomes ignition timing Adv' after correction.

Figure 13:
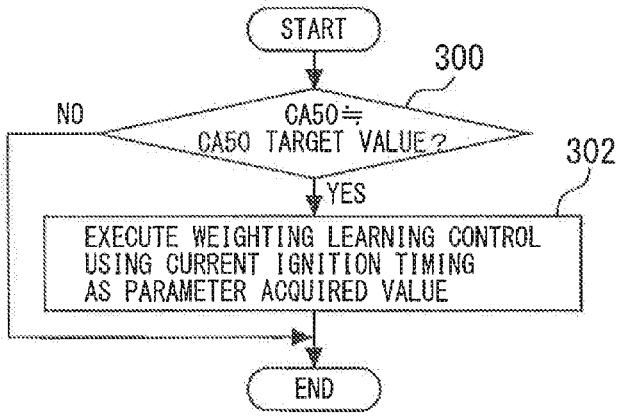
FIG. 13 is a flowchart of the control executed by the ECU in Embodiment 7 of the present invention.

On the other hand, the learning control portion 108 executes the above-described weighting learning control using the ignition timing Adv' after correction as the acquired value $z_k$ of the control parameter and reflects the ignition timing Adv' in the learning value $Z_{ij}(k)$ of the MBT as illustrated in FIG. 13. This weighting learning control is executed only if the combustion gravity center CA 50 substantially matches the combustion gravity center target value as illustrated in FIG. 13. FIG. 13 is a flowchart of the control executed by the ECU in Embodiment 7 of the present invention. In the routine illustrated in this figure, at Step 300, it is determined whether or not the combustion gravity center CA 50 substantially matches the combustion gravity center target value. If this determination is true, it is determined that the MBT is realized, and the weighting learning control of the ignition timing is executed at Step 302. On the other hand, if the determination at Step 300 does not hold true, it is determined that the MBT has not been realized, and the weighting learning control is not executed.

According to this embodiment configured as above, in the learning control of the ignition timing, the working effect substantially similar to the above-described Embodiment 1 can be obtained. Moreover, the weighting learning control is executed only when the combustion gravity center CA 50 substantially matches the combustion gravity center target value, but since the MBT can be efficiently learned at all the grid points of the MBT map 100 in one session of the learning operation, even if the learning chances are relatively fewer, the learning can be made sufficiently. In the above-described Embodiment 7, the combustion gravity center calculation portion 102 illustrates a specific example of combustion gravity center calculating means, and FB gain calculation portion 106 illustrates a specific example of ignition timing correcting means, and the learning control portion 108 illustrates specific examples of weight setting means and weighting learning means.

Embodiment 8

Subsequently, Embodiment 8 of the present invention will be explained by referring to FIG. 14. This embodiment is characterized in that, by using the reliability map described in the above-described Embodiment 6, an update amount of the learning value of the MBT in a transition operation of the engine is suppressed as compared with that in a steady operation. In this embodiment, the same reference numerals are given to the same constituent elements as those in Embodiments 6 and 7, and the explanation will be omitted.

[Features of Embodiment 8]

If the ignition timing is learned in the transition operation of the engine, there is a concern that mis-learning occurs. Thus, in this embodiment, as illustrated in FIG. 14, the reliability evaluation value $c_{ij}(k)$ of the reliability map is calculated on the basis of an operation state of the engine, and the calculated reliability evaluation value $c_{ij}(k)$ is reflected in the learning value of the MBT. FIG. 14 is a flowchart of the control executed by the ECU in Embodiment 8 of the present invention. This figure describes only the processing relating to the learning of the reliability map.

Figure 14:
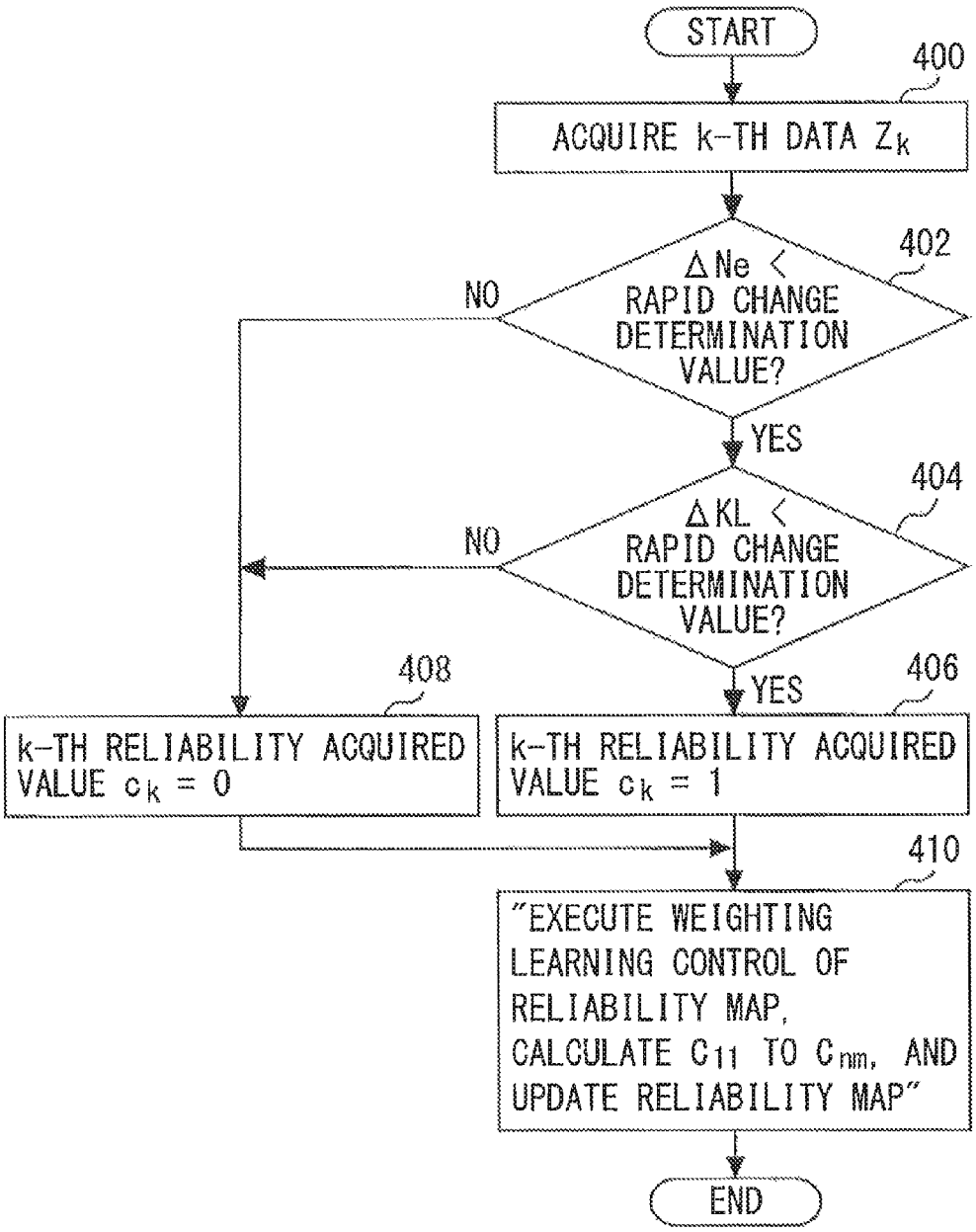
FIG. 14 is a flowchart of the control executed by the ECU in Embodiment 8 of the present invention.

In the routine illustrated in FIG. 14, first, at Step 400, the ignition timing Adv' after correction which is the k-th data (parameter acquired value) $z_k$ is acquired. Subsequently, at Step 402, it is determined whether or not a change amount ΔNe per unit time of an engine rotation number is less than a predetermined rotation number rapid change determination value, and at Step 404, it is determined whether or not a change amount ΔKL per unit time of an engine load is less than a predetermined load rapid change determination value. These determination values are set on the basis of minimum values of the change amounts ΔNe and ΔKL at which an error occurs in calculated value of the ignition timing or the combustion gravity center, for example.

If the determination holds true both at Steps 402 and 404, it is determined that the engine is in a steady operation state, and at Step 406, the reliability acquired value $c_k=1$ is set. On the other hand, if the determination does not holds true at least either one of Steps 402 and 404, it is determined to be in a transition operation state, and at step 408, the reliability acquired value $c_k=0$ is set. Subsequently, at Step 410, as described in Embodiment 6, the weighting learning control of the reliability map is executed, the reliability evaluation value $C_{ij}$ at each grid point is calculated, and the reliability map is updated.

The reliability evaluation value $C_{ij}(k)$ updated by the above-described processing is reflected in the learning value $Z_{ij}(k)$ of the ignition timing by equations in the following Formula 16 and Formula 17, for example. These equations are used instead of the equations in Formula 1 and Formula 2 explained in the above-described Embodiment 1. As a result, in the transition operation, update of the learning value $Z_{ij}(k)$ is stopped, or the update amount is suppressed as compared with that in the steady operation.

$$W_{ij}(k)=W_{ij}(k-1)+w_{kij}*C_{ij}(k) \quad \text{[Formula 16]}$$

$$V_{ij}(k)=V_{ij}(k-1)+z_k*w_{kij}*C_{ij}(k) \quad \text{[Formula 17]}$$

According to this embodiment configured as above, in addition to the working effect substantially similar to the above-described Embodiment 7, the following effects can be obtained. In the learning control of the ignition timing, the more stable the operation state is when the control parameter is acquired, that is, the higher the reliability of the parameter acquired value (ignition timing Adv') is, the apparent weight ($w_{kij}*C_{ij}(k)$) at each grid point can be increased, and the update amount of the learning value $Z_{ij}(k)$ can be made larger. On the other hand, if the operation state is unstable, the above-described apparent weight is decreased so as to make the update amount of the learning value $Z_{ij}(k)$ smaller, and the learning can be stopped or suppressed. As a result, learning in the steady operation can be promoted, and mis-learning in the transition operation can be suppressed.

Embodiment 9

Subsequently, by referring to FIGS. 15 to 18, Embodiment 9 of the present invention will be explained. This embodiment is characterized to be configured that, even if the combustion gravity center CA 50 is deviated from the combustion gravity center target value, the ignition timing can be learned. In this embodiment, the same reference numerals are given to the same constituent elements as those in Embodiment 7, and the explanation will be omitted.

[Features of Embodiment 9]

In the above-described Embodiment 7, the weighting learning control of the ignition timing is executed only if the combustion gravity center CA 50 substantially matches the combustion gravity center target value, and thus, learning chances cannot be increased easily. Thus, in this embodiment, even if the combustion gravity center CA 50 is deviated from the combustion gravity center target value, the weighting learning control according to reliability is executed on the basis of an estimated value of the MBT and a difference ΔCA 50 of the combustion gravity center.

Figure 15:
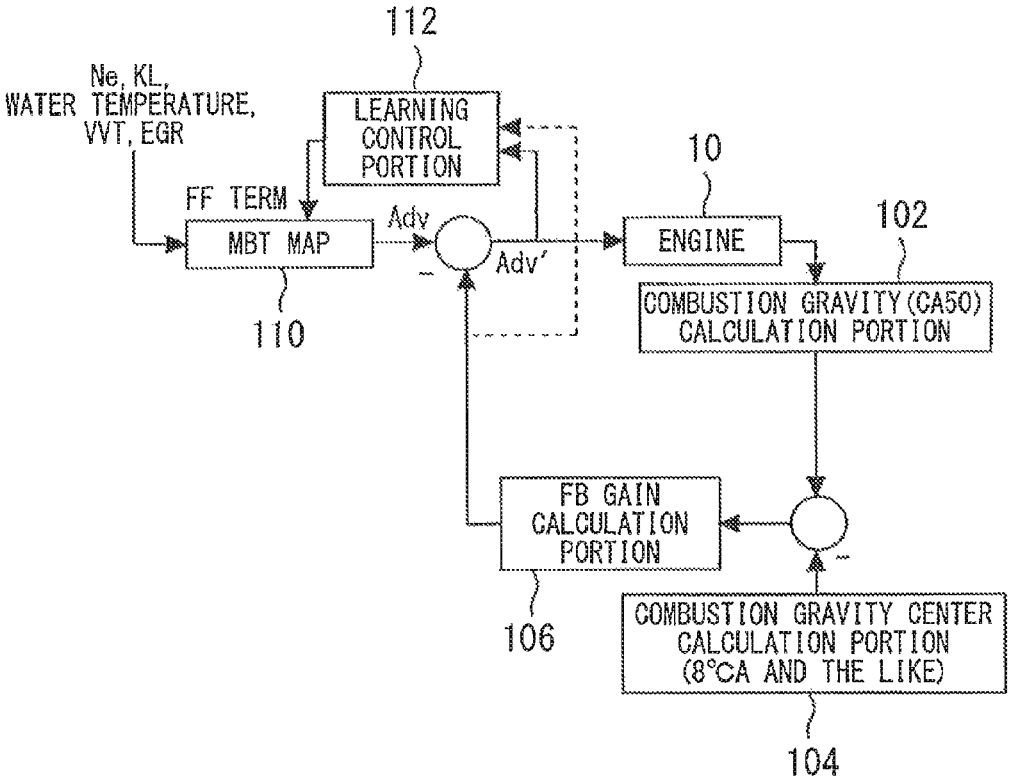
FIG. 15 is a control block diagram illustrating the ignition timing control according to Embodiment 9 of the present invention.

FIG. 15 is a control block diagram illustrating the ignition timing control according to Embodiment 9 of the present invention. A system of this embodiment is provided with an MBT map 110 configured similarly to the above-described Embodiment 7 and a learning control portion 112. The learning control portion 112 estimates the MBT from equations in the following Formula 18 and Formula 19 and executes the weighting learning control of the ignition timing on the basis of the estimated value. In this case, the estimated value of the MBT corresponds to the parameter acquired value $z_k$.

$$MBT=\text{ignition timing } Adv' \text{ after correction } [BTDC]+\Delta CA\ 50 \quad \text{[Formula 18]}$$

$$\Delta CA\ 50=\text{combustion gravity center } CA\ 50([ATDC]-\text{combustion gravity center target value} \quad \text{[Formula 19]}$$

The above-described estimating method of the MBT is based on the following principle. First, if the ignition timing changes, the combustion gravity center CA 50 also changes with that, but in the vicinity of the MBT, there is a characteristic that a change amount of the ignition timing and a change amount of the combustion gravity center CA 50 become substantially equal. That is, a difference ΔCA 50 between the combustion gravity center CA 50 and the combustion gravity center target value is considered to correspond to a shift amount between the MBT and the ignition timing Adv'. Therefore, the MBΔT can be estimated as a value obtained by shifting the ignition timing after correction Adv' only by the difference ΔCA 50 as illustrated in the equation in the above-described Formula 18.

Figure 16:
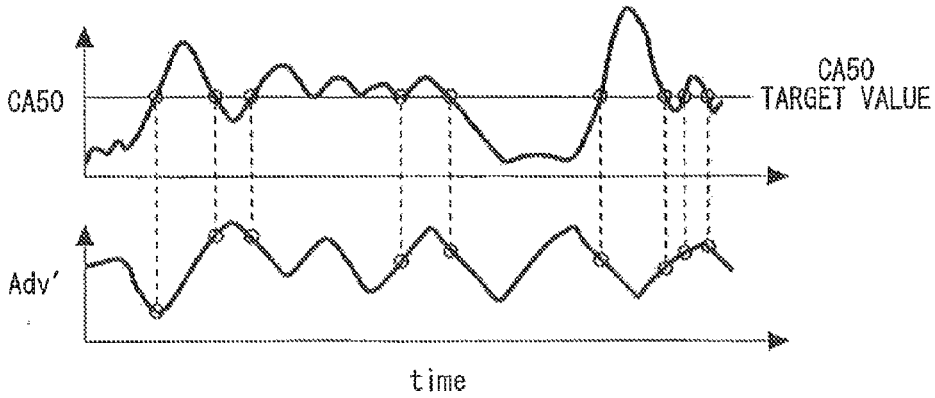
FIG. 16 is a timing chart illustrating a learning chance configured such that the ignition timing is learned only if the combustion gravity center CA 50 substantially matches the combustion gravity center target value (Embodiment 7) as a comparative example.

According to this embodiment configured as above, in addition to the working effect substantially similar to the above-described Embodiment 7, the following effects can be obtained. First, FIG. 16 is a timing chart illustrating a learning chance configured such that the ignition timing is learned only if the combustion gravity center CA 50 substantially matches the combustion gravity center target value (Embodiment 7) as a comparative example. As indicated by circles in this figure, timing when the combustion gravity center CA 50 substantially matches the combustion gravity center target value occurs sporadically, and learning of the MBT only at this time cannot obtain the learning chances sufficiently.

Figure 17:
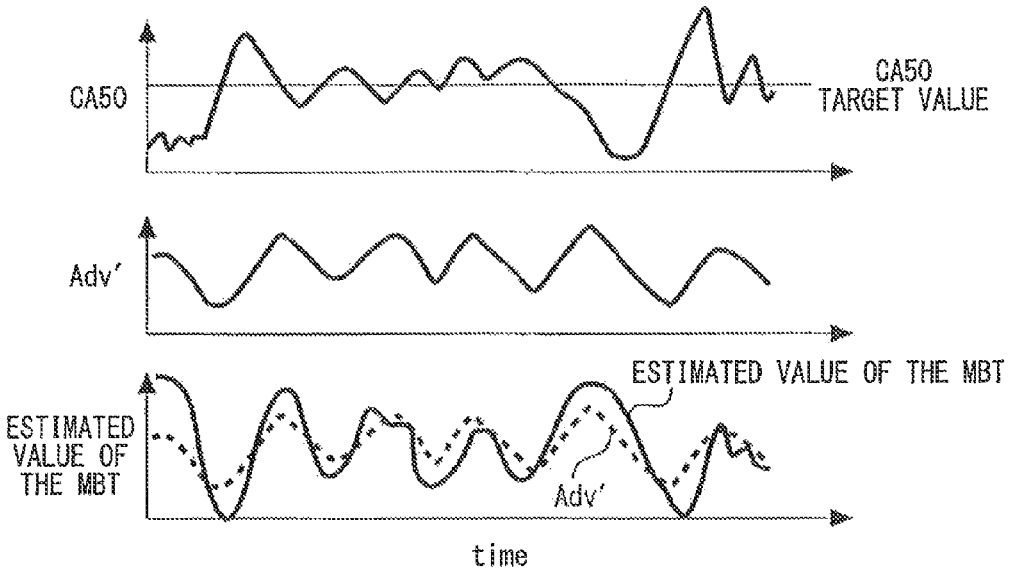
FIG. 17 is a timing chart illustrating the learning control according to Embodiment 9 of the present invention.

On the other hand, FIG. 17 is a timing chart illustrating the learning control according to Embodiment 9 of the present invention. As illustrated in this figure, in the learning control of the MBT according to this embodiment, even if the combustion gravity center CA 50 is deviated from the combustion gravity center target value, the estimated value of the MBT can be acquired all the time, and the learning value $Z_{ij}(k)$ can be updated on the basis of this estimated value, and the learning chances can be drastically increased. As a result, the learning value $Z_{ij}(k)$ can be quickly brought close to the MBT, and controllability of the MBT control can be improved.

When the MBT is to be estimated by the equation in the above-described Formula 18, the farther the combustion gravity center CA 50 is deviated from the combustion gravity center target value, that is, the larger the difference ΔCA 50 between the both becomes, the more the estimation accuracy of the MBT is lowered, and mis-learning can easily occur. Thus, in this embodiment, a reliability coefficient ϵ is calculated by an equation in the following Formula 20 on the basis of the difference ΔCA 50 of the combustion gravity center. Then, a calculated value of the reliability coefficient ϵ is reflected in the weight $w_{kij}$ at each grid point of the MBT map 110, that is, the learning value $Z_{ij}(k)$ of the MBT by equations of the following Formula 12 and Formula 22.

$$\varepsilon=\frac{1}{\sqrt{2\sigma_{CA50}}}\exp\left(\frac{\Delta CA50}{2\sigma_{CA50}}\right) \quad \text{[Formula 20]}$$

$$W_{ij}(k)=W_{ij}(k-1)+w_{kij}*\epsilon \quad \text{[Formula 21]}$$

$$V_{ij}(k)=V_{ij}(k-1)+z_k*w_{kij}*\epsilon \quad \text{[Formula 22]}$$

Here, the equation in the above-described Formula 20 has a characteristic substantially similar to the Gaussian function, and the reliability coefficient ϵ is set so as to decrease as the ΔCA 50 becomes larger (the farther the combustion gravity center CA 50 is deviated from the combustion gravity center target value). Moreover, a decrease characteristic of the reliability coefficient ϵ is adjusted in accordance with a size of an adjustment term $\sigma_{CA50}$. Moreover, the equations in the above-described Formula 21 and Formula 22 are used instead of the equations in Formula 1 and Formula 2 explained in Embodiment 1.

According to the above-described configuration, the lower the estimation accuracy of the MBT is, the smaller the reliability coefficient $\epsilon$ can be set, and a degree of reflection of the estimated value of the MBT in the learning value $Z_{ij}(k)$ can be lowered. Therefore, by estimating the MBT, the learning chances are increased, while the update amount of the learning value $Z_{ij}(k)$ can be appropriately adjusted in accordance with the estimation accuracy, and mis-learning can be suppressed.

Figure 18:
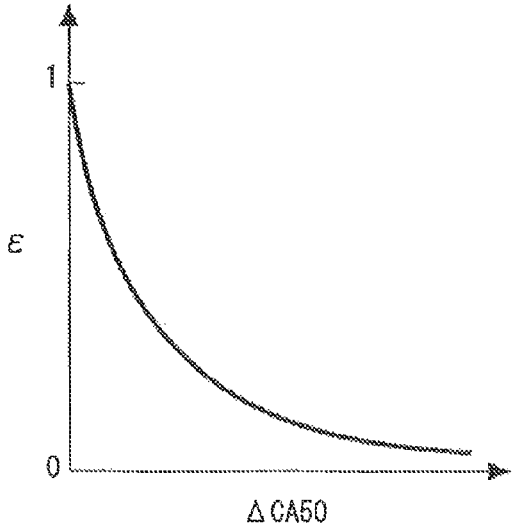
FIG. 18 is a characteristic diagram for calculating the reliability coefficient $\epsilon$ on the basis of the difference $\Delta$CA 50 between the combustion gravity center CA 50 and the combustion gravity center target value.

In the above-described Embodiment 9, the equations in Formula 18 and Formula 19 indicate a specific example of MBT estimating means, and the equations in Formula 20 to Formula 22 indicate a specific example of MBT full-time learning means. Moreover, in Embodiment 9, the reliability coefficient $\epsilon$ is set by the equation in Formula 20, but the present invention is not limited to that and may be so configured that the reliability coefficient $\epsilon$ is calculated on the basis of the data map illustrated in FIG. 18, for example. FIG. 18 is a characteristic diagram for calculating the reliability coefficient $\epsilon$ on the basis of the difference $\Delta$CA 50 between the combustion gravity center CA 50 and the combustion gravity center target value. In this figure, the reliability coefficient $\epsilon$ is set so as to decrease as the difference $\Delta$CA 50 of the combustion gravity center becomes larger.

Moreover, in the above-described Embodiment 9, it may be so configured that the reliability map is used instead of the reliability coefficient $\epsilon$. As one example of this configuration, the larger the difference CA 50 of the combustion gravity center is, the smaller the reliability acquired value $c_k$ is set, and then, the weighting control of the reliability map is executed. Then, in the learning value of the MBT, the reliability evaluation value $C_{ij}(k)$ is reflected by the equations in the above-described Formula 16 and Formula 17.

Embodiment 10

Subsequently, by referring to FIG. 19 and FIG. 20, Embodiment 10 of the present invention will be explained. This embodiment is characterized in that, in addition to the configuration of the above-described Embodiment 9, a TK (Trace Knock) map is employed. In this embodiment, the same reference numerals are given to the same constituent elements as those in Embodiments 7 and 9, and the explanation will be omitted.

[Features of Embodiment 10]

In the above-described Embodiment 9, it is configured such that the MBT is learned by the MBT map 110. However, in the engine operation region, there are an MBT region where the MBT can be realized, and a TK region where the MBT cannot be realized. The TK region is a region where trace knock (weak knock occurring before occurrence of a full-fledged knock) before advancing the ignition timing to the MBT, and in this region, learning of the MBT becomes difficult. Thus, in this embodiment, it is configured such that the ignition timing is learned by a TK map 124 which will be described later in the TK region.

Figure 19:
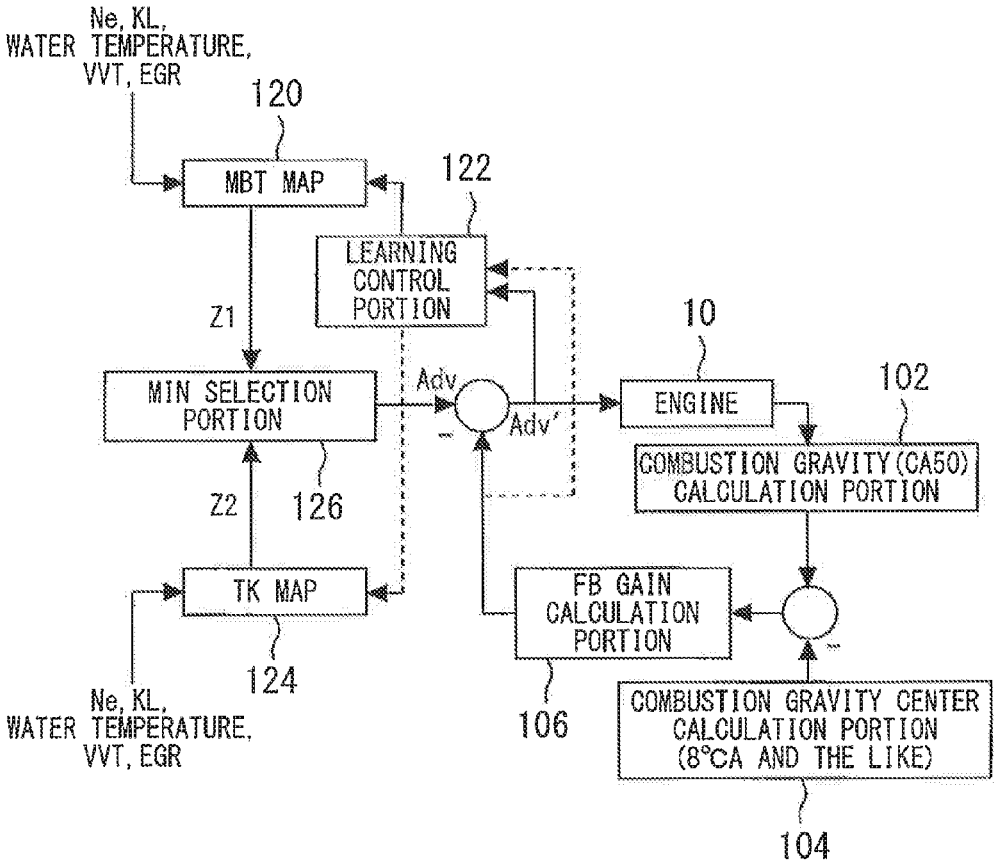
FIG. 19 is a control block diagram illustrating ignition timing control according to Embodiment 10 of the present invention.
Figure 20:
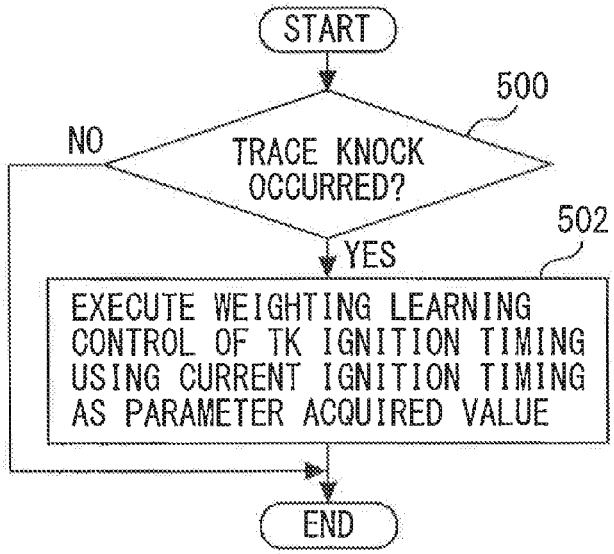
FIG. 20 is a flowchart of the control executed by the ECU in Embodiment 10 of the present invention.

FIG. 19 is a control block diagram illustrating ignition timing control according to Embodiment 10 of the present invention. As illustrated in this figure, a system of this embodiment is provided with an MBT map 120 configured similarly to the above-described Embodiment 9, a learning control portion 122, the TK map 124, and a Min selection portion 126. Here, the TK map 124 is a multi-dimensional learning map configured similarly to the MBT map 120, the at each grid point of the TK map 124, the learning value $Z_{ij}(k)$ of TK ignition timing which is a control parameter is stored capable of being updated, respectively. The TK ignition timing is defined as ignition timing at which the trace knock occurs in the TK region before the ignition timing reaches the MBT (before the MBT is realized), that is, the ignition timing on the most advanced angle side capable of being realized without causing a full-fledged knock. In the following explanation, the learning value $Z_{ij}(k)$ of the MBT map 120 is noted as an MBT learning value Z1, and the learning value $Z_{ij}(k)$ of the TK map 124 is noted as a TK learning value Z2.

In this embodiment, the weighting learning control of the MBT described in the above-described Embodiment 9 and the weighting learning control of the TK ignition timing are executed by the learning control portion 122. FIG. 20 is a flowchart of the control executed by the ECU in Embodiment 10 of the present invention. The routine illustrated in this figure describes only the learning processing of the TK ignition timing. In the routine illustrated in FIG. 20, first, at Step 500, it is determined whether or not the trace knock occurred on the basis of an output waveform of the in-cylinder pressure sensor 50. If this determination holds true, at Step 502, the current ignition timing (TK ignition timing) is acquired as the parameter acquired value $z_k$. Then, the weighting learning control is executed on the basis of this acquired value, and the TK learning value Z2 is updated.

Therefore, if the trace knock occurs before the MBT is realized, the ignition timing at this point of time is acquired and learned as the TK ignition timing. Moreover, if the ignition timing reaches the MBT, the MBT is acquired and learned. As a result, in the learning control of this embodiment, each time ignition is performed, either one of the MBT map 120 and the TK map 124 is learned (updated).

Moreover, in the ignition timing control of this embodiment, first, on the basis of the engine operation state (each of the above-described reference parameter), the learning values Z1 and Z2 are calculated from the MBT map 120 and the TK map 124, and a size relationship between the learning values Z1 and Z2 is determined by the Min selection portion 126. The Min selection portion 126 selects the smaller ignition timing (ignition timing on the more delayed angle side) in the MBT learning value Z1 and the TK learning value Z2 and outputs the selected ignition timing as the ignition timing Adv before correction. The processing after the ignition timing Adv is outputted is similar to the processing described in Embodiments 9.

According to this embodiment configured as above, in addition to the working effect substantially similar to the above-described Embodiment 9, the following effects can be obtained. Since either one of the MBT and the TK ignition timing can be learned in learning of the ignition timing, the learning chances can be increased, and the ignition timing can be efficiently learned other than the MBT region. Moreover, in this embodiment, the ignition timing on the advanced angle side in the MBT learning value Z1 and the TK learning value Z2 can be selected. Therefore, while occurrence of the knock is avoided, the ignition timing is controlled to the advanced angle side as much as possible so that the operation performances and operation efficiency can be improved. In Embodiment 10, the learning control portion 122 indicates specific examples of the weight setting means and the weighting learning means of the two learning maps composed of the MBT map 120 and the TK map 124. Moreover, the routine in FIG. 20 indicates a specific example of the TK ignition timing learning means, and the Min selection portion 126 indicates a specific example of selecting means.

Embodiment 11

Figure 21:
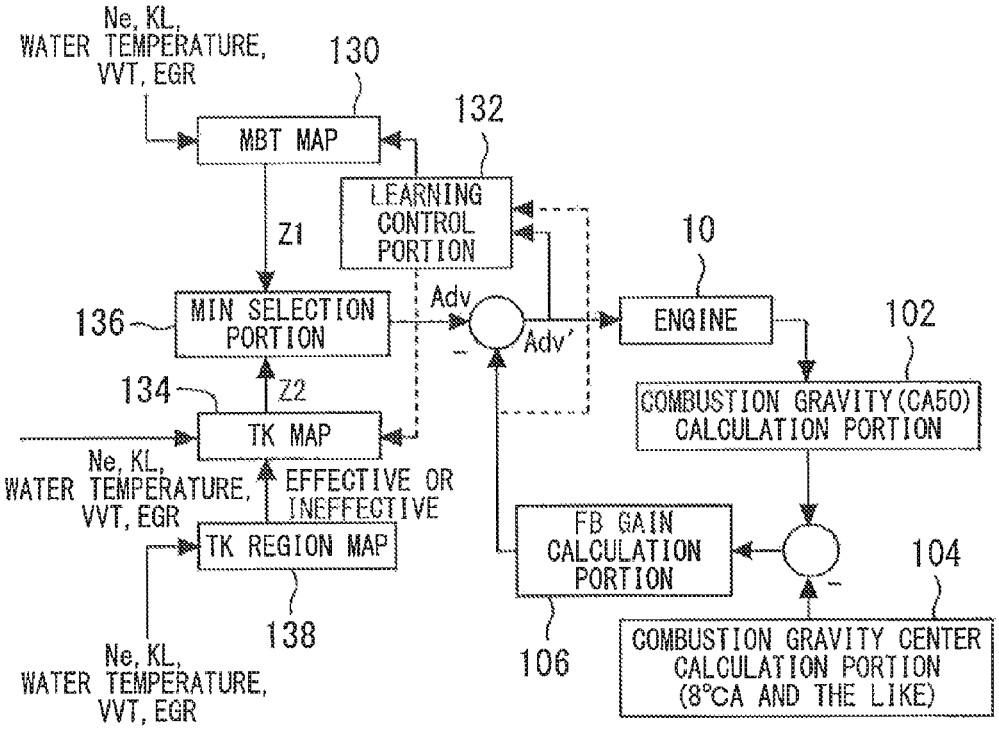
FIG. 21 is a control block diagram illustrating ignition timing control according to Embodiment 11 of the present invention.

Subsequently, by referring to FIG. 21 and FIG. 22, Embodiment 11 of the present invention will be explained. This embodiment is characterized in that, in addition to the configuration of the above-described Embodiment 10, a TK region map for confirming the TK region is employed. In this embodiment, the same reference numerals are given to the same constituent elements of those in Embodiments 7 and 10, and the explanation will be omitted.

[Features of Embodiment 11]

In the above-described Embodiments 10, it is configured such that the TK ignition timing is learned by the TK map 124, but with this configuration, there is a concern that the TK ignition timing is mis-learned in a region other than the TK region (the MBT region where there is no measurement point of the TK ignition timing or the like). Thus, in this embodiment, it is configured such that the TK region is learned by a TK region map 138 which will be described later, and a TK map 134 is used only in the TK region. FIG. 21 is a control block diagram illustrating ignition timing control according to Embodiment 11 of the present invention. As illustrated in this figure, a system of this embodiment is provided with an MBT map 130, a learning control portion 132, the TK map 134, a Min selection portion 136 configured similarly to the above-described Embodiment 10, and the TK region map 138.

The TK region map 138 is a multi-dimensional learning map configured similarly to the MBT map 130 and the TK map 134, and at each grid point of the TK region map 138, a TK region determination value which is a control parameter is stored, respectively. The TK region determination value is the learning value $Z_{ij}(k)$ indicating whether or not the individual grid points of the TK map 134 belongs to a trace knock region, updated by the weighting learning control similar to the reliability map, and changes within a range of 0 to 1. Then, the larger a value of the TK region determination value is, the higher the possibility (reliability) that the grid point corresponding to the determination value belongs to the TK region.

Figure 22:
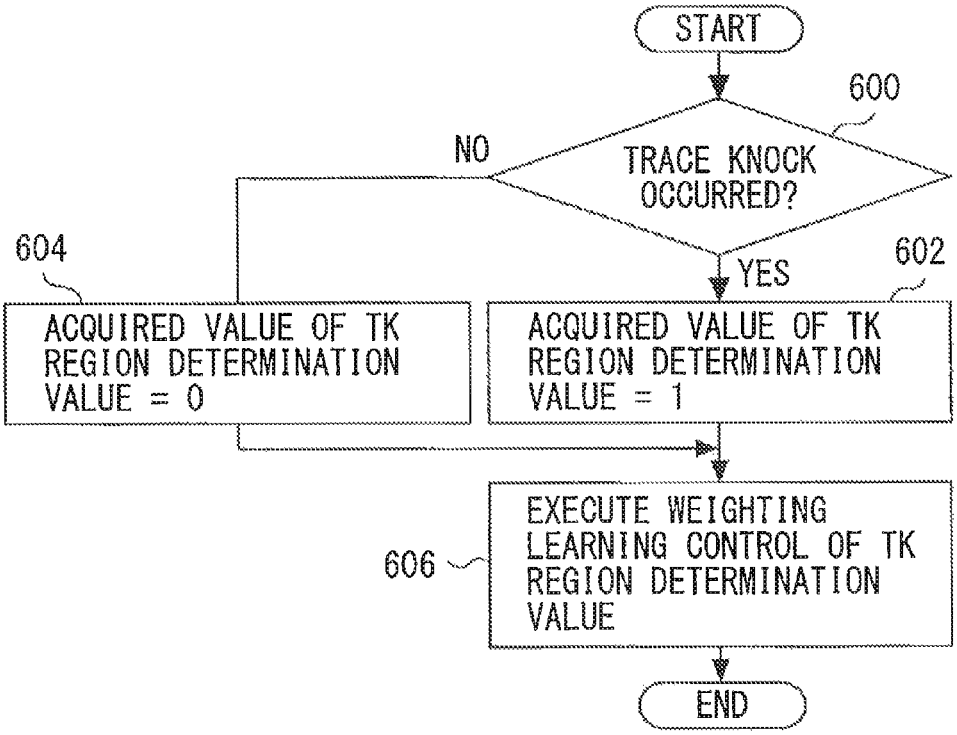
FIG. 22 is a flowchart illustrating the learning control of the TK region map 138 executed by the ECU in Embodiment 11 of the present invention.

FIG. 22 is a flowchart illustrating the learning control of the TK region map 138 executed by the ECU in Embodiment 11 of the present invention. A routine illustrated in this figure is periodically executed in parallel with the learning processing of the MBT map 130, for example. In the routine illustrated in FIG. 22, first, at Step 600, it is determined whether or not the trace knock has occurred. If this determination holds true, it is the TK region, and the routine proceeds to Step 602, and an acquired value of the TK region determination value in the current operation region (position on the learning map determined by a combination of the reference parameters) is set to 1. On the other hand, if the determination at Step 600 does not hold true, it is not the TK region, and the routine proceeds to Step 604, and the acquired value of the TK region determination value is set to 0.

Then, at Step 606, by executing the weighting learning control of the TK region determination value, the TK region determination values at all the grid points are updated. In this case, the TK region determination value corresponds to the control parameter and its learning value $Z_{ij}(k)$I, and the acquired value of the TK region determination value corresponds to the parameter acquired value $z_k$. In the weighting learning control of the TK region determination value, the decrease characteristic of the weight $w_{kij}$ decreasing in accordance with the distance from the reference position is preferably set steep (the standard deviation σ of the Gaussian function is set small). As a result, on the TK region map 138, the boundary of the TK region can be made clear.

On the other hand, when the weighting learning control of the TK ignition timing is executed, when the learning value is to be updated at each grid point of the TK map 134, the TK region determination value stored at the same position on the TK region map 138 is read out. Then, on the basis of the value of the read-out TK region determination value, it is determined whether or not the TK ignition timing is learned at the grid point (learning is effective or ineffective). As an example, it may be so configured that, if the TK region determination value is 0.5 or more, the learning value of the TK ignition timing is updated, and the learning value is not updated in the other cases.

Moreover, by setting the initial value of the TK region determination value to 0, for example, since the learning value of the TK ignition timing is 0 in a region other than the TK region (the MBT region and the like), if a value on the delayed angle side (the smaller value) in the TK ignition timing and the MBT is selected, the ignition timing becomes 0. It is preferable that the TK map 134 is not used in a region where the TK region determination value is close to 0 (grid point) but the ignition timing is controlled on the basis only of the MBT map 130.

According to the embodiment configured as above, in addition to the working effect substantially similar to the above-described Embodiment 10, the following effects can be obtained. By using the TK region map 138, the boundary of the TK region can be made clear, and thus, mis-learning of the TK ignition timing in a region other than the TK region can be suppressed, and learning accuracy can be improved. In the above-described Embodiment 11, the learning control portion 132 indicates specific examples of the weight setting means and the weighting learning means of the two learning maps, that is, the MBT map 130 and the TK map 134. Moreover, the routine in FIG. 22 indicates a specific example of TK region learning means. On the other hand, since the TK region map 138 functions similarly to the reliability map with respect to the TK map 134, Embodiment 11 corresponds to the configuration in which the reliability map is applied to the TK map 134.

Moreover, in the above-described Embodiments 7 to 11, if the ignition timing control is executed by using the learning value of the region where the MBT is not learned at all (grid point), there is a concern that the knock is caused by mis-learning. Thus, in the present invention, the reliability map reflecting a learning history of the MBT may be used at the same time with the MBT maps 100, 110, 120, and 130. In this case, the reliability evaluation value of the reliability map is updated together with the MBT map by the method described in the above-described Embodiment 6. Moreover, in the MBT control, in a region where the reliability of the learning value of the MBT map is low, that is, in a region where a learning history of the MBT is small and the reliability evaluation value of the reliability map is close to 0, it may be configured that the ignition timing is conservatively delayed a little.

Embodiment 12

Subsequently, by referring to FIG. 23 and FIG. 24, Embodiment 12 of the present invention will be explained. This embodiment is characterized in that the weighting learning control described in the above-described Embodiment 1 is applied to calculation control of an in-cylinder air-fuel ratio. In this embodiment, the same reference numerals are given to the same constituent elements as those in Embodiment 1, and the explanation will be omitted.

[Features of Embodiment 12]

In the calculation control of the in-cylinder air-fuel ratio, the in-cylinder air-fuel ratio is calculated on the basis of at least an output of the in-cylinder sensor 50, and this calculated value is corrected on the basis of an output of the air-fuel ratio sensor 54. This embodiment is to learn a correction map used for this correction by the weighting learning control. In general, an exhaust air-fuel ratio detected by the air-fuel ratio sensor 54 has poor responsiveness. That is caused by the fact that a response delay of the sensor itself is large and moreover, a detection position is apart from a combustion chamber. Moreover, the exhaust air-fuel ratio cannot be detected at time of a low temperature when the air-fuel ratio sensor is not activated, and detection according to a cylinder is also difficult. On the other hand, regarding the in-cylinder air-fuel ratio, an air-fuel ratio in combustion can be calculated every time and thus, responsiveness is good, and control with high accuracy can be realized. However, since the in-cylinder air-fuel ratio basically has low calculation accuracy, it is preferably corrected on the basis of the output of the air-fuel ratio sensor 54.

Figure 23:
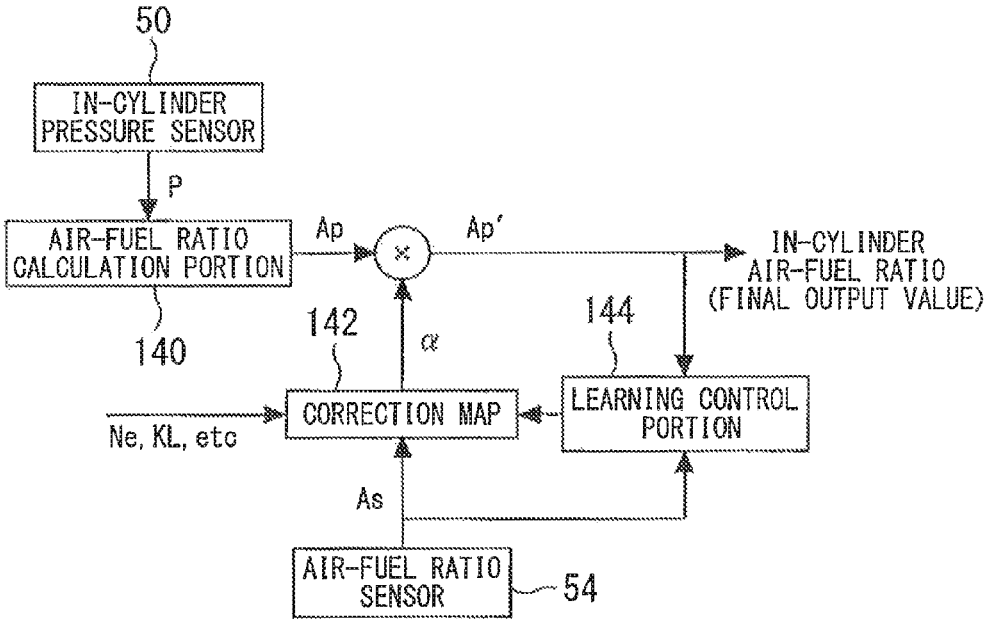
FIG. 23 is a control block diagram illustrating the calculation control of the in-cylinder air-fuel ratio according to Embodiment 12 of the present invention.

FIG. 23 is a control block diagram illustrating the calculation control of the in-cylinder air-fuel ratio according to Embodiment 12 of the present invention. As illustrated in this figure, a system of this embodiment is provided with an air-fuel ratio calculation portion 140, a correction map 142, and a learning control portion 144. Each of constituent element will be explained, and first, the air-fuel ratio calculation portion 140 calculates an in-cylinder air-fuel ratio (CPS detection air-fuel ratio) Ap by an equations in the following Formulas 23 to 25 on the basis of an in-cylinder pressure P detected by an in-cylinder pressure sensor (CPS) 50 and the like.

In-cylinder air-fuel ratio $Ap$=in-cylinder air mass/in-cylinder fuel mass [Formula 23]

In-cylinder fuel mass=CPS detection heating value $Q$/lower heating value [Formula 24]

$$Q = \frac{1}{\kappa - 1}\int \frac{d(PV^{\kappa})}{V^{\kappa-1}}d\theta \quad \text{[Formula 25]}$$

In each of the above-described equations, the in-cylinder air mass is calculated by using an output of an airflow sensor 46 or on the basis of a principle that an in-cylinder pressure change in a compression stroke (a pressure difference between a start point and an end point of the compression stroke) ΔαaP is in proportion to the in-cylinder air mass. Moreover, the lower heating value is defined as a heating value per unit mass of a fuel and is a known value determined in accordance with a component of the fuel and the like. Moreover, the CPS detection heating value Q is a heating value in the cylinder calculated on the basis of an output of the in-cylinder pressure sensor 50 and the like, and each parameter used for the calculation is those explained in the above-described Formula 15.

The in-cylinder air-fuel ratio Ap can easily fluctuate in accordance with the engine operation state. Thus, in this embodiment, the in-cylinder air-fuel ratio Ap is corrected by an equation in the following Formula 26 on the basis of a multiplication type correction coefficient α reflecting the operation state, for example. In this equation, reference character Ap denotes an in-cylinder air-fuel ratio before correction, and reference character Ap' denotes an in-cylinder air-fuel ratio after correction (final output value of the in-cylinder air-fuel ratio). The correction coefficient α is calculated by the correction map 142.

$$Ap' = Ap * \alpha \quad \text{[Formula 26]}$$

The correction map 142 is a multi-dimensional learning map for calculating the correction coefficient α on the basis of a plurality of reference parameters including at least the engine rotation number Ne and the engine load KL, and at each grid point of the correction map 142, the learning value $Z_{ij}(k)$ of the correction coefficient α which is a control parameter is stored, respectively. On the other hand, the learning control portion 144 executes weighting learning control of the correction coefficient α. Specifically, first, on the basis of an equation in the following Formula 27, a ratio between an exhaust air-fuel ratio As detected by the air-fuel ratio sensor 54 and the in-cylinder air-fuel ratio Ap' after correction is calculated as the correction coefficient α. Then, the calculated value of the correction coefficient α is made the parameter acquired value $z_k$, and the learning value $Z_{ij}(k)$ of the correction coefficient α at each grid point is updated.

$$\alpha = As/Ap' \quad \text{[Formula 27]}$$

In a multi-cylinder engine, an average value of the in-cylinder air-fuel ratio Ap' of each cylinder may be employed as the in-cylinder air-fuel ratio Ap' in the equation in the above-described Formula 27. Moreover, since the air-fuel ratio sensor 54 has large response delay, the above-described learning control is to be executed only in the steady operation of the engine and is preferably prohibited in the transition operation.

Figure 24:
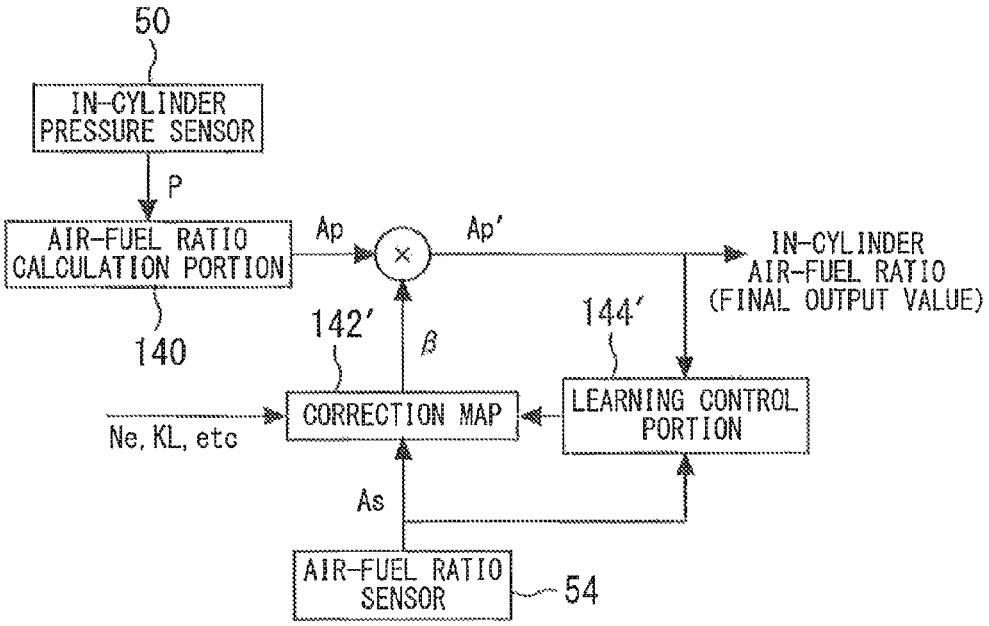
FIG. 24 is a control block diagram illustrating a configuration of a variation according to Embodiment 12 of the present invention.

Moreover, in this embodiment, a configuration of a variation illustrated in FIG. 24 may be employed. In this variation, on the basis of an addition type correction coefficient β, the in-cylinder air-fuel ratio Ap is corrected by an equation in the following Formula 28. Moreover, at each grid point of a correction map 142', the learning value $Z_{ij}(k)$ of the correction coefficient β is stored, respectively, and a learning control portion 144' uses a calculated value of the correction coefficient β calculated by an equation in the following Formula 29 as the parameter acquired value $z_k$ and executes the weighting learning control of the correction coefficient β.

$$Ap' = Ap + \beta \quad \text{[Formula 28]}$$

$$\beta = As = Ap' \quad \text{[Formula 29]}$$

According to this embodiment configured as above, in the calculation control of the in-cylinder air-fuel ratio, the effect described in the above-described Embodiment 1 can be obtained. Particularly, the in-cylinder air-fuel ratio calculated by the in-cylinder pressure sensor 50 has a large error caused by a change in the operation state, even if a correction coefficient obtained by the prior-art learning method is used, improvement of practicability is difficult. On the other hand, in this embodiment, even if the learning chances are relatively fewer, the correction coefficients α and β can be quickly learned at all the grid points of the correction maps 142 and 142'. Therefore, even if an error of the in-cylinder air-fuel ratio is large, this error can be appropriately corrected by the correction coefficients α and β, and calculation accuracy and practicability of the in-cylinder air-fuel ratio can be improved. In the above-described Embodiment 12, the air-fuel ratio calculation portion 140 indicates a specific example of in-cylinder air-fuel ratio calculating means, and the learning control portion 144 indicates specific examples of the weight setting means and the weighting learning means.

Embodiment 13

Subsequently, by referring to FIGS. 25 to 27, Embodiment 13 of the present invention will be explained. This embodiment is characterized in that the weighting learning control described in the above-described Embodiment 1 is applied to learning control of a fuel injection characteristic. In this embodiment, the same reference numerals are given to the same constituent elements as those in Embodiment 1, and the explanation will be omitted.

[Features of Embodiment 13]

Figure 25:
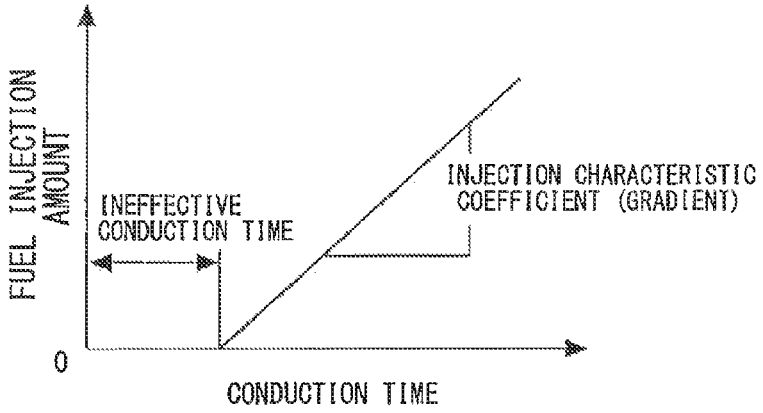
FIG. 25 is a characteristic diagram illustrating an injection characteristic of a fuel injection valve in Embodiment 13 of the present invention.
Figure 26:
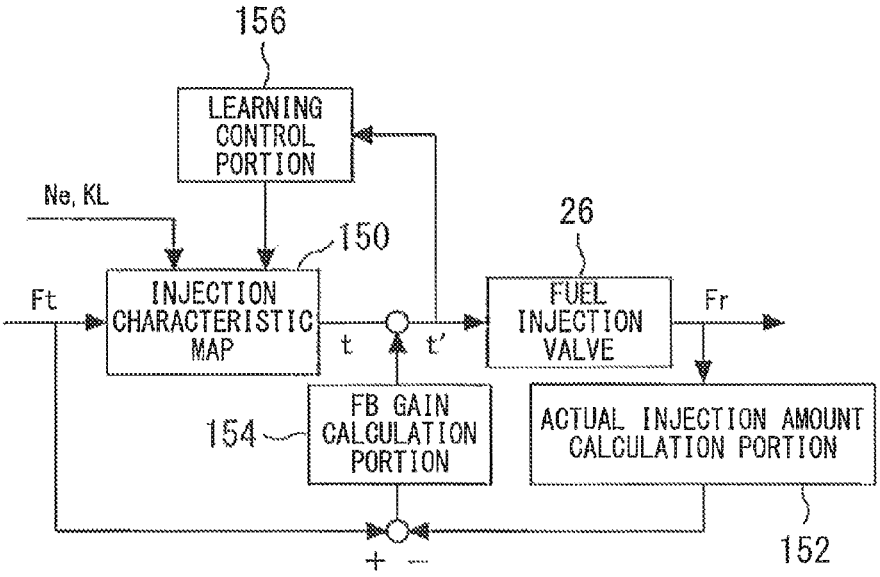
FIG. 26 is a control block diagram illustrating the learning control of the fuel injection characteristic executed in Embodiment 13 of the present invention.

FIG. 25 is a characteristic diagram illustrating an injection characteristic of a fuel injection valve in Embodiment 13 of the present invention. In general, a fuel injection amount of the fuel injection valve 26 has a characteristic of increasing in proportion to effective conduction time obtained by subtracting ineffective conduction time from conduction time and is controlled on the basis of conduction time t by an equation in the following Formula 30. Here, a target injection amount Ft is a target value set by fuel injection control, and an injection characteristic coefficient corresponds to inclination of a characteristic line illustrated in FIG. 25.

Conduction time $t$=target injection amount $Ft$/injection characteristic coefficient+ineffective conduction time [Formula 30]

However, the injection characteristic of the fuel injection valve is changed in accordance by an individual difference of the injection valve, elapse of time and the like and is preferably handled by learning control. Thus, in this embodiment, the fuel injection characteristic is learned by the weighting learning control. FIG. 26 is a control block diagram illustrating the learning control of the fuel injection characteristic executed in Embodiment 13 of the present invention. As illustrated in this figure, a system of this embodiment is provided with an injection characteristic map 150, an actual injection amount calculation portion 152, an FB gain calculation portion 154, and a learning control portion 156.

The injection characteristic map 150 is a multi-dimensional learning map for calculating the conduction time t on the basis of reference parameters composed of the target fuel injection amount Ft, the engine rotation number Ne, and the engine load KL, for example, and at each grid point of the injection characteristic map 150, the learning value $Z_{ij}(k)$ of the conduction time t which is a control parameter is stored, respectively. The actual injection amount calculation portion 152 calculates the actual fuel injection amount (actual injection amount) Fr on the basis of the output of the in-cylinder pressure sensor 50, and the actual injection amount Fr is acquired by dividing the in-cylinder fuel mass described in the above-described Embodiment 12 by the correction coefficient α as illustrated in an equation in the following Formula 31.

Actual injection amount $Fr$=In-cylinder fuel mass/α [Formula 31]

The FB gain calculation portion 154 compares the target fuel injection amount Ft with the actual injection amount Fr and calculates a correction amount of the conduction time t and corrects the conduction time t on the basis of the correction amount. Specifically, on the basis of the target fuel injection amount Ft, if the actual injection amount Fr is larger, the conduction time t is decreased, while if the actual injection amount Fr is smaller, the conduction time t is increased. As a result, conduction time t' after correction is calculated, and the fuel injection valve 26 is conducted in accordance with the conduction time t'.

On the other hand, the learning control portion 156 uses the conduction time t' after correction as the parameter acquired value $z_k$, executes the weighting learning control of the conduction time t and updates the learning value $Z_{ij}(k)$ stored at each grid point of the injection characteristic map 150. Since the fuel injection characteristic is a primary function as illustrated in FIG. 25, it is only necessary that there are two grid points on the injection characteristic map 150.

According to this embodiment configured as above, in the learning control of the fuel injection characteristic, the effect described in the above-described Embodiment 1 can be obtained. Therefore, even in a small number of learning times, a change in the injection characteristic can be efficiently learned, and accuracy of the fuel injection control can be improved. Particularly in this embodiment, the actual injection amount Fr is calculated on the basis of the output of the in-cylinder pressure sensor 50, and learning can be executed on the basis of this actual injection amount Fr and thus, even if the actual fuel injection amount cannot be detected, the learning control can be easily executed by using an existing sensor. In the above-described Embodiment 13, the actual injection amount calculation portion 152 indicates a specific example of actual injection amount calculating means, and the learning control portion 156 indicates a specific example of the weight setting means and the weighting learning means.

Figure 27:
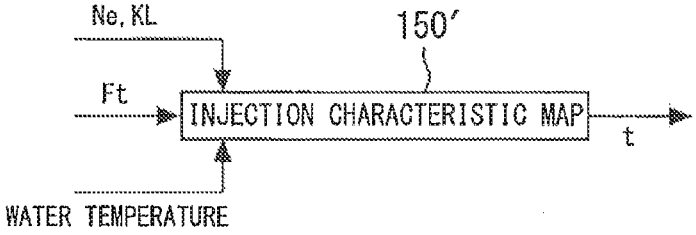
FIG. 27 is a control block diagram illustrating a variation in Embodiment 13 of the present invention.

Moreover, if a temperature of the engine is low, discrepancy is caused in the fuel injection characteristic by a portion for which fuel cannot be evaporated easily, and in the above-described embodiment, a configuration of a variation illustrated in FIG. 27 may be employed. In this variation, an injection characteristic map 150' is configured to calculate the conduction time t on the basis of the reference parameters composed of the target fuel injection amount Ft, the engine rotation number Ne, the engine load KL, and the water temperature. As a result, a difference in a warming-up state of the engine can be handled.

Embodiment 14

Figure 28:
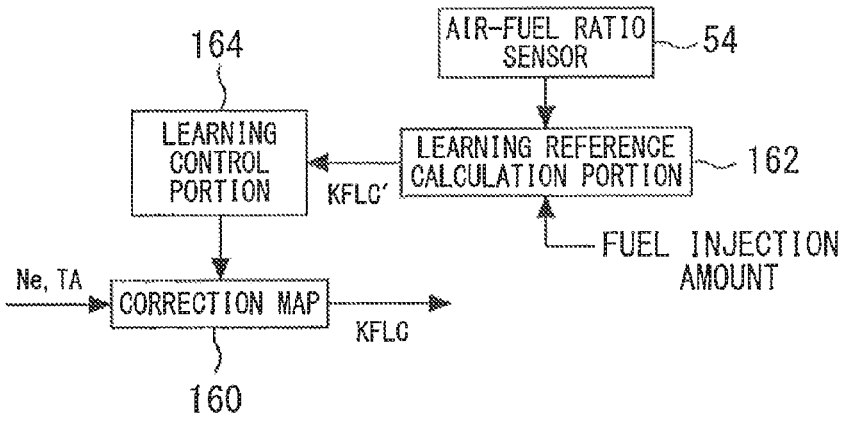
FIG. 28 is a control block diagram illustrating learning control of the correction coefficient for an airflow sensor in Embodiment 14 of the present invention.

Subsequently, by referring to FIG. 28, Embodiment 14 of the present invention will be explained. This embodiment is characterized in that the weighting learning control described in the above-described Embodiment 1 is applied to an output correction coefficient of an airflow sensor. In this embodiment, the same reference numerals are given to the same constituent elements as those in Embodiment 1, and the explanation will be omitted.

[Features of Embodiment 14]

In general, when the airflow sensor 46 is used, a final detection air amount Sout is calculated by correcting a sensor output value S by an equation in the following Formula 32. Here, reference character KFLC denotes a correction coefficient for output correction and is stored in a correction map 160 illustrated in FIG. 28. FIG. 28 is a control block diagram illustrating learning control of the correction coefficient for an airflow sensor in Embodiment 14 of the present invention.

Detection air amount $Sout$=Sensor output value $S*KFLC$ [Formula 32]

The correction map 160 is a multi-dimensional learning map for calculating the correction coefficient KFLC on the basis of reference parameters composed of the engine rotation number Ne and an outside air temperature TA, for example, and at each grid point of the correction map 160, the learning value $Z_{ij}(k)$ of the correction coefficient KFLC which is a control parameter is stored, respectively. Moreover, a system of this embodiment is provided with a learning reference calculation portion 162 and a learning control portion 164 in addition to the correction map 160. The learning reference calculation portion 162 calculates a learning reference value KFLC' of the correction coefficient by equations in the following Formula 33 and Formula 34 on the basis of an output of the air-fuel ratio sensor 54 and the fuel injection amount. In the following equations, the actual fuel injection amount Fr (equation in Formula 31) calculated in the above-described Embodiment 13 is preferably used as the fuel injection amount.

$$KFLC' = \text{Air-fuel ratio detection air amount/sensor output value } S \quad \text{[Formula 33]}$$

$$\text{Air-fuel ratio detection amount} = \text{Air-fuel ratio sensor output} * \text{fuel injection amount} \quad \text{[Formula 34]}$$

The learning control portion 164 uses the learning reference value KFLC' of the correction coefficient calculated by the equation in the above-described Formula 33 as the parameter acquired value $z_k$, executes the weighting learning control of the correction coefficient KFLC and updates the learning value $Z_{ij}(k)$ stored at each grid point of the correction map 160. Since the air-fuel ratio sensor 54 has a large response delay, the above-described learning control is to be executed only in the steady operation of the engine and is preferably prohibited in the transition operation.

According to this embodiment configured as above, in the learning control of the correction coefficient for an airflow sensor, the effect described in the above-described Embodiment 1 can be obtained. Therefore, even in a small number of learning times, the correction coefficient KFLC can be efficiently learned, and calculation accuracy of an intake air amount can be improved. In the above-described Embodiment 14, the learning reference calculation portion 162 indicates a specific example of the learning reference calculating means, and the learning control portion 164 indicates specific examples of the weight setting means and the weighting learning means.

Embodiment 15

Subsequently, by referring to FIG. 29, Embodiment 15 of the present invention will be explained. This embodiment is characterized in that the weighting learning control described in the above-described Embodiment 1 is applied to calculation control of a wall-surface fuel adhesion amount. In this embodiment, the same constituent elements are given the same reference numerals as those in Embodiment 1, and the explanation will be omitted.

[Features of Embodiment 15]

As an example of the fuel injection control, the wall-surface fuel adhesion amount qmw which is an amount of an injected fuel adhering to a wall surface of an intake port or the like is calculated, and the fuel injection amount is corrected on the basis of this calculation result. In this case, in the calculation control of the wall-surface fuel adhesion amount qmw, the wall-surface fuel adhesion amount qmw is acquired from a wall-surface fuel adhesion amount calculation map (QMW map). In this embodiment, the weighting learning control is applied to this QMW map.

Figure 29:
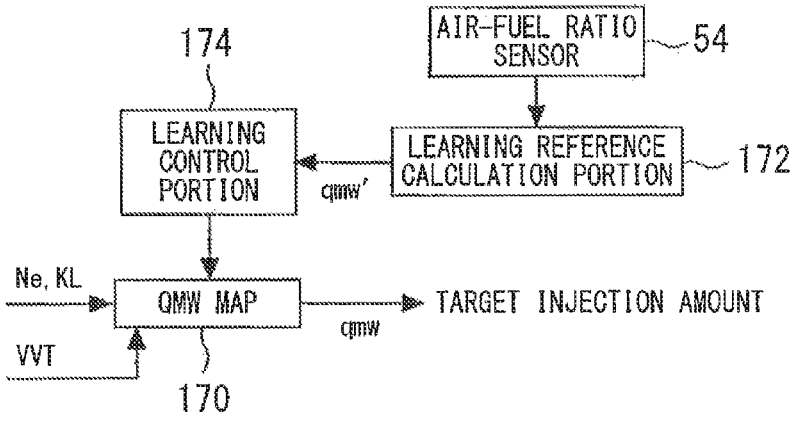
FIG. 29 is a control block diagram illustrating the learning control of the wall-surface fuel adhesion amount in Embodiment 15 of the present invention.

FIG. 29 is a control block diagram illustrating the learning control of the wall-surface fuel adhesion amount in Embodiment 15 of the present invention. As illustrated in this figure, a system of this embodiment is provided with a QMW map 170, a learning reference calculation portion 172, and a learning control portion 174. The QMW map 170 is a multi-dimensional learning map for calculating the wall-surface fuel adhesion amount qmw on the basis of reference parameters including the engine rotation number Ne, the engine load KL, and a valve timing control amount by VVT and the like, for example, and at each grid point of the QMW map 170, the learning value $Z_{ij}(k)$ of the wall-surface fuel adhesion amount qmw which is a control parameter is stored, respectively. The wall-surface fuel adhesion amount qmw calculated by the QMW map 170 is reflected in a target injection amount of the fuel in the fuel injection control.

The learning reference calculation portion 172 calculates a learning reference value qmw' of the wall-surface fuel adhesion amount by an equation in the following Formula 35 on the basis of the wall-surface fuel adhesion amount qmw calculated by the QMW map 170, an output of the air-fuel ratio sensor 54, and parameters for determining acceleration and deceleration of the engine. As the parameters for determining acceleration/deceleration, an output of a throttle sensor, an engine rotation number and the like, for example, can be cited.

$$qmw' = qmw + \text{adjustment amount } \Delta \quad \text{[Formula 35]}$$

In the above-described equation, the learning reference value qmw' of the wall-surface fuel adhesion amount cannot be directly detected or calculated easily and thus, it is acquired by adding an adjustment amount Δ0 to the calculated value qmw by the QMW map 170. The adjustment amount Δ is set as a micro amount for changing the wall-surface fuel adhesion amount qmw little by little, and as a specific example, it is determined by the following processing:

(1) If the air-fuel ratio becomes lean in acceleration or if the air-fuel ratio becomes rich in deceleration, it is determined that the wall-surface fuel adhesion amount runs short, and the adjustment amount Δ is set to a predetermined positive value.

(2) If the air-fuel ratio becomes rich in acceleration or if the air-fuel ratio becomes lean in deceleration, it is determined that the wall-surface fuel adhesion amount is excessive, and the adjustment amount Δ is set to a predetermined negative value.

The learning control portion 174 uses the learning reference value qmw' of the wall-surface fuel adhesion amount calculated by the equation in the above-described Formula 35 as the parameter acquired value $z_k$, executes the weighting learning control of the wall-surface fuel adhesion amount qmw and updates the learning value $Z_{ij}(k)$ stored at each grid point of the QMW map 170.

According to this embodiment configured as above, in the learning control of the wall-surface fuel adhesion amount, the effect described in the above-described Embodiment 1 can be obtained. Therefore, even in a small number of learning times, the wall-surface fuel adhesion amount qmw can be efficiently learned, and accuracy of the fuel injection control can be improved. In the above-described Embodiment 15, the learning reference calculation portion 172 indicates a specific example of the learning reference calculating means, and the learning control portion 174 indicates specific examples of the weight setting means and the weighting learning means.

Embodiment 16

Subsequently, by referring to FIG. 30, Embodiment 16 of the present invention will be explained. This embodiment is characterized in that the weighting learning control described in the above-described Embodiment 1 is applied to learning control of valve timing. In this embodiment, the same reference numerals are given the same constituent element as those in Embodiment 1, and the explanation will be omitted.

[Features of Embodiment 16]

Figure 30:
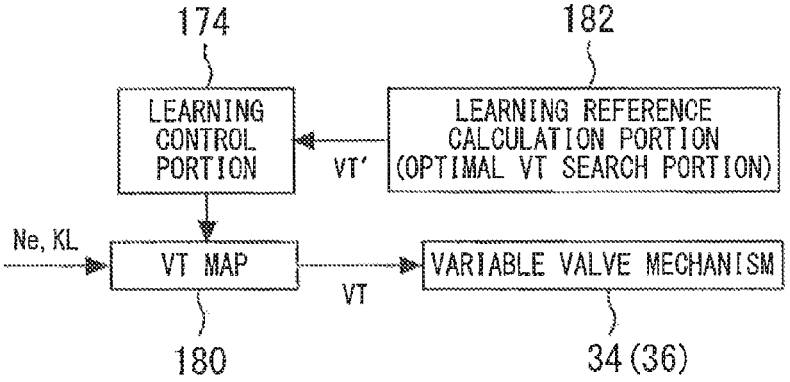
FIG. 30 is a control block diagram illustrating learning control of the valve timing in Embodiment 16 of the present invention.

FIG. 30 is a control block diagram illustrating learning control of the valve timing in Embodiment 16 of the present invention. As illustrated in this figure, a system of this embodiment is provided with a VT map 180, a learning reference calculation portion (optimal VT search portion) 182, and a learning control portion 184. The VT map 180 is a multi-dimensional learning map for calculating the valve timing VT on the basis of reference parameters composed of the engine rotation number Ne and the engine load KL, for example, and at each grid point of the VT map 180, the learning value $Z_{ij}(k)$ of the valve timing VT which is a control parameter is stored, respectively. During an operation of the engine, the valve timing VT is calculated by the VT map 180 on the basis of each of the above-described reference parameters, and this calculated value is outputted to an actuator of the variable valve mechanism 34 (36). A control target of this embodiment is preferably the intake valve 30 but may be the exhaust valve 32.

The optimal VT search portion 182 searches the optimal valve timing at which fuel consumption becomes optimal, for example, and the search result is outputted as a learning reference value VT' of the valve timing. As a searching method of the optimal valve timing, a general method is used. As an example, a fuel consumption rate per unit time is calculated on the basis of information such as the in-cylinder fuel mass calculated on the basis of the output of the in-cylinder pressure sensor 50 as described above, for example, the engine rotation number and the like, and by changing the valve timing VT little by little while this calculated value is monitored, the optimal valve timing VT can be found.

On the other hand, the learning control portion 184 uses the learning reference value VT of the valve timing as the parameter acquired value $z_k$, executes the weighting learning control of the valve timing VT and updates the learning value $Z_{ij}(k)$ stored at each grid point of the VT map 180. According to this embodiment configured as above, in the learning control of the valve timing, the effect described in the above-described Embodiments 1 can be obtained. Therefore, even in a small number of learning times, the valve timing can be efficiently learned, and controllability of the valve system can be improved. In the above-described Embodiment 16, the optimal VT search portion 182 indicates a specific example of the learning reference calculating means, and the learning control portion 184 indicates specific examples of the weight setting means and the weighting learning means.

Moreover, in Embodiment 16, during search processing of the optimal valve timing, there is a possibility that the realized valve timing is not an optimal value. Thus, in the above-described search processing, the weight $w_{kij}$ used by the weighting learning control may be configured to be made smaller than that after completion of the search processing. Moreover, during the search processing, instead of making the weight $w_{kij}$ small, it may be so configured that the above-described reliability map is used at the same time. Specifically, if the learning control is to be executed during the search processing of the valve timing, it is only necessary that the reliability acquired value is set to a small value at the reference position on the reliability map (position of the learning reference value VT'). According to the above-described configuration, the update amount of the learning value can be adjusted as appropriate in accordance with reliability on whether or not the valve timing is optimized, and learning accuracy can be improved.

Embodiment 17

Subsequently, by referring to FIG. 31 and FIG. 32, Embodiment 17 of the present invention will be explained. This embodiment is characterized in that the weighting learning control described in the above-described Embodiment 1 is applied to learning control of misfire limit ignition timing. In this embodiment, the same reference numerals are given to the same constituent elements as those in Embodiment 1, and the explanation will be omitted.

[Features of Embodiment 17]

Figure 31:
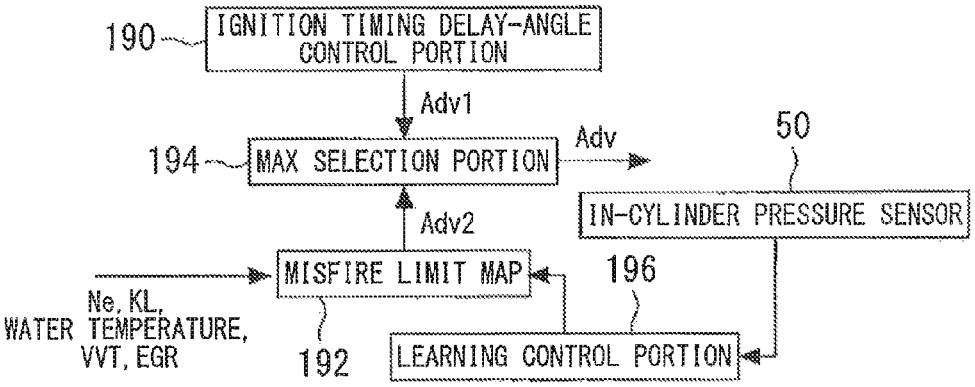
FIG. 31 is a control block diagram illustrating ignition timing control according to Embodiment 17 of the present invention.

FIG. 31 is a control block diagram illustrating ignition timing control according to Embodiment 17 of the present invention. As illustrated in this figure, a system of this embodiment is provided with ignition timing delay-angle control portion 190, a misfire limit map 192, a Max selection portion 194, and a learning control portion 196. The ignition timing delay-angle control portion 190 executes general controls for delaying the ignition timing such as knock control, speed-change response control, catalyst warming-up control and the like, for example, and outputs a target ignition timing Adv1 set by delaying through these controls.

The misfire limit map 192 is a multi-dimensional learning map for calculating misfire limit ignition timing Adv2 on the basis of a plurality of reference parameters, and at each grid point of the misfire limit map 192, the learning value $Z_{ij}(k)$ of the misfire limit ignition timing Adv2 which is a control parameter is stored, respectively. The misfire limit ignition timing is defined as ignition timing on the most delayed angle side that can be realized without occurrence of a misfire by ignition timing delay-angle control. Moreover, as the above-described reference parameters, the engine rotation number Ne, the engine load KL, the water temperature, a control amount of the valve timing, a control amount of EGR and the like, for example, can be cited. The Max selection portions 194 selects the larger ignition timing (ignition timing on the more delayed angle side) in the target ignition timing Adv1 delayed by the ignition timing delay-angle control and the misfire limit ignition timing Adv2 calculated by the misfire limit map 192 and outputs the selected ignition timing.

Figure 32:
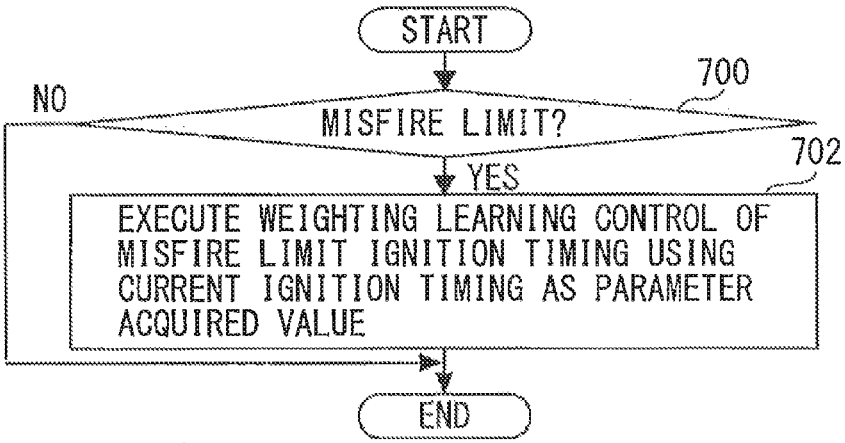
FIG. 32 is a flowchart of control executed by the ECU in Embodiment 17 of the present invention.

On the other hand, the learning control portion 196 executes the weighting learning control of the misfire limit ignition timing Adv2 by the processing illustrated in FIG. 32. FIG. 32 is a flowchart of control executed by the ECU in Embodiment 17 of the present invention. In a routine illustrated in this figure, first, at Step 700, it is determined whether or not the current ignition timing is a misfire limit. Specifically speaking, at Step 700, first, the above-described CPS detection heating value Q is calculated on the basis of the output of the in-cylinder pressure sensor 50, and if this calculated amount becomes a predetermined determination value or less corresponding to the lower limit value of normal combustion, occurrence of a misfire is detected. And the number of misfire times per unit time is counted, and if the count value exceeds a predetermined determination value corresponding to the misfire limit, it is determined that the current ignition timing reaches the misfire limit ignition timing.

If the determination at Step 700 holds true, the routine proceeds to Step 702, and by using the current ignition timing as the parameter acquired value $z_k$, the weighting learning control of the misfire limit ignition timing Adv2 is executed, and the learning value $Z_{ij}(k)$ stored at each grid point of the misfire limit map 192 is updated. According to this embodiment configured as above, in the learning control of the misfire limit ignition timing, the effect described in the above-described Embodiment 1 can be obtained, and the misfire limit can be efficiently learned. And by selecting the delayed angle side of the ignition timings Adv1 and Adv2, while the misfire is avoided, the ignition timing can be delayed to the maximum in accordance with a delay-angle request, and controllability of the ignition timing can be improved. Moreover, the weighting learning control is executed only when the misfire limit is reached, but since the misfire limit ignition timing can be efficiently learned at all the grid points of the misfire limit map 192 in one session of the learning operation, even in a small number of learning chances, learning can be made sufficiently.

In the above-described embodiment 17, Step 700 in FIG. 32 indicates a specific example of misfire limit determining means, Step 702 indicates a specific example of misfire limit learning means, and the Max selection portion 194 indicates a specific example of selecting means. On the other hand, in embodiment 17, since the operation is not performed in the vicinity of the misfire limit all the time, it may be so configured that a misfire region map is used in order to avoid mis-learning other than the vicinity of the misfire limit. In this case, the misfire region map has a configuration and a function similar to the TK region map 138 described in the above-described Embodiment 11 and at each grid point of the misfire region map, the learning value of a misfire region determination value is stored, respectively. Then, if the misfire limit is detected, a detection position of the misfire limit is made a reference position, a misfire region determination value is set at the same position on the misfire region map, and moreover, it is only necessary that the weighting learning control of the misfire region map is executed. As a result, a boundary of the misfire limit region can be made clear.

Embodiment 18

Subsequently, by referring to FIG. 33, Embodiment 18 of the present invention will be explained. This embodiment is characterized in that the weighting learning control described in the above-described Embodiment 1 is applied to learning control of a fuel increase amount correction value. In this embodiment, the same reference numerals are given to the same constituent elements as those in Embodiment 1, and the explanation will be omitted.

[Features of Embodiment 18]

Figure 33:
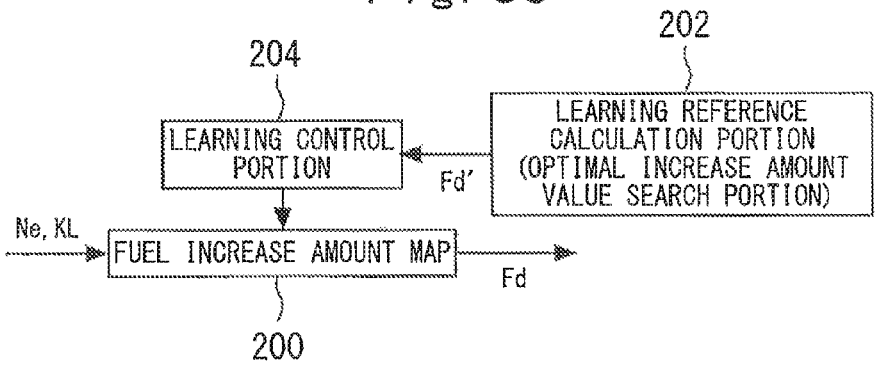
FIG. 33 is a control block diagram illustrating learning control of the fuel increase amount correcting value in Embodiment 18 of the present invention.

FIG. 33 is a control block diagram illustrating learning control of the fuel increase amount correcting value in Embodiment 18 of the present invention. As illustrated in this figure, a system of this embodiment is provided with a fuel increase amount map 200, a learning reference calculation portion (optimal increase amount value search portion) 202, and a learning control portion 204. The fuel increase amount map 200 is a multi-dimensional learning map for calculating a fuel increase amount value Fd on the basis of reference parameters composed of the engine rotation number Ne and the engine load KL, for example, and at each grid point of the fuel increase amount map 200, the learning value $Z_{ij}(k)$ of the fuel increase amount value Fd which is a control parameter is stored, respectively. The fuel increase amount value Fd is a correction amount (power increase amount value) for applying increase-amount correction to a target injection amount in accordance with an acceleration request or the like in the fuel injection control. The optimal increase amount value search portion 202 searches an optimal value of the fuel increase amount at which an engine torque is maximized on the basis of the output of the in-cylinder pressure sensor 50, for example, and outputs the search result as a learning reference value Fd' of the fuel increase amount value.

On the other hand, the learning control portion 204 uses the learning reference value Fd' of the fuel increase amount value as the parameter acquired value $z_k$, executes the weighting learning control of the fuel increase value Fd and updates the learning value $Z_{ij}(k)$ stored at each grid point of the fuel increase amount map 200. According to this embodiment configured as above, in the learning control of the fuel increase amount value, the effect described in the above-described Embodiment 1 can be obtained. Therefore, even in a small number of learning chances, the fuel increase amount value can be efficiently learned, and engine operation performances can be improved. In the above-described Embodiment 18, the learning control portion 204 indicates specific examples of the weight setting means and the weighting learning means.

Embodiment 19

Figure 34:
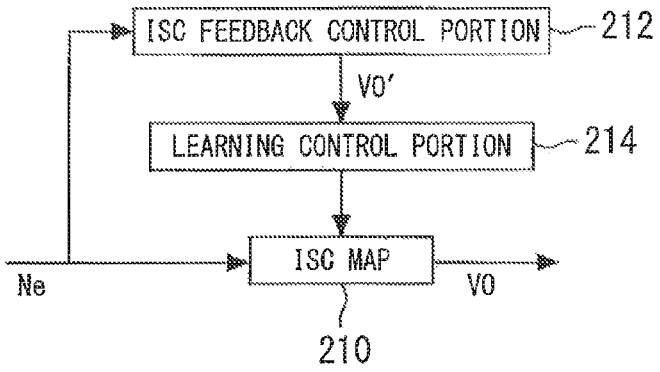
FIG. 34 is a control block diagram illustrating the learning control of the ISC in Embodiment 19 of the present invention.

Subsequently, by referring to FIG. 34, Embodiment 19 of the present invention will be explained. This embodiment is characterized in that the weighting learning control described in the above-described Embodiment 1 is applied to learning control of ISC (Idle Speed Control). In this embodiment, the same reference numerals are given to the same constituent elements as those in Embodiment 1, and the explanation will be omitted.

[Features of Embodiment 19]

In this embodiment, idle operation control for applying feedback control of an opening degree of an intake passage (ISC opening degree) on the basis of the engine rotation number and the like in an idle operation and learning control for learning the ISC opening degree corrected by the idle operation control. Specifically speaking, the opening degree of the intake passage means an opening degree of an ISC valve or a throttle valve 20. FIG. 34 is a control block diagram illustrating the learning control of the ISC in Embodiment 19 of the present invention. A system in this embodiment is provided with an ISC map 210, an ISC feedback control portion 212, and a learning control portion 214.

The ISC map 210 is a learning map for calculating an ISC opening degree VO on the basis of the engine rotation number Ne, and at each grid point of the ISC map 210, the learning value $Z_{ij}(k)$ of the ISC opening degree VO which is a control parameter is stored, respectively. During the idle operation, the ISC opening degree VO is calculated by the ISC map 210 on the basis of the engine rotation number Ne, and this calculated value is outputted to a driving portion of the ISC valve or the throttle valve 20. Moreover, the ISC feedback control portion 212 corrects (feedback control) the ISC opening degree VO so that the engine rotation number Ne in the idle operation matches a target rotation number. The ISC opening degree VO' corrected by that is inputted into the learning control portion 214.

The learning control portion 214 uses the ISC opening degree VO' after correction as the parameter acquired value $z_k$, executes the weighting learning control of the ISC opening degree VO and updates the learning value $Z_{ij}(k)$ stored at each grid point of the ISC map 210. According to this embodiment configured as above, in the learning control of the ISC opening degree, the effect described in the above-described Embodiment 1 can be obtained. Therefore, even in a small number of learning chances, the ISC opening degree can be efficiently learned, and stability in the idle operation can be improved.

In the above-described Embodiment 19, the learning control portion 214 indicates specific examples of the weight setting means and the weighting learning means. Moreover, in Embodiment 19, it may be so configured that, the larger the engine rotation number Ne is deviated from the target rotation number, it is determined that reliability of the learning value lowers, and the weight $w_{kij}$ is made smaller. This configuration is realized by multiplying the weight $w_{kij}$ by a coefficient which decreases larger as the difference between the engine rotation number Ne and the target rotation number becomes larger. According to this configuration, the engine rotation number Ne is controlled to a value close to the target rotation number, and the higher the accuracy of the idle operation control, the update amount of the learning value can be increased at all the grid points. Moreover, if the engine rotation number Ne is deviated from the target rotation number and the accuracy of the idle operation control is low, the learning can be suppressed. Therefore, learning accuracy of the entire ISC map 210 can be improved.

Embodiment 20

Subsequently, by referring to FIG. 35 and FIG. 36, Embodiment 20 of the present invention will be explained. This embodiment is characterized in that the weighting learning control described in the above-described Embodiment 1 is applied to learning control of EGR. In this embodiment, the same reference numerals are given to the same constituent elements as those in Embodiment 1, and the explanation will be omitted.

[Features of Embodiment 20]

Figure 35:
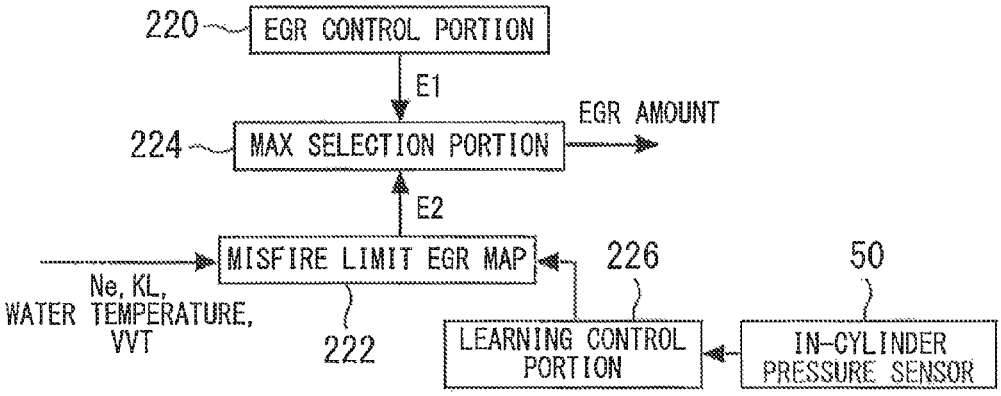
FIG. 35 is a control block diagram illustrating learning control of EGR according to Embodiment 20 of the present invention.

FIG. 35 is a control block diagram illustrating learning control of EGR according to Embodiment 20 of the present invention. As illustrated in this figure, a system of this embodiment is provided with an EGR control portion 220, a misfire limit EGR map 222, a Max selection portion 224, and a learning control portion 226. The EGR control portion 220 is to execute known EGR control and outputs a requested EGR amount E1 calculated by the EGR control. In this embodiment, an "EGR amount" means an arbitrary control parameter corresponding to an amount of an EGR gas flowing into a cylinder and specifically it may be any of parameters of an opening degree of the EGR valve 42, the EGR gas amount flowing through the EGR passage 40, and an EGR rate which is a ratio of the EGR gas amount to the intake air amount.

The misfire limit EGR map 222 is a multi-dimensional learning map for calculating a misfire limit EGR amount E2 on the basis of a plurality of reference parameters, and at each grid point of the misfire limit EGR map 222, the learning value $Z_{ij}(k)$ of the misfire limit EGR amount E2 which is a control parameter is stored, respectively. The misfire limit EGR amount is defined as the maximum EGR amount that can be realized by the EGR control without occurrence of a misfire. Moreover, as the above-described reference parameters, the engine rotation number Ne, the engine load KL, the water temperature, the control amount of the valve timing and the like can be cited. The Max selection portion 224 selects the larger EGR amount in the requested EGR amount E1 calculated by the EGR control and the misfire limit EGR amount E2 calculated by the misfire limit EGR map 222 and outputs the selected EGR amount. The EGR control is executed on the basis of an output amount of this EGR amount.

Figure 36:
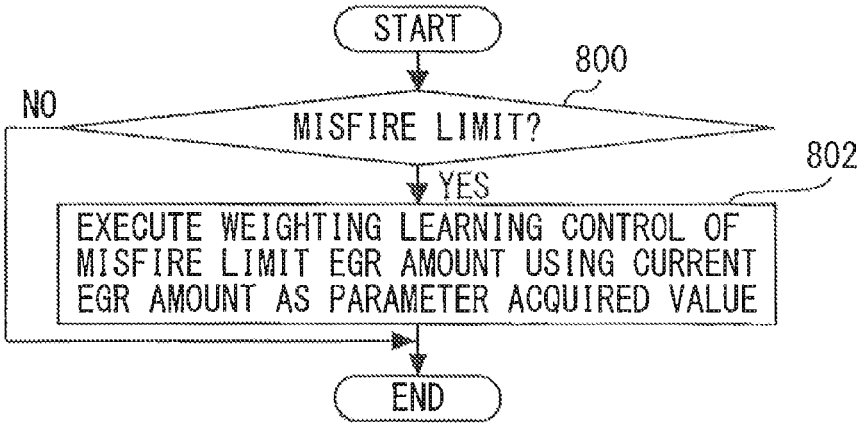
FIG. 36 is a flowchart of the control executed by the ECU in Embodiment 20 of the present invention.

On the other hand, the learning control portion 226 executes the weighting learning control of the misfire limit EGR amount E2 by processing illustrated in FIG. 36. FIG. 36 is a flowchart of the control executed by the ECU in Embodiment 20 of the present invention. In a routine illustrated in this figure, first, at Step 800, it is determined whether or not the current ignition timing is a misfire limit. This determination processing is processing similar to the above-described Embodiment 17 (FIG. 32).

If the determination at Step 800 holds true, the routine proceeds to Step 802, uses the current EGR amount as the parameter acquired value $z_k$, executes the weighting learning control of the misfire limit EGR amount E2 and updates the learning value $Z_{ij}(k)$ stored at each grid point of the misfire limit EGR map 222. According to the embodiment configured as above, in the learning control of the EGR, the effect obtained in the above-described Embodiment 1 can be obtained, and the misfire limit EGR amount can be efficiently learned. Then, by selecting the larger of the EGR amounts E1 and E2, while a misfire is avoided, the EGR amount can be ensured to the maximum in accordance with a request, and controllability of the EGR control can be improved. Moreover, the weighting learning control is executed only when the misfire limit is reached, but since the misfire limit EGR amount can be efficiently learned at all the grid points of the misfire limit EGR map 222 in one session of the learning operation, even if the learning chances are relatively fewer, learning can be made sufficiently.

In the above-described Embodiment 20, Step 800 in FIG. 36 indicates a specific example of misfire limit determining means, Step 802 indicates a specific example of misfire limit EGR learning means, and the Max selection portion 224 indicates a specific example of selecting means. Moreover, in Embodiment 20, the operation is not performed in the vicinity of the misfire limit all the time, it may be so configured that a misfire region map described in the above-described Embodiment 17 is employed in order to avoid mis-learning other than the vicinity of the misfire limit so as to clarify the boundary of the misfire limit region.

Embodiment 21

Figure 37:
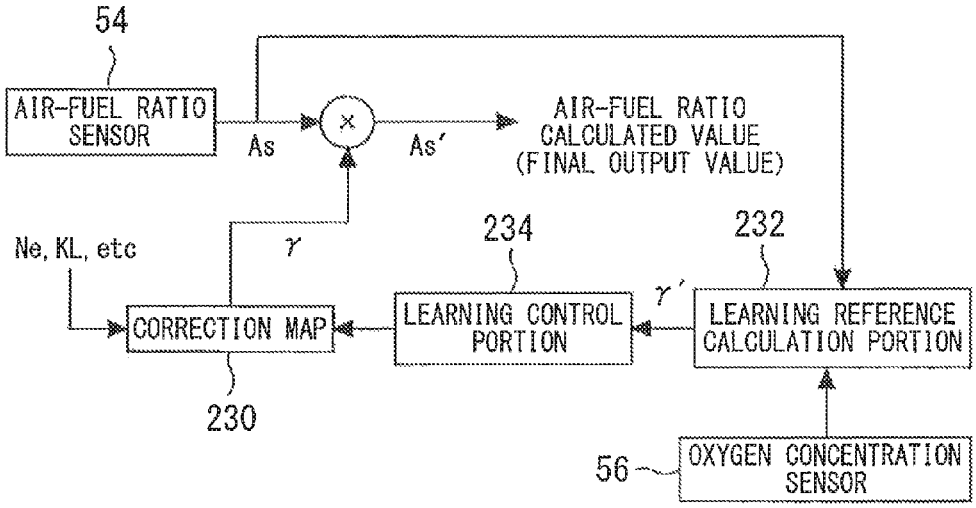
FIG. 37 is a control block diagram illustrating the output correction control of the air-fuel ratio sensor in Embodiment 21 of the present invention.

Subsequently, by referring to FIG. 37, Embodiment 21 of the present invention will be explained. This embodiment is characterized in that the weighting learning control described in the above-described Embodiment 1 is applied to output correction control of an air-fuel ratio sensor. In this embodiment, the same reference numerals are given to the same constituent elements as those in Embodiment 1, and the explanation will be omitted.

[Features of Embodiment 21]

In this embodiment, the output correction control of the air-fuel ratio sensor corrects an output value As of the air-fuel ratio sensor 54 on the basis of an output of the oxygen concentration sensor 56 and controls such that the output value As under stoichiometric atmosphere matches a predetermined reference output value. FIG. 37 is a control block diagram illustrating the output correction control of the air-fuel ratio sensor in Embodiment 21 of the present invention. A system of this embodiment is provided with a correction map 230, a learning reference calculation portion 232, and a learning control portion 234.

The correction map 230 is a multi-dimensional learning map for calculating a correction coefficient γ for output correction on the basis of a plurality of reference parameters including at least the engine rotation number Ne and the engine load KL, and at each grid point of the correction map 230, the learning value $Z_{ij}(k)$ of the correction coefficient γ which is a control parameter is stored, respectively. During an engine operation, the correction coefficient γ is calculated by the correction map 230 on the basis of each of the above-described reference parameters. As a result, the output value AS of the air-fuel ratio sensor is corrected on the basis of the correction coefficient γ as illustrated in an equation in the following Formula 36 and outputted as an air-fuel ratio output value (final output value of exhaust air-fuel ratio) As' after correction.

$$As' = As * \gamma \quad \text{[Formula 36]}$$

The learning reference calculation portion 232 calculates the learning reference value γ' of the correction coefficient on the basis of a reference output value Aref as illustrated in an equation in the following Formula 37 and outputs this calculated value to the learning control portion 234. Here, the reference output value Aref is defined as the output value As of the air-fuel ratio sensor when the output of the oxygen concentration sensor 56 becomes an output value corresponding to a stoichiometric air-fuel ratio.

$$\gamma' = \text{Stoichiometric air-fuel ratio/reference output value } Aref \quad \text{[Formula 37]}$$

In more detail, the oxygen concentration sensor 56 has a characteristic that the output becomes 1 on the rich side and 0 on the lean side but it becomes an intermediate value between 0 to 1 (0.5, for example) in the vicinity of the stoichiometric air-fuel ratio (stoichiometric). In the explanation below, a range that this intermediate value can take (0 to 1) is noted as a stoichiometric band. When the output value of the oxygen concentration sensor 56 is included in the above-described stoichiometric band, the learning reference calculation portion 232 regards it a state in which a true air-fuel ratio is equal to the stoichiometric air-fuel ratio and acquires the output value As of the air-fuel ratio sensor at this time as the reference output value Aref. Then, it calculates the learning reference value γ' of the correction coefficient by the equation in the above-described Formula 37.

On the other hand, the learning control portion 234 uses the learning reference value γ' of the correction coefficient as the parameter acquired value $z_k$, executes the weighting learning control of the correction coefficient γ and updates the learning value $Z_{ij}(k)$ stored at each grid point of the correction map 230. Since the outputs of the air-fuel ratio sensor 54 and the oxygen concentration sensor 56 have large response delays, the above-described learning control is executed only in the steady operation of the engine and is preferably prohibited in the transition operation.

According to this embodiment configured as above, in the output correction control of the air-fuel ratio sensor, the effect described in the above-described Embodiment 1 can be obtained, and detection accuracy of the exhaust air-fuel ratio can be improved. Moreover, in this embodiment, by using the output value of the oxygen concentration sensor 56 is included in the stoichiometric band in the stoichiometric air-fuel ratio, the reference output value Aref in stoichiometric can be acquired. As a result, a reference of correction can be easily obtained. Moreover, the weighting learning control is executed only if the stoichiometric is detected by the oxygen concentration sensor 56, but since the correction coefficient γ can be efficiently learned at all the grid points of the correction map 230 in one session of the learning operation, even if the learning chances are relatively fewer, learning can be made sufficiently. In the above-described Embodiment 21, the learning reference calculation portion 232 indicates a specific example of the learning reference calculating means, and the learning control portion 234 indicates specific examples of the weight setting means and the weighting learning means.

Moreover, in the above-described Embodiment 21, when the weighting learning control is executed, it may be so configured that, the larger the output value of the oxygen concentration sensor is deviated from a median value (0.5) of the stoichiometric band, it is determined reliability that the stoichiometric state is realized or not is low, and the weight $w_{kij}$ is made smaller. This configuration is realized by multiplying the weight $w_{kij}$ by a coefficient which decreases larger as the difference between the output value of the oxygen concentration sensor and 0.5 becomes larger. According to this configuration, the output value of the oxygen concentration sensor gets close to the median value of the stoichiometric band, and the higher the reliability of the stoichiometric state is, the larger the update amount of the learning value can be increased at all the grid points. Moreover, if the output value of the oxygen concentration sensor is deviated from the above-described median value, and the reliability of the stoichiometric state is low, learning can be suppressed. Therefore, learning accuracy of the entire correction map 230 can be improved.

Embodiment 22

Subsequently, by referring to FIG. 38, Embodiment 22 of the present invention will be explained. This embodiment is characterized in that the weighting learning control described in the above-described Embodiment 1 is applied to learning control to a start injection amount. In this embodiment, the same reference numerals are given to the same constituent elements as those in Embodiment 1, and the explanation will be omitted.

[Features of Embodiment 22]

Figure 38:
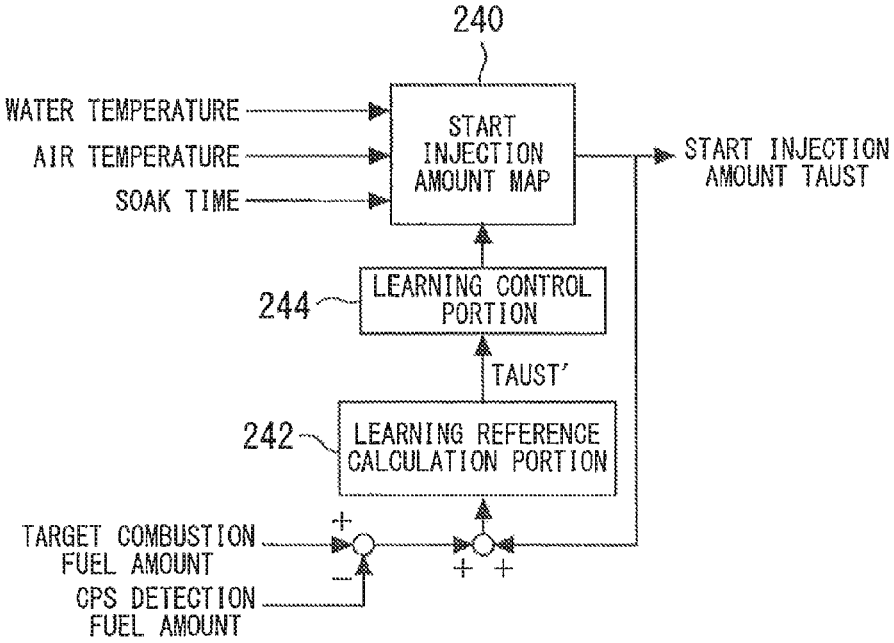
FIG. 38 is a control block diagram illustrating learning control of a start injection amount TAUST according to Embodiment 22 of the present invention.

FIG. 38 is a control block diagram illustrating learning control of a start injection amount TAUST according to Embodiment 22 of the present invention. A system of this embodiment is provided with a start injection amount map 240, a learning reference calculation portion 242, and a learning control portion 244. The start injection amount map 240 is a multi-dimensional learning map for calculating the fuel injection amount TAUST at start on the basis of a plurality of reference parameters including at least a water temperature, an outside air temperature, and soak time (time from engine stop to the subsequent start), and at each grid point of the start injection amount map 240, the learning value $Z_{ij}(k)$ of the start injection amount TAUST which is a control parameter is stored, respectively. At start of the engine, the start injection amount TAUST is calculated by the start injection amount map 240 on the basis of each of the above-described reference parameters, and a fuel in an amount corresponding to the calculated value is injected from the fuel injection valve 26.

The learning reference calculation portion 242 calculates a learning reference value TAUST of the start injection amount on the basis of the start injection amount TAUST calculated by the start injection amount map 240, a target combustion fuel amount, and a CPS detection fuel amount. Here, the target combustion fuel amount is set by fuel injection control at start, for example, and the CPS detection fuel amount is calculated on the basis of an output of the in-cylinder pressure sensor 50 and the like. The CPS detection fuel amount corresponds to the in-cylinder fuel mass used in the above-described Embodiment 12 (equation in Formula 24). The learning reference calculation portion 242 corrects the start injection amount TAUST on the basis of the difference between the target combustion fuel amount and the CPS detection fuel amount and acquires the learning reference value TAUST.

On the other hand, the learning control portion 244 uses the learning reference value TAUST' of the start injection amount as the parameter acquired value $z_k$, executes the weighting learning control of the start injection amount TAUST and updates the learning value $Z_{ij}(k)$ stored at each grid point of the start injection amount map 240. According to this embodiment configured as above, in the learning control of the start injection amount, the effect described in the above-described Embodiment 1 can be obtained. Therefore, even in a small number of learning times, the start injection amount TAUST can be efficiently learned, and startability of the engine can be improved. In the above-described Embodiment 22, the learning reference calculation portions 242 indicates a specific example of the learning reference calculating means, and the learning control portion 244 indicates specific examples of the weight setting means and the weighting learning means.

In the above-described Embodiments 1 to 22, an instance in which the weighting learning control is executed by the ECU 60 mounted on one vehicle, and various learning values are held is exemplified. However, the present invention is not limited to that and may be configured such that the learning value is shared by the ECU of a plurality of vehicles via data communication or the like. As a result, the number of acquired data of the operation state (cooling-down and the like) with fewer learning chances can be increased by being shared with the other vehicles, and learning efficiency or accuracy can be improved. Moreover, by comparing the learning value of the own vehicle with an average of the learning values of the other vehicles, mis-learning can be detected. The learning values of the other vehicles can be acquired by using an onboard network or by acquiring the learning values of the other vehicles accumulated in a service plant while in a garage, for example.

Moreover in the above-described Embodiments 1 to 22, the respective configurations are explained individually, but the present invention is not limited to that, and one system may be configured by combining arbitrary two or more configurations of Embodiments 1 to 22 that can be combined. As specific examples, to the weighting control explained in Embodiments 7 to 22, any of the Gaussian function, the primary function, and the trigonometric function may be applied as the weight means. Moreover, in any of Embodiments 7 to 22, the decrease characteristic of the weight may be configured to be switched for each of the plurality of regions provided in the learning map, and a range for updating the learning value may be configured to be limited to the effective range.

DESCRIPTION OF REFERENCE NUMERALS

10 engine (internal combustion engine), 14 combustion chamber, 16 crank shaft, 18 intake passage, 20 throttle valve, 22 exhaust passage, 24 catalyst, 26 fuel injection valve, 28 ignition plug, 30 intake valve, 32 exhaust valve, 34, 36 variable valve mechanism, 40 EGR passage, 42 EGR valve, 44 crank angle sensor, 46 airflow sensor, 48 water temperature sensor, 50 in-cylinder pressure sensor, 52 intake temperature sensor, 54 air-fuel ratio sensor, 56 oxygen concentration sensor, 60 ECU, 100, 110, 120, 130 MBT map (learning map), 102 combustion gravity center calculation portion (combustion gravity center calculating means), 104 combustion gravity center target setting portion, 106, 154 FB gain calculation portion (ignition timing correcting means), 108, 112, 122, 132, 144, 144', 156, 164, 174, 184, 196, 204, 214, 226, 234, 244 learning control portion (weight setting means and weighting learning means), 124, 134 TK map (learning map), 126, 136 Min selection portion (selecting means), 138 TK region map (learning map), 140 an air-fuel ratio calculation portion (in-cylinder air-fuel ratio calculating means), 142, 142', 160, 230 correction map (learning map), 150, 150' injection characteristic map (learning map), 152 actual injection amount calculation portion (actual injection amount calculating means), 162, 172, 182, 202, 232, 242 earning reference calculation portion (learning reference calculating means), 170 QMW map (learning map), 180 VT map (learning map), 192 misfire limit map (learning map), 194, 224 Max selection portion (selecting means), 200 fuel increase amount map (learning map), 210 ISC map (learning map), 222 misfire limit EGR map (learning map), 240 start injection amount map (learning map)

The invention claimed is:

1. An internal combustion engine control device comprising:

a learning map having a plurality of grid points and storing a learning value of a control parameter used for control of an internal combustion engine at each of the grid points, capable of being updated;

an engine control unit configured to refer to the learning map to acquire the learning value of the control parameter, and to control the internal combustion engine based on the acquired learning value of the control parameter;

weight setting unit for setting a weight of each grid point of the learning map when a value of the control parameter is acquired and for decreasing the weight of the grid point as a distance from a reference position which is a position of the acquired value of the control parameter on the learning map to the grid point becomes larger; and weighting learning unit for executing weighting learning control for updating the learning value of the respective grid points so that, each time the value of the control parameter is acquired, the larger the weight is, the more the acquired value of the control parameter is reflected in the learning value at all the grid points.

2. The internal combustion engine control device according to claim 1, wherein the learning map includes a plurality of regions different from each other; and the weight setting unit is configured to switch a decrease characteristic of the weight decreasing in accordance with the distance from the reference position for each of the plurality of regions.

3. The internal combustion engine control device according to claim 1, wherein at a grid point where the distance from the reference position is larger than a predetermined effective range, update of the learning value is prohibited.

4. The internal combustion engine control device according to claim 1, wherein the weight setting unit is a Gaussian function in which the weight decreases in a normal distribution curve state in accordance with the distance from the reference position.

5. The internal combustion engine control device according to claim 1, wherein the weight setting unit is a primary function in which the weight decreases in proportion to the distance from the reference position.

6. The internal combustion engine control device according to claim 1, wherein the weight setting unit is a trigonometric function in which the weight decreases in a sinusoidal wave state in accordance with the distance from the reference position.

7. The internal combustion engine control device according to claim 1, further comprising:

a reliability map having a plurality of grid points configured similarly to the learning map and storing a reliability evaluation value which is an index indicating reliability of the learning value at each of the grid points, capable of being updated;

reliability map weight setting unit which is unit for decreasing a reliability weight which is a weight of each grid point of the reliability map larger as the distance from the reference position to the grid point becomes larger and in which the decrease characteristic of the reliability weight is set steeper than the decrease characteristic of the weight of the learning map; and reliability map learning unit for setting a reliability acquired value having a value corresponding to reliability of the acquired value to the reference position each time the control parameter is acquired and for updating the reliability evaluation value of the respective grid points so that, the larger the reliability weight is, the more the reliability acquired value is reflected in the reliability evaluation value at all the grid points of the reliability map.

8. The internal combustion engine control device according to claim 1, wherein the learning map is a correction map storing a learning value of a correction coefficient for correcting an in-cylinder air-fuel ratio on the basis of an output of an air-fuel ratio sensor at each of the grid point, respectively;

in-cylinder air-fuel ratio calculating unit for calculating the in-cylinder air-fuel ratio on the basis of at least an output of an in-cylinder pressure sensor is provided;

the weight setting unit sets a weight at each grid point of the correction map by using a calculated value of the correction coefficient calculated on the basis of the in-cylinder air-fuel ratio after correction corrected by the correction coefficient and the output of the air-fuel ratio sensor as an acquired value of the control parameter; and the weighting learning unit is configured to update the learning value of the correction coefficient at each of the grid points on the basis of the calculated value of the correction coefficient and the weight at each of the grid points.

9. The internal combustion engine control device according to claim 1, wherein the learning map is an injection characteristic map storing a relationship between a target injection amount of a fuel injection valve and conduction time as a learning value of the conduction time at each of the grid point, respectively;

actual injection amount calculating unit for calculating an actual injection amount on the basis of at least an output of an in-cylinder pressure sensor is provided;

the weight setting unit sets a weight at each grid point of the injection characteristic map by using the conduction time after correction corrected on the basis of the target injection amount and the actual injection amount as an acquired value of the control parameter; and the weighting learning unit is configured to update the learning value of the conduction time at each of the grid points on the basis of the conduction time after correction and the weight at each of the grid points.

10. The internal combustion engine control device according to claim 1, wherein the learning map is a correction map storing a learning value of a correction coefficient for correcting an output of an airflow sensor at each of the grid points, respectively;

learning reference calculating unit for calculating a learning reference value of the correction coefficient on the basis of an output of the air-fuel ratio sensor and a fuel injection amount is provided; and the learning value of the correction coefficient is configured to be updated by executing the weighting learning control by using the learning reference value of the correction coefficient as an acquired value of the control parameter.

11. The internal combustion engine control device according to claim 1, wherein the learning map is a QMW map storing a learning value of a wall-surface fuel adhesion amount which is an amount of a fuel adhering to a wall surface of an intake passage at each of the grid points, respectively;

learning reference calculating unit for calculating a learning reference value of the wall-surface fuel adhesion amount on the basis of at least an output of an air-fuel ratio sensor is provided; and the learning value of the wall-surface fuel adhesion amount is configured to be updated by executing the weighting learning control by using the learning reference value of the wall-surface fuel adhesion amount as an acquired value of the control parameter.

12. The internal combustion engine control device according to claim 1, wherein the learning map is a VT map storing a learning value of valve timing at which fuel consumption of an internal combustion engine is optimized at each of the grid points, respectively;

learning reference calculating unit for calculating a learning reference value of the valve timing on the basis of at least an output of an in-cylinder sensor is provided; and the learning value of the valve timing is configured to be updated by executing the weighting learning control by using the learning reference value of the valve timing as an acquired value of the control parameter.

13. The internal combustion engine control device according to claim 1, wherein the learning map is a misfire limit map storing a learning value of misfire limit ignition timing which is ignition timing on the most delayed angle side capable of being realized without occurrence of a misfire by ignition timing delay-angle control at each of the grid points, respectively;

misfire limit determining unit for determining whether or not the current ignition timing is a misfire limit;

misfire limit learning unit for acquiring the ignition timing when being determined to be the misfire limit and for updating the learning value of the misfire limit ignition timing by the weighting learning control on the basis of the acquired value; and selecting unit for selecting the ignition timing on the more advance-angle side in target ignition timing delayed by the ignition timing delay-angle control and the learning values calculated by the misfire limit map are provided.

14. The internal combustion engine control device according to claim 1, wherein the learning map is a fuel increase amount map storing a learning value of a fuel increase amount value for increasing a fuel injection amount at each of the grid points, respectively; and a learning value of the fuel increase amount value is configured to be updated by the weighting learning control.

15. The internal combustion engine control device according to claim 1, wherein the learning map is an ISC map storing a learning value of an opening degree of an intake passage corrected by idle operation control at each of the grid points, respectively; and the learning value of the opening degree of the intake passage is configured to be updated by the weighting learning control.

16. The internal combustion engine control device according to claim 1, wherein the learning map is a misfire limit EGR map storing a learning value of a misfire limit EGR amount which is a maximum EGR amount capable of being realized without occurrence of a misfire by EGR control at each of the grid points, respectively;

misfire limit determining unit for determining whether or not the current ignition timing is a misfire limit;

misfire limit EGR learning unit for acquiring an EGR amount when being determined to be the misfire limit and updating the learning value of the misfire limit EGR amount on the basis of the acquired value by the weighting learning control; and selecting unit for selecting the larger EGR amount in a requested EGR amount calculated by the EGR control and the learning value calculated by the misfire limit EGR map.

17. The internal combustion engine control device according to claim 1, wherein the learning map is a correction map storing a learning value of a correction coefficient for correcting an output of an air-fuel ratio sensor, respectively;

learning reference calculating unit for acquiring an output value of the air-fuel ratio sensor when an output of an oxygen concentration sensor becomes an output value corresponding to a stoichiometric air-fuel ratio as a reference output value and calculating a learning reference value of the correction coefficient on the basis of the reference output value is provided; and the learning value of the correction coefficient is configured to be updated by executing the weighting learning control by using the learning reference value of the correction coefficient as an acquired value of the control parameter.

18. The internal combustion engine control device according to claim 1, wherein the learning map is a start injection amount map storing a learning value of a start injection amount of a fuel injected at start of an internal combustion engine, respectively;

learning reference calculating unit for calculating a learning reference value of the start injection amount on the basis of at least an output of an in-cylinder pressure sensor; and the learning value of the start injection amount is configured to be updated by executing the weighting learning control by using the learning reference value of the start injection amount as an acquired value of start injection amount.

19. An internal combustion engine control device comprising:

an MBT map which is a learning map having a plurality of grid points and storing a learning value of an MBT which is ignition timing when a torque of an internal combustion engine becomes a maximum at each of the grid points, capable of being updated;

combustion gravity center calculating unit for calculating a combustion gravity center on the basis of an in-cylinder pressure;

ignition timing correcting unit for correcting the ignition timing calculated by the MBT map so that the combustion gravity center matches a predetermined combustion gravity center target value;

weight setting unit which is unit for setting a weight of each grid point of the MBT map on the basis of the ignition timing after correction by the ignition timing correcting unit, respectively, and for decreasing the weight of the grid point such that, the larger a distance from a reference position which is a position of the ignition timing after correction on the MBT map to the grid point is, the more the weight of the grid point is decreased; and weighting learning unit for executing weighting learning control updating the learning value of the respective grid points so that, if the combustion gravity center matches the combustion gravity center target value, at all the grid points, the larger the weight is, the more the ignition timing after correction is reflected in the learning value of the MBT.

20. The internal combustion engine control device according to claim 19, wherein an update amount of the learning value in a transition operation of an internal combustion engine is configured to be suppressed as compared with that in a steady operation.

21. The internal combustion engine control device according to claim 19, further comprising:

MBT estimating unit for estimating an MBT on the basis of a difference between the combustion gravity center and the combustion gravity center target value and the ignition timing after correction; and MBT full-time learning unit which is unit used instead of the weighting learning unit and for updating the learning value of the MBT by the weighting learning control even if the combustion gravity center is deviated from the combustion gravity center target value and for lowering a degree of reflection of the estimated value of the MBT in the learning value as the difference between the combustion gravity center and the combustion gravity center target value becomes larger.

22. The internal combustion engine control device according to claim 19, further comprising:

a TK map which is a learning map having a plurality of grid points configured similarly to the MBT map and storing a learning value of TK ignition timing which is ignition timing in a trace knock region at each of the grid points, capable of being updated, respectively;

TK ignition timing learning unit for acquiring the ignition timing when the trace knock occurs before the MBT is realized and for updating the learning value of the TK ignition timing on the basis of the acquired value by the weighting learning control; and selecting unit for selecting the ignition timing on a more delayed angle side in the learning values calculated by the MBT map and the learning values calculated by the TK map.

23. The internal combustion engine control device according to claim 22, further comprising:

a TK region map which is a learning map having a plurality of grid points configured similarly to the TK map and storing a learning value on whether or not the respective grid points of the TK map belong to a trace knock region at each of the grid points, capable of being updated, respectively; and TK region learning unit for updating the learning value of the TK region map by the weighting learning control when the TK ignition timing is acquired.

24. The internal combustion engine control device according to claim 19, further comprising:

a reliability map which is a learning map having a plurality of grid points configured similarly to the MBT map and storing a reliability evaluation value reflecting a learning history of the MBT at each of the grid points, capable of being updated, respectively; and reliability map learning unit for updating the reliability evaluation value by the weighting learning control on the basis of the reference position when the MBT map is updated.

* * * * *